US006293414B1

(12) United States Patent
Stuart

(10) Patent No.: US 6,293,414 B1
(45) Date of Patent: Sep. 25, 2001

(54) SIDE PANEL SHELVING SYSTEM

(75) Inventor: Timothy Scott Stuart, Potomac, MD (US)

(73) Assignee: Stuart Shelving LLC, Potomac, MD (US)

( * ) Notice: Subject to any disclaimer, the term of this patent is extended or adjusted under 35 U.S.C. 154(b) by 0 days.

(21) Appl. No.: 09/722,218

(22) Filed: Nov. 27, 2000

Related U.S. Application Data

(62) Division of application No. 09/259,078, filed on Feb. 26, 1999, now Pat. No. 6,230,907.
(60) Provisional application No. 60/076,398, filed on Feb. 28, 1998.

(51) Int. Cl.[7] ..... A47F 5/00
(52) U.S. Cl. ..... 211/87.01; 211/90.02; 211/90.04; 312/245; 108/108; 108/152
(58) Field of Search ..... 312/245; 108/106, 108/107, 149, 152, 108; 211/90.01, 90.02, 90.03, 90.04, 87.01, 103, 187, 186, 135, 134, 181.1

(56) References Cited

U.S. PATENT DOCUMENTS

Re. 28,994 * 10/1976 Aylworth ..... 312/245
2,031,718 * 2/1936 Kress ..... 211/87.01
3,563,626 * 2/1971 Ferdinand et al. .
3,604,669 * 9/1971 Asher ..... 211/134 X
3,701,325 * 10/1972 Fenwick ..... 108/152 X
3,712,696 * 1/1973 McDonnell ..... 312/245 X
3,729,113 * 4/1973 Lopatka .
3,948,581 * 4/1976 Helman et al. ..... 312/245 X
4,148,535 * 4/1979 Fenwick .
4,270,821 * 6/1981 Verdesca ..... 312/245
4,324,379 * 4/1982 Ovitz .
4,558,647 * 12/1985 Petersen ..... 211/181.1 X
4,697,712 * 10/1987 Valinlis ..... 211/187
5,893,616 * 4/1999 MacDonald et al. ..... 312/245
6,193,085 * 2/2001 Nook et al. ..... 211/187

* cited by examiner

*Primary Examiner*—Robert W. Gibson, Jr.

(57) ABSTRACT

A wall-mounted shelving system comprising a plurality of elongated vertical standards secured to a wall, each elongated standard having a vertical axis and a plurality of slots; a plurality of shelf brackets removably connected with said standards via said slots; one or more shelves supported by said shelf brackets; and a plurality of side panels supported by said shelves and serving to enclose said shelves at their ends. Each side panel has means for easily and removably attaching to the ends of said shelves and thus said side panels are suitable for both new installations and retrofitting existing shelving. An embodiment of the invention formed from wire is also described.

17 Claims, 42 Drawing Sheets

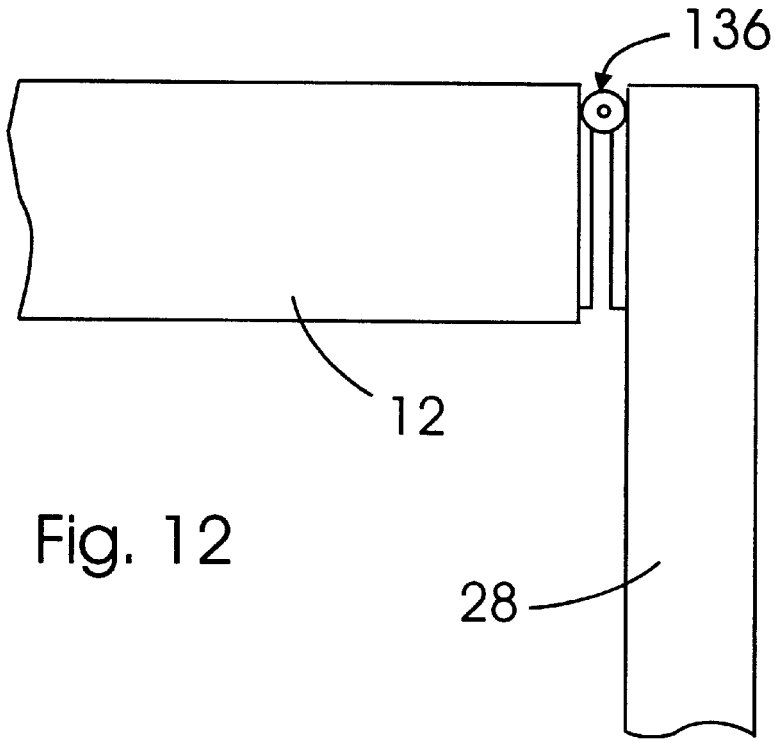
Fig. 12
Fig. 13
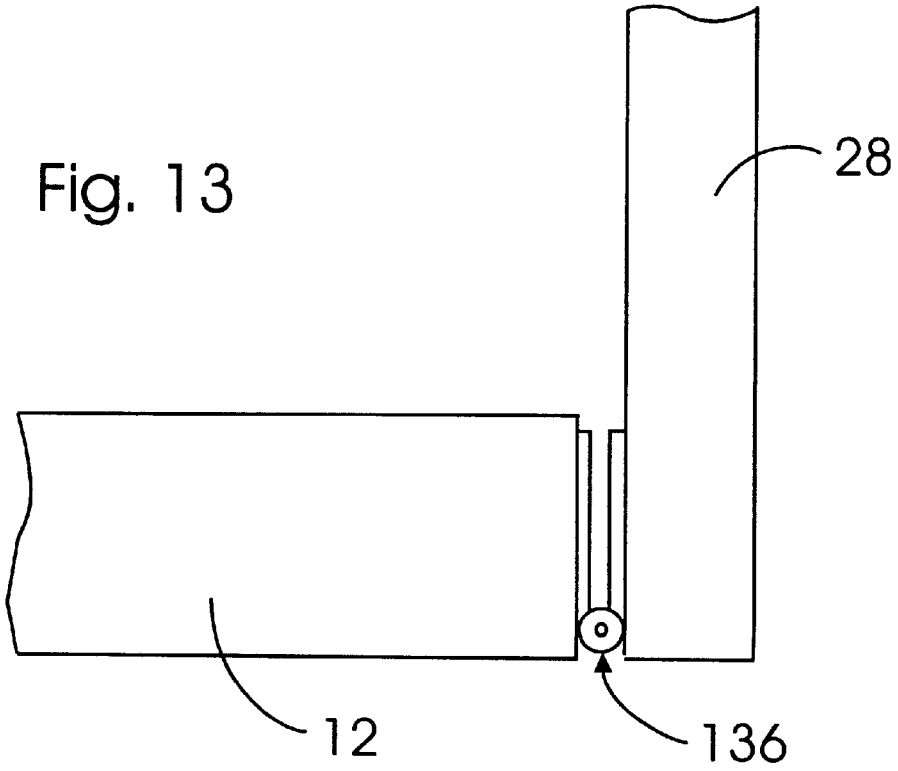

Fig. 41
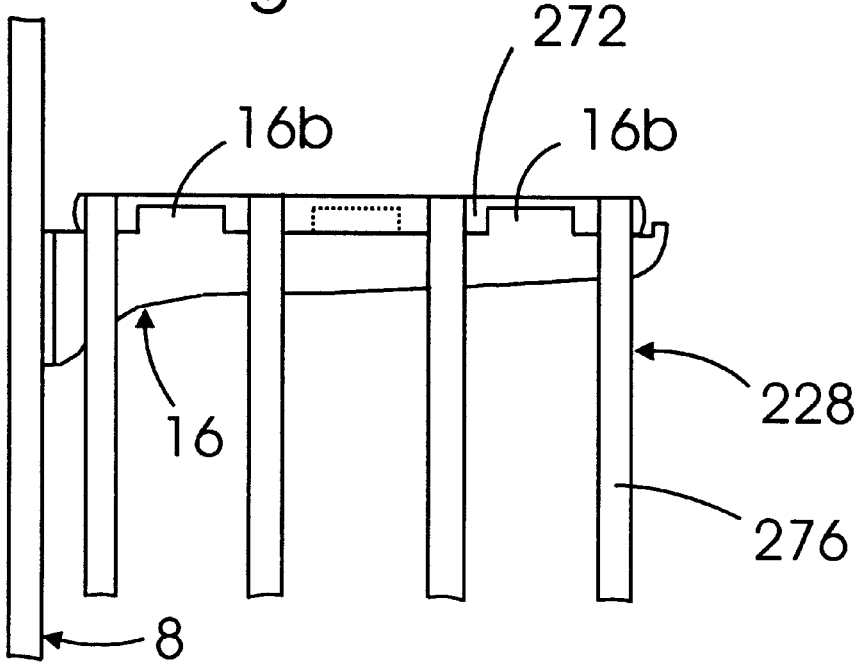
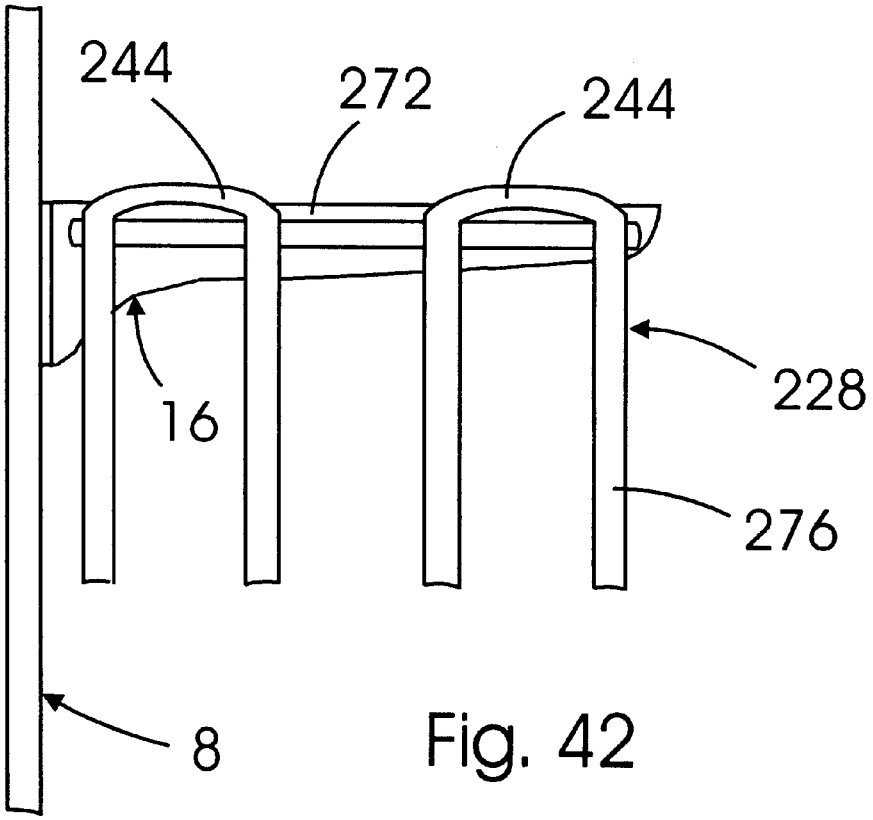
Fig. 42

SIDE PANEL SHELVING SYSTEM

This application is a division of application Ser. No. 09/259,078, filed Feb. 26, 1999 now U.S. Pat. No. 6,230,907 which also claims the benefit of Provisional Patent Application No. 60/076,398; filed Feb. 28, 1998.

BACKGROUND OF THE INVENTION

This invention relates to adjustable shelving and, in particular, to adjustable shelving of the type in which brackets are mounted in perforated vertical supports. This shelving system also is well suited for use with means for firmly but reversibly attaching such items as bookends, signs and lamps to shelving as described in the U.S. Patents to Stuart (U.S. Pat. Nos. 5,655,670; 6,044,982; and 6,119,992) which reference, in turn, U.S. Provisional Patent Applications Nos. 60/057,230; 60/061,045; and 60/064,042). This application claims the benefit of Provisional Patent Application No. 60/076,398 filed Feb. 28, 1998.

BRIEF DESCRIPTION OF THE PRIOR ART

Shelving systems, as well as display stands and showcases come in a variety of configurations and styles. Depending upon the nature of the articles to be stored or displayed, many utilize sections of shelves affixed to a supporting wall or pedestal. A very popular type of shelving system includes vertical standards having a longitudinal series of slots, so that when the standards are mounted on a vertical wall surface they may receive outwardly projecting, horizontal blade-like brackets (for example, see U.S. Pat. No. 1,983,470). The brackets are usually provided with hooks or ears to permit the brackets to be engaged in selected slots of the standards. In this way, the brackets are adapted to support shelves at selected locations and at selected distances from one another.

Appearance: Cantilever shelving described in the prior art is generally not attractive in appearance. Conventional brackets of the type described are often formed from sheet metal with nose portions that project beyond the front edges of the shelves to keep the shelves from sliding off the brackets. Thus, the unattractive brackets and standards are exposed. Cantilever shelving systems are therefore usually mounted in garages, recreation rooms and the like, but not in living rooms, dining rooms, retail areas and offices where the setting is more dressy.

Attempts have been made in the prior art to enhance the appearance of shelving systems of the general type described above. It has been proposed, for example, to embed hooks or support plates within wooden shelf brackets. Another approach involves using a standard and bracket assembly with an off-set bracket and a cover over the openings in the standard (see U.S. Pat. No. 5,277,393). This particular approach is only partially successful in that it does not improve the appearance of the bracket. These approaches also would require discarding the shelf brackets now in use, and substituting completely new brackets or equivalent shelf mounts.

Other systems apply a sleeve-like covering to the bracket, however, these systems have several disadvantages. First, they cover only the bracket and do not cover the standard. Second, they require that the covering be secured using, for example, shims or adhesive metal tape provided with gripping teeth or protrusions, thus requiring additional assembly by the user. Still other systems secure the covering to the bracket by cutting a groove in the decorative covering which is slightly smaller than the bracket so that the bracket is held in place by friction. This limits the size of the bracket which may be employed and may permit the bracket to become dislodged. Yet another approach involves a cumbersome decorative covering that conceals both the standard and shelf bracket (see U.S. Pat. No. 5,560,580).

The prior art thus has not solved the problem of easily and decoratively covering conventional shelf brackets and standards in a manner which conceals both the unattractive horizontal blade-like arms and the unattractive vertical standards.

Accidental Dislodgement and Side Sway: Prior art shelf assemblies often have the problem that the shelf portion of the assembly is not secured to the shelf mounting brackets, thus permitting accidental movement. Unsecured shelves may be very undesirable, for example, if objects are to be placed on the shelf without evenly distributing their weight, causing the shelf to become unbalanced.

Although some shelf assemblies may overcome this problem by securing the shelf to the mounting brackets, excessive effort may then be required for disassembly to remove or replace a single shelf. Often a shelf needs replacement or repair because of damage or deterioration. It may also be desirable to change the color or style of a shelf for aesthetic reasons.

A disadvantage of the brackets usually used for cantilever shelving is potential side to side sway. In order to limit side sway of such brackets, the brackets have previously been provided with special features such as a transverse clip as in U.S. Pat. No. 1,983,470 or use of double brackets for each standard. Prior devices have also included saddle type clips on the brackets or adhesives (see for example U.S. Pat. No. 5,069,408). However, the adhesive tends to lock the shelf in place and thus interferes with repositioning the shelf as needed for later changes in the shelving system.

Ease of Assembly: Many of the shelving systems described in the prior art are difficult to assemble. Shelving systems are typically provided as knock-down kits for assembly at the user's location, thus minimizing shipping costs by avoiding the need to transport bulky assemblies. Assembly of these units then becomes the task of the user, who is typically unfamiliar with the assembled design, and this requires the location and identification of a multitude of parts, and an understanding of packaged instructions concerning their assembly. The problems with this approach are based on complicated prior art designs, which do not lend themselves to quick construction.

In addition, it would be an advantage to provide the shelving system in a form that allowed upgrading existing shelving, thus providing greater function and enhanced appearance at low cost.

Wire Rod Construction: It would also be an advantage to provide the shelving system in a wire rod version. Wire shelving has long been used in institutional settings, but in recent times has gained popularity in domestic new construction and remodeling. Wire shelving has largely replaced wood and particle board in areas such as kitchen cabinets, bedroom closets and linen closets.

A number of shelving supports and shelving systems have been developed using wire shelving (see, for example, U.S. Pat. Nos. 4,624,376; 4,669,692; 5,355,819; 5,592,886; 5,346,077; 3,294,351; 4,603,781 and 3,993,002). However, the prior art does not meet the need for a shelving system with an improved appearance, reduced side sway and reduced accidental dislodgement.

Enclosures, including Doors: It is frequently desirable to provide partial or full enclosures to shelving. Such enclosures are useful in avoiding articles or items from falling off the shelves and breaking or becoming lost or misplaced. Some enclosed shelving include only enclosures of the side and rear portions of the shelving. These enclosures, while providing protection to the items on the shelves, also provides convenient access to the items. Other types of enclosures include doors which can be used as a security unit.

Enclosures are also useful in an office or retail setting. For example, retail stores use a variety of fixtures to display merchandise for sale. Thus some merchandise may be displayed on tables, while other merchandise may be displayed on open shelves either arranged along the walls or as a component of free standing "gondolas". Some units provide open shelves in the top portion for displaying merchandise and a closed storage compartment in the lower half of the unit. Frequently considerations of theft and security must be taken into account and in such cases it is typical to display merchandise in a limited access enclosure.

Enclosures for shelving are know in the prior art (see, for example, U.S. Pat. Nos. 4,509,805; 4,318,576; and 4,148,535). However, the prior art generally uses sliding doors that fit into grooves in specially designed shelves or the enclosures are designed for free-standing rather than wall-mounted shelving.

One Standard Construction: It would also be an advantage to provide the shelving system as a version requiring one, rather than two or more vertical standards. Such a version would be particularly useful in a confined location, e.g., at the end of a display case. The prior art (for example, see U.S. Pat. No. 5,253,835) generally requires the use of a modified shelf bracket assembly for such shelving.

One Shelf Version: It would also be an advantage to provide the shelving system as a one shelf version for use when one shelf would suffice. Much of the prior art (see, for example, U.S. Pat. Nos. 4,508,301; 4691887; 4,934,642; 5,575,444; and 5,692,717) uses a horizontal rail for supporting a single shelf as a cantilever and thus requires an expensive continuous rail. Several other approaches are also described in the prior art (see, for example, U.S. Pat. Nos. 4,361,099; 4,010,697; and 4,685,575) but these approaches are intended for use in a recess such as a window opening, or require awkward and unsightly support rods either above or below the shelf.

Combination of Standards with Sheet Metal or Plastic Shelves: It would also be an advantage to provide a version of the shelving system that combines sheet metal or plastic shelving with vertical standards, thus combining much of the strength and stability of wall-mounted shelving with the low cost and light weight of plastic or sheet metal shelving.

The prior art describes a number of free-standing sheet metal or plastic shelving systems (see, for example, U.S. Pat. Nos. 4,138,953; 5,127,342; 5,350,073 and 5,779,070) which typically use comer posts with a series of shelves supported at spaced positions on the posts. A common basic configuration comprises four uprights supporting three or more rectangular shelves, the uprights being positioned to provide a support at each of the four comers of the shelves. However, the prior art apparently does not describe the combination of wall-mounted standards with sheet metal or plastic free-standing shelving.

SUMMARY OF THE INVENTION

It is a primary object of the present invention to provide a wall-mounted shelving system for easily, conveniently, and inexpensively storing and displaying objects, with said system being well suited for use with previously described lever clamps, clamping bookends, and screw fasteners for firmly but reversibly attaching such items as signs, lamps and bookends to the horizontal and vertical surfaces of said shelving system.

It is also an object of the invention to provide a means for mounting a plurality of shelves on a wall or similar support surface at varying heights and in different configurations to accommodate and support items of various sizes and to meet various storage requirements.

It is a more specific object of the invention to provide a shelving system with side panels, doors, lids and drawers for shelving installed using conventional shelving standards.

Another object of the invention is to provide a wall-mounted shelving system that is easy and economical to manufacture.

A further object of the invention is to provide a shelving system that is attractive in appearance.

Still a further object of the present invention is to provide a wall mounting system for shelves that will securely hold the shelves in place so that they will not be inadvertently disengaged.

Yet another object of the invention is to provide a shelving system with less side to side sway.

It is another object of the present invention to provide a shelving system which can be easily assembled.

It is another object of the present invention to provide a shelving system in a form that allows easy upgrading of existing shelving.

Still another object of the present invention is to provide a shelving system of open wire construction.

Yet a further object of the present invention is to provide a version of the shelving system requiring one, rather than two or more vertical standards.

It is also a more specific object of the invention to provide a shelving system suitable for commercial use, e.g., in retail stores.

It is also a more specific object of the invention to provide a shelving system with slanted display shelves supported by a slanted shelf bracket.

It is also a more specific object of the invention to provide a shelving system suitable for use with a single shelf.

It is also a more specific object of the invention to provide a shelving system with panels that connect directly with one or more wall standards.

It is also a more specific object of the invention to provide a shelving system which uses a combination of free-standing sheet metal or plastic shelving and wall mounted standards for easily, conveniently, and inexpensively storing and displaying objects.

It is also a more specific object of the invention to provide a shelf installation guide.

It is also a more specific object of the invention to provide a shelving system which uses one standard and one panel for storing and displaying objects.

It is also a more specific object of the invention to provide a shelving system which uses several shelves and one standard for storing and displaying objects.

BRIEF DESCRIPTION OF THE DRAWINGS

Other objects and advantages of the invention will become apparent from a study of the following specification when viewed in the light of the accompanying drawings, in which:

FIG. 12 is a side view of a butt hinge for fastening a lid to a shelf where said door opens up;

FIG. 13 is a side view of a butt hinge for fastening a lid to a shelf where said door opens down;

FIG. 41 is a side view of a wire side panel fastened to a shelf bracket via cradle portions of the shelf bracket;

FIG. 42 is a side view of a wire side panel fastened to a shelf bracket via hangers at the top end of the side panel;

DETAILED DESCRIPTION

Figure 1:
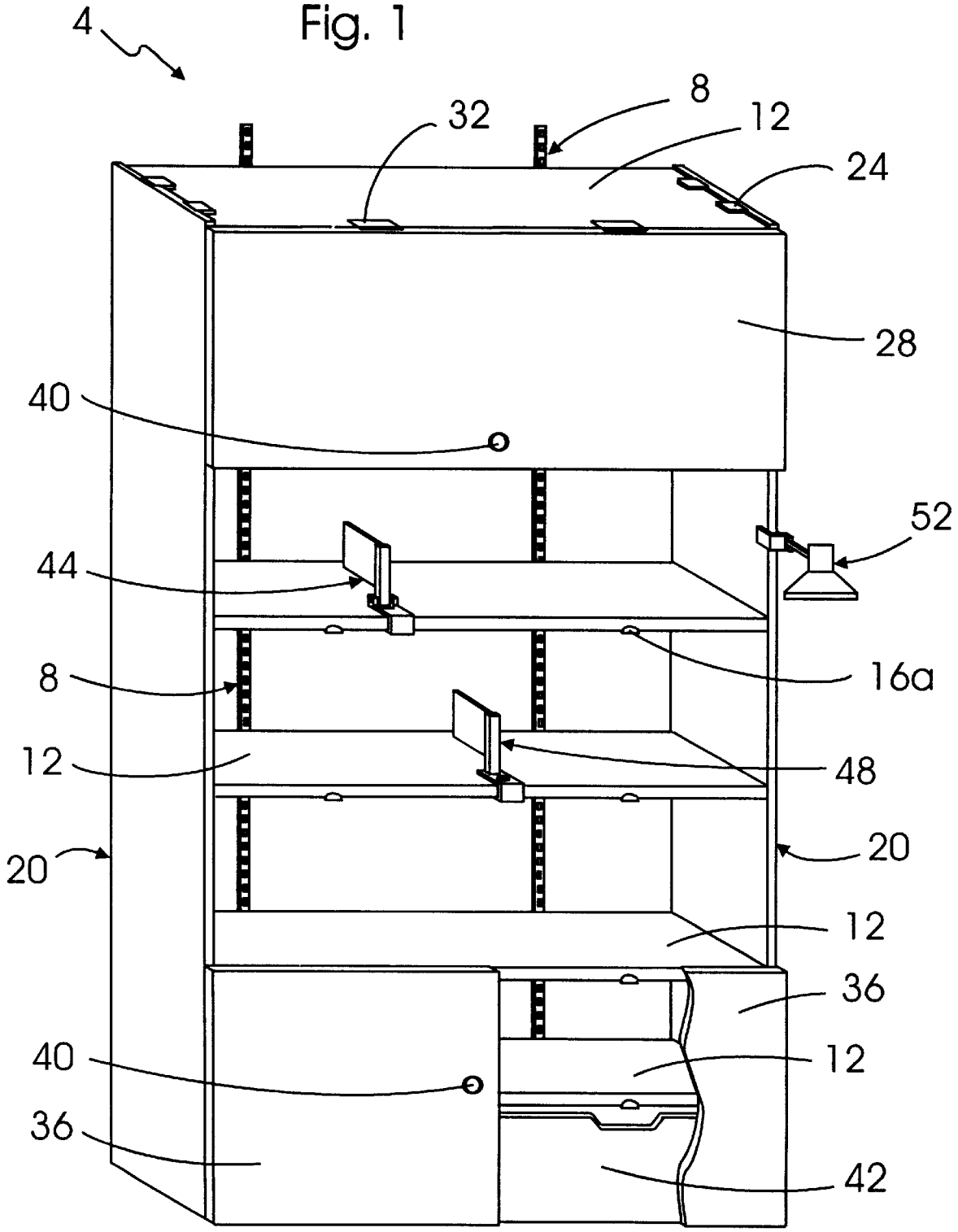
FIG. 1 is a front perspective view of shelving system according to the invention.

Referring first to FIG. 1, there is shown a shelving system 4 with wall uprights, tracks or standards 8, shelves 12, shelf brackets 16, side panels 20 and top-hung door or lid 28 and side-hung doors 36. So as to not interfere with the operation of the optional shelf doors, the shelf brackets 16 are modified so that the ends of the bracket which retain the front of the shelf, i.e., the retainer portions 16*a* furthest away from the standards 8, are shaped, e.g., bent back to be parallel to the front of the shelves, so they do not protrude significantly. The side panels are held in place by fasteners 24. Several embodiments for shown below for fastening the side panels to the shelves. If desired, the side panels can be provided as several sections that fit together at their top and/or bottom edges (not shown). The lid 28 is supported by hinge supports 32 as are the side-hung doors 36 (not shown). Several embodiments are also shown below for fastening doors and lids to the side panels or shelves. The doors also have knobs 40. A drawer 42 and shelf 12 are provided behind the side-hung doors 36. The drawer 42 is mounted on side mount drawer slides (not shown) connected to the side panels 20. A previously described clamping bookend partition 44 and screw fastener partition 48 are attached to the shelves and a previously described lamp 52 is attached to the side panel 20. For previously described items, please see the above referenced patents by Stuart. In general, the side panels and doors are usually formed to be light in weight so as to be easy to assemble and also so as to not significantly interfere with the weight-bearing function of the shelves. Also, if desired, e.g., for display purposes, the doors and/or side panels can be formed from transparent material such as glass or some types of plastic. In addition to providing a mounting surface for lighting, signs, literature dispensers, etc. and helping provide useful storage areas, the side panels also help keep goods secure from theft or damage, particularly when doors are attached to the side panels or shelves. The side panels are designed for easily installation on existing shelving and thus the side panels and other components of the shelving system can be added as an upgrade. The above components are formed of strong durable materials such as, for example, metal, wood, or plastic.

Figure 2:
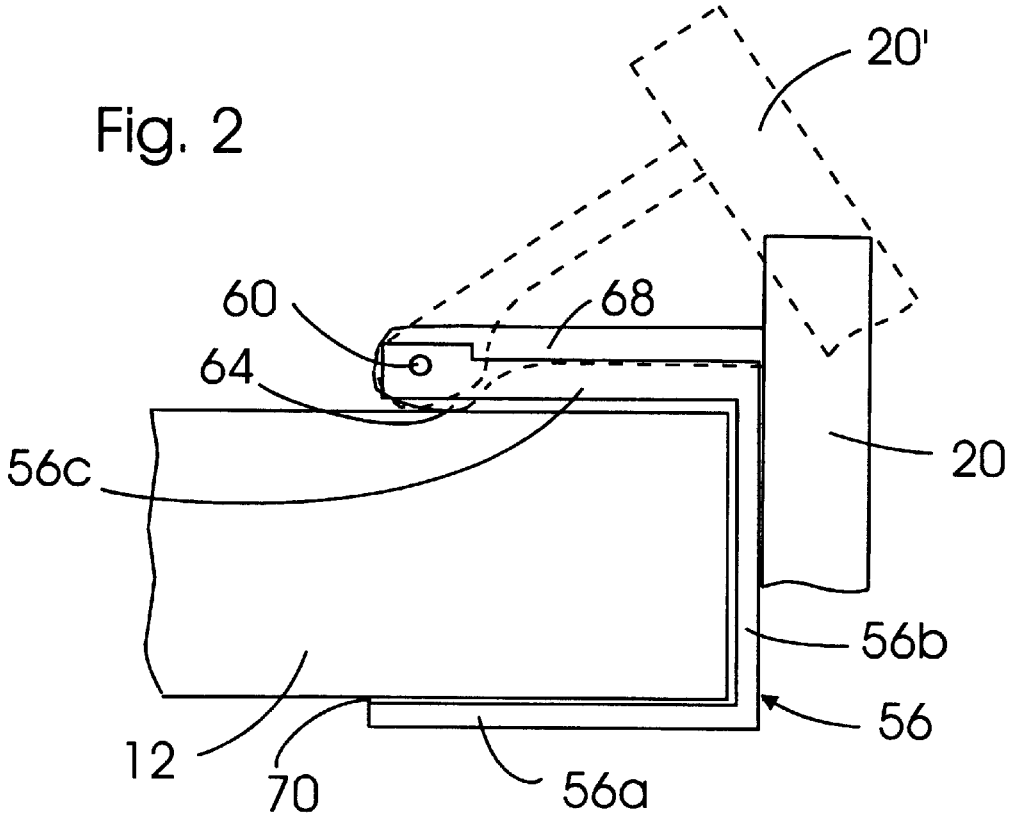
FIG. 2 is a front view of a clamp and cam assembly for fastening a side panel to a shelf.

FIG. 2 shows a cam 64 and clamp 56 for fastening a side panel 20 to a shelf 12. The cam arm 68 is attached to a cam 64 and a side panel 20 and the cam 64 engages the top of the shelf 12. The cam is attached via the cam pivot pin 60 to a clamp 56 consisting of a lower leg portion 56*a,* a middle connecting portion 56*b* and a upper leg portion 56*c* which is generally parallel to lower leg portion 56*a*. Analogous to the clamping bookend described by Stuart (U.S. Pat. No. 5,655,670), the upper leg portion 56*c* contains an opening (not shown) that receives the cam 64. The leg portions 56*a,* 56*c* and connecting portion 56*b* define a slot 70 that receives a shelf 12 therein. The above components are formed of strong durable materials such as, for example, wood, metal, or plastic.

The operation of the cam and clamp can be summarized as follows: With the side panel in the raised, disengaged, or opened position 20' shown in phantom, where the cam arm is moved away from being parallel to leg portions 56*a* and 56*c,* the clamp 56 is placed on a shelf 12. The clamp is sized such that the slot 70 is slightly larger than the thickness of the shelf and the shelf fits loosely within the slot. Once placed on the shelf. the side panel 20 is lowered by hand, whereby the cam 64 extends into slot 70 through the opening in the upper leg portion 56*c* and engages the upper surface of the shelf 12, thereby wedging the shelf between the cam and the lower leg portion 56*a* of the clamp. The clamping force generated by the cam is sufficient to firmly maintain the side panel on the shelf without marring or otherwise damaging the shelf. The cam and clamp can be removed from the shelf by lifting the side panel to the raised or opened position 20' so that the cam no longer engages the shelf.

As disclosed for the clamping bookend and related clamp in U.S. Pat. Nos. 5,655,670 and 6,044,982 to Stuart, it will be recognized that the clamping force can be varied to avoid damaging the shelf by changing the size or rigidity of the cam 64. In addition, the clamping force can be increased by increasing the roughness of the cam which engages the shelf or by placing shims or pads between the cam 64 and the shelf 12 or between the lower leg portion 56*a* of the clamp and the shelf.

Figure 3:
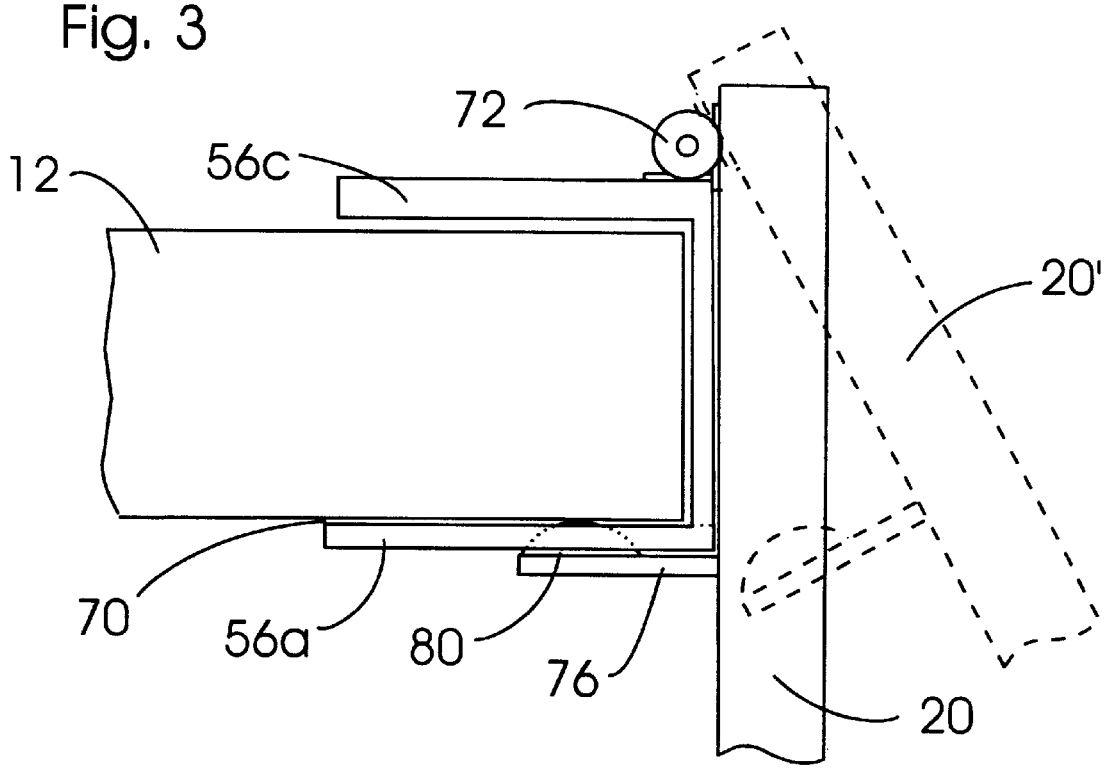
FIG. 3 is a front view of a clamp and clamping foot assembly for fastening a side panel to a shelf.

FIG. 3 shows an alternative embodiment, i.e., a clamping foot 76, clamping foot pad 80 and clamp 56 for fastening a side panel 20 to a shelf 12. The clamping foot 76 is attached to a side panel 20 and a clamping foot pad 80. The clamping foot pad 80 engages the lower surface of the shelf 12. The side panel, clamping foot and clamping foot pad are attached via a clamp hinge 72 to a clamp 56 consisting of a lower leg portion 56*a,* a middle connecting portion 56*b* and a upper leg portion 56*c* which is generally parallel to leg portion 56*a*. The lower leg portion 56*a* contains an opening (not show) that receives the clamping foot pad 80. Leg portions 56*a,* 56*c* and connecting portion 56*b* define a slot 70 that receives a shelf 12 therein. The above components are formed of strong durable materials such as, for example, wood, metal, or plastic.

The operation of the clamping foot and clamp can be summarized as follows: With the side panel in the raised, disengaged, or opened position 20" shown in phantom, where the clamping foot is moved away from being parallel to leg portions 56*a* and 56*c,* the clamp 56 is placed on a shelf 12. The clamp is sized such that the slot 70 is slightly larger than the thickness of the shelf and the shelf fits loosely within the slot. Once placed on the shelf, the side panel 20 is lowered by hand, whereby the clamping foot pad 80 extends into slot 70 through the opening in the lower leg portion 56*a* and engages the lower surface of the shelf 12, thereby wedging the shelf between the clamping foot pad 80 and the upper leg portion 56*c* of the clamp. The clamping force generated by the clamping foot and clamping foot pad is sufficient to firmly maintain the side panel on the shelf without marring or otherwise damaging the shelf. The side panel can be removed from the shelf by lifting the side panel to the raised or open position 20' so that the clamping foot pad 80 no longer engages the shelf 12.

As disclosed for the clamping bookend and related clamp in U.S. Pat. Nos. 5,655,670 and 6,044,982 to Stuart, it will be recognized that the clamping force can be varied to avoid damaging the shelf by changing the size or rigidity of the clamping foot 76 and/or clamping foot pad 80. In addition, the clamping force can be increased by increasing the roughness of the clamping foot pad which engages the shelf or by placing shims or pads between the clamping foot pad 80 and the shelf 12 or between the upper leg portion 56*c* of the clamp and the shelf.

Figure 4:
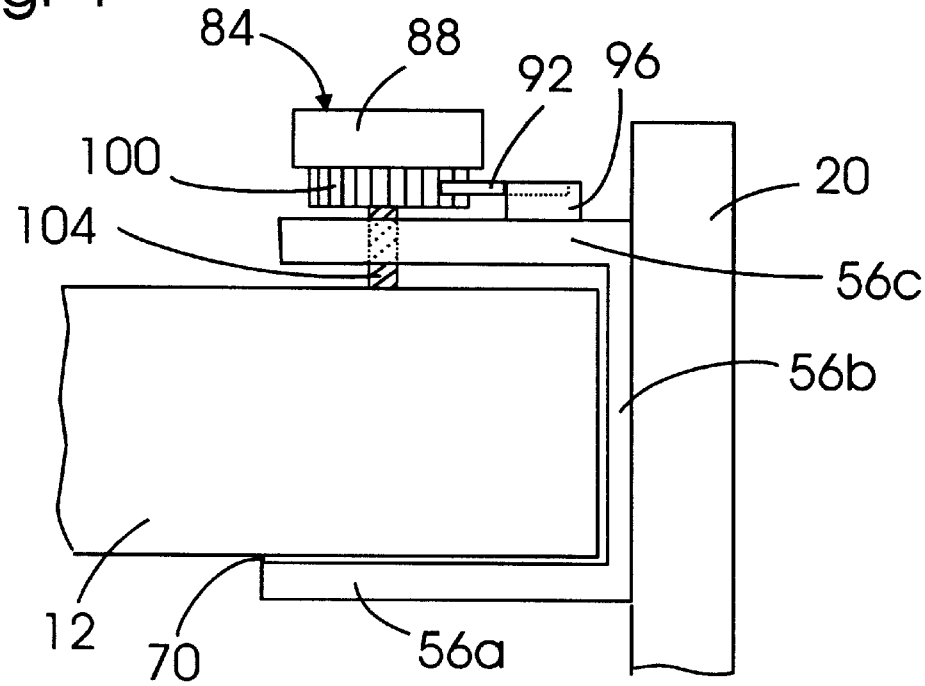
FIG. 4 is a front view of a clamp and screw fastener assembly for fastening a side panel to a shelf.

FIG. 4 shows a screw fastener 84 and clamp 56 for fastening a side panel 20 to a shelf 12. A similar clamp and screw fastener for fastening bookends, partitions, or banding and/or binning to shelves or other objects were disclosed in U.S. Patents to Stuart (U.S. Pat. Nos. 6,044,982; and 6,119,992). The above components are formed of strong durable materials such as, for example, wood, metal, or plastic.

The structure and function of the clamp 56 and screw fastener 84 can be summarized as follows: The clamp 56 includes a lower leg portion 56*a,* an upper leg portion 56*c* which is generally parallel to leg portion 56*a,* and a connecting portion 56*b.* Leg portions 56*a,* 56*c* and connecting portion 56*b* define a slot 70 which receives a shelf 12 therein. The screw fastener 84 rotates in a threaded opening in the upper leg portion 56*c* and reversibly presses against the shelf. The clamp 56 is attached to the side panel 20 and is sized such that slot 70 is slightly larger than the thickness of the shelf and the shelf fits loosely within the slot. With the screw fastener knob 88 rotated so that the screw fastener stud 104 does not significantly protrude into the slot 70, the clamp 56, screw fastener 84 and side panel 20 are placed on a shelf 12. Once placed on the shelf, the screw fastener knob 88 is rotated so that the end of the screw fastener stud 104 extends into slot 70 and engages the surface of the shelf 12, thereby wedging the shelf between the end of the screw fastener stud 104 and the lower leg portion 56*a* of the clamp. As the screw fastener 88 is rotated, the clamp 56 is pushed against the shelf 12, thus forming a tight fit between the shelf and the clamp and securely fastening the clamp to the shelf at a selected location. If desired, the end of the screw fastener stud 104 can be provided with a screw fastener pad (not shown) to help prevent marring of the surface of the shelf.

The screw fastener 84 is equipped with a previously described optional latch consisting of a rachet wheel 100, spring 92, and a spring mount 96 to reversibly retain said screw fastener in the tightened or operative position after rotation. The rachet wheel, spring, and spring mount are formed of a strong durable material such as metal or plastic. The rachet wheel 100 is formed as an integral component of the screw fastener knob 88, while the spring 92 is connected to spring mount 96 which is connected to the clamp 56. The spring 92 is oriented so that it presses against the teeth of the rachet wheel 100. The end of the spring 92 that engages the teeth of the rachet wheel is shaped so as to allow free rotation of said rachet wheel 100, and thus the connected screw fastener stud 104, in the direction that moves the stud toward the shelf 12, i.e., as the grip is increased and the clamp and side panel is installed. However, the spring 100 does not allow free rotation of the screw fastener stud 104 in the direction that moves the stud away from the shelf 12, i.e., as the grip is reduced. Rotation in this direction is only feasible by pressing the spring 92 so as to release said spring from the teeth of said rachet wheel 100. Since, during rotation of the screw fastener 84, the screw fastener and the related rachet wheel 100 move relative to the spring 92, either the rachet wheel 100 or spring 92 are formed of a large enough thickness for said rachet wheel and said spring to stay engaged during the operational length of travel of the screw fastener. The embodiment shown provides a rachet wheel 100 that is thicker than the spring 92.

It will be noted that the knob 88, rachet wheel 100 and stud 104 may be formed as one piece or unit of hard material such as metal or rigid plastic, while the spring 92 and spring mount 96 may be formed of one piece of a slightly more flexible material such as a semi-flexible plastic.

As disclosed for the screw fastener bookend and a related clamp in the U.S. Patent by Stuart U.S. Pat. No. 6,119,992, the grip generated by a screw fastener 84 is sufficient to firmly maintain the bookend on the shelf without marring or otherwise damaging the shelf. It will be recognized that the grip can be varied by changing the diameter of the screw fastener knob 88 since, when the screw fastener is operated by hand, the larger the diameter of the screw fastener knob 88, the greater the amount of force that can be provided by the knob to the screw fastener stud 104. Also, the amount of force per each unit of surface area of the engaged surface of the shelf from the screw fastener stud 104 can be regulated by changing the diameter of the screw fastener stud 104, since decreasing the diameter of the stud increases the amount of force per each unit of surface area of the shelf. As noted above, a screw fastener pad (not shown) can be provided on the end of the screw fastener stud to help prevent marring of the shelf surface. In addition, the grip generated by the screw fastener 84 can be increased by increasing the roughness of the end of the screw fastener stud 104 which engages the shelf. Additional means for ensuring that a screw fastener used to fasten a bookend to a shelf does not damage the shelf are disclosed in the Patent Application referenced above.

It will be noted that the screw fastener and clamp assembly would also be suitable for fastening the side panel 20 to lower shelves 12 so as to hold the lower portion of the side panel in place and thereby add rigidity to the shelving system.

Figure 5:
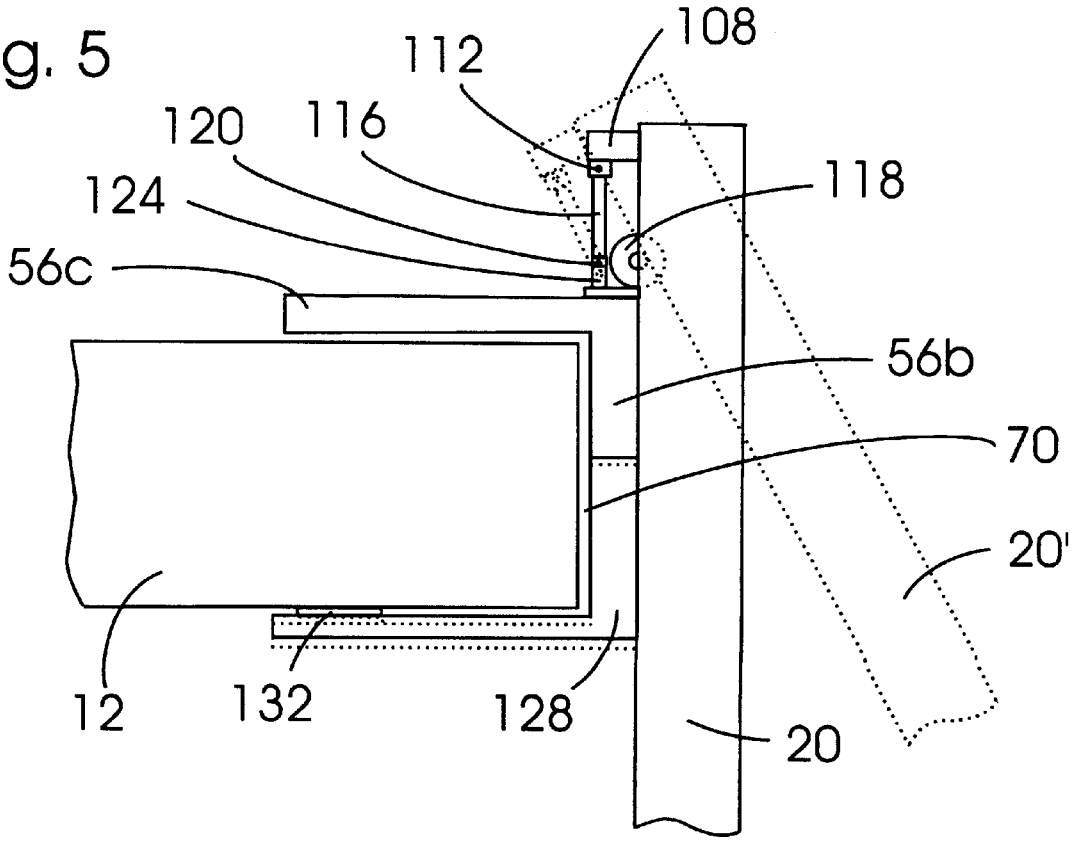
FIG. 5 is a front view of a clamp, pull rod and clamping leg assembly for fastening a side panel to a shelf.

FIG. 5 shows a pull rod 116 and clamp 56 with a clamping leg 128 for fastening a side panel 20 to a shelf 12. The upper portion of the pull rod 116 is attached, via a upper pull rod pin 112 to a pull rod support 108, which is attached to a side panel 20. The side panel is attached to the clamp 56 by a hinge 118. The lower portion of the pull rod is attached, via a lower pull rod pin 120, to a leg rod 124 which is attached to the clamping leg 128. The upper leg portion 56*c* and connecting portion 56*b* of the clamp 56, together with the clamping leg 128 and pad 132 define a slot 70 which receives a shelf 12 therein. The pad 132 engages the lower surface of the shelf 12. The above components are formed of strong durable materials such as, for example, wood, metal, or plastic.

The operation of the pull rod 116, clamp 56 and clamping leg 128 can be summarized as follows: With the side panel in the raised, disengaged, or opened position 20''' shown in phantom, the clamp 56 and clamping leg 128 are placed on a shelf 12. The clamp and clamping leg 128 are sized such that the slot 70 is slightly larger than the thickness of the shelf and the shelf fits loosely within the slot. Once placed on the shelf, the side panel is lowered by hand, whereby the pull rod is pulled upward as the side panel rotates around the hinge 118. As the pull rod 116 is pulled upward, it pulls the clamping leg 128 and pad 132 upward forcing the pad against the bottom of the shelf 12, thereby wedging the shelf between the pad and the upper leg portion 56*c* of the clamp. The clamping force generated by the pull rod is sufficient to firmly maintain the side panel on the shelf without marring or otherwise damaging the shelf. The side panel can be removed from the shelf by lifting the side panel to the raised or open position 20' so that the pad 132 no longer engages the shelf.

As disclosed for the clamping bookend and related clamp in U.S. Pat. Nos. 5,655,670 and 6,044,982 to Stuart it will be recognized that the clamping force can be varied to avoid damaging the shelf by changing the size or rigidity of the leg 128 and/or pad 132. In addition, the clamping force can be increased by increasing the roughness of the pad 132 which engages the shelf or by placing shims or pads between the pad 132 and the shelf 12 or between the upper leg portion 56*c* of the clamp and the shelf.

Figure 6:
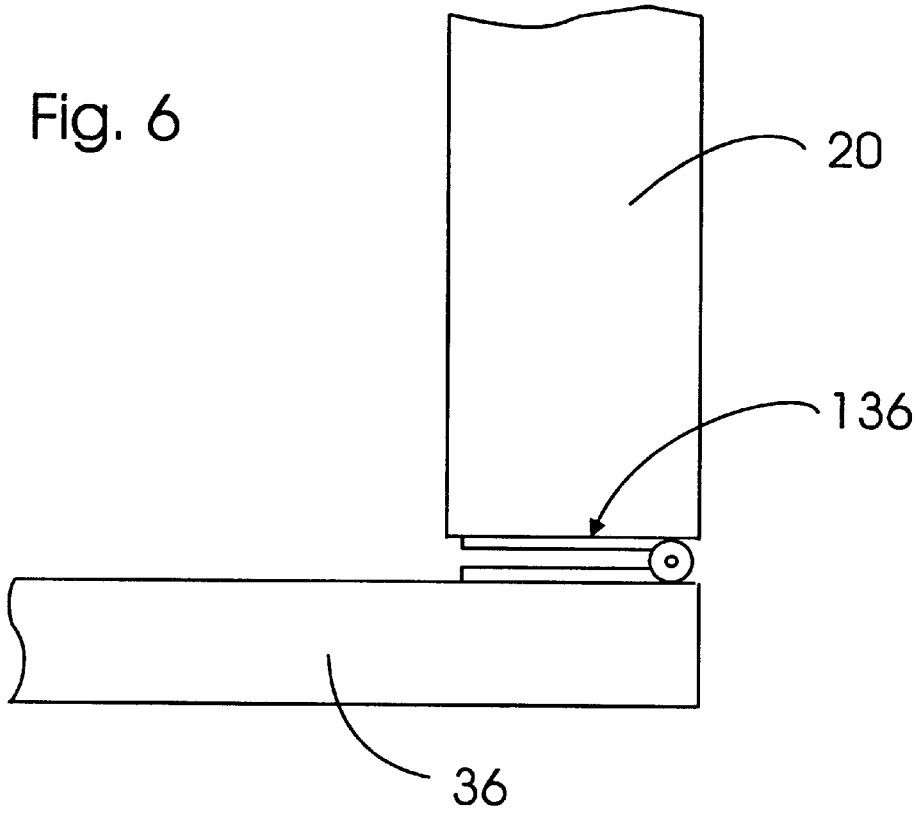
FIG. 6 is a top view of a butt hinge for fastening a door to a side panel where the door opens to the side.

FIG. 6 shows the use of a butt hinge 136 to mount a door 36 to a side panel 20. In this embodiment, the door 36 opens outward and to the side. In this and the following figures showing hinges, it should be recognized that many other types of hinges could also be employed such as pivot hinges, invisible hinges, pin hinges, and concealed or European hinges. The components described above and in the following embodiments are formed of strong durable materials such as metal, wood, or plastic.

Figure 7:
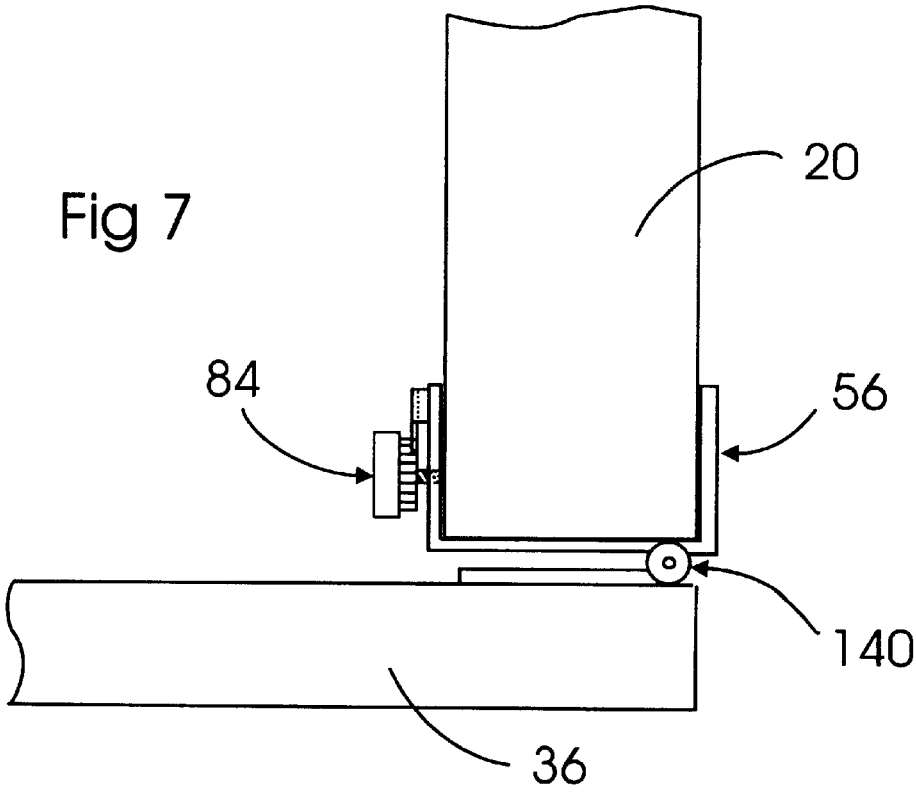
FIG. 7 is a top view of a hinge assembly for fastening a door to a side panel with said hinge fastened to the side panel with a clamp and screw fastener.

FIG. 7 shows a door 36 mounted to a side panel 20 using a butt hinge clamp and screw fastener assembly 140 having a clamp 56 and a screw fastener 84. The operation of the assembly 140 is basically as described above for the clamp 56 and screw fastener 84 in FIG. 4. As in FIG. 6, the door in this embodiment opens outward and to the side.

Figure 8:
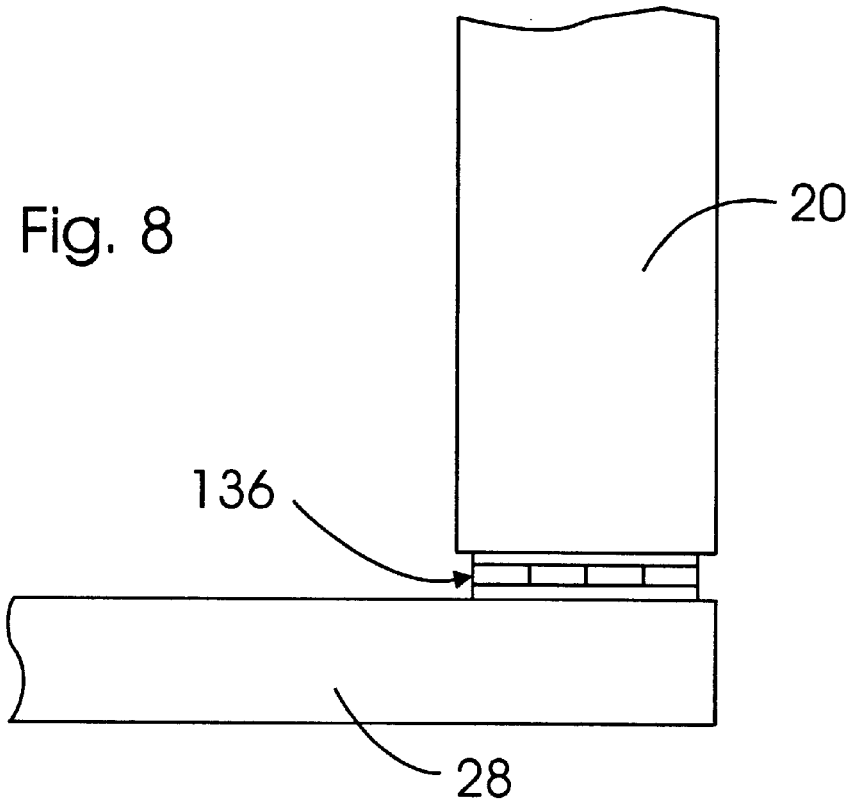
FIG. 8 is a top view of a butt hinge for fastening a door or lid to a side panel where the door opens down.

FIG. 8 shows a top-hung door or lid 28 fastened near its top edge to a side panel 20 using a butt hinge 136. In this embodiment, the lid would open upward and would usually be equipped with a lid stay (not shown) to hold the lid in the raised or open position as desired. The lid 28 could also be fastened near its bottom edge to the side panels 20 using a butt hinge so that the lid opened from its top and the top edge would open out and down. In this case, a lid support would usually be provided to keep the lid from dropping too far when opened.

Figure 9:
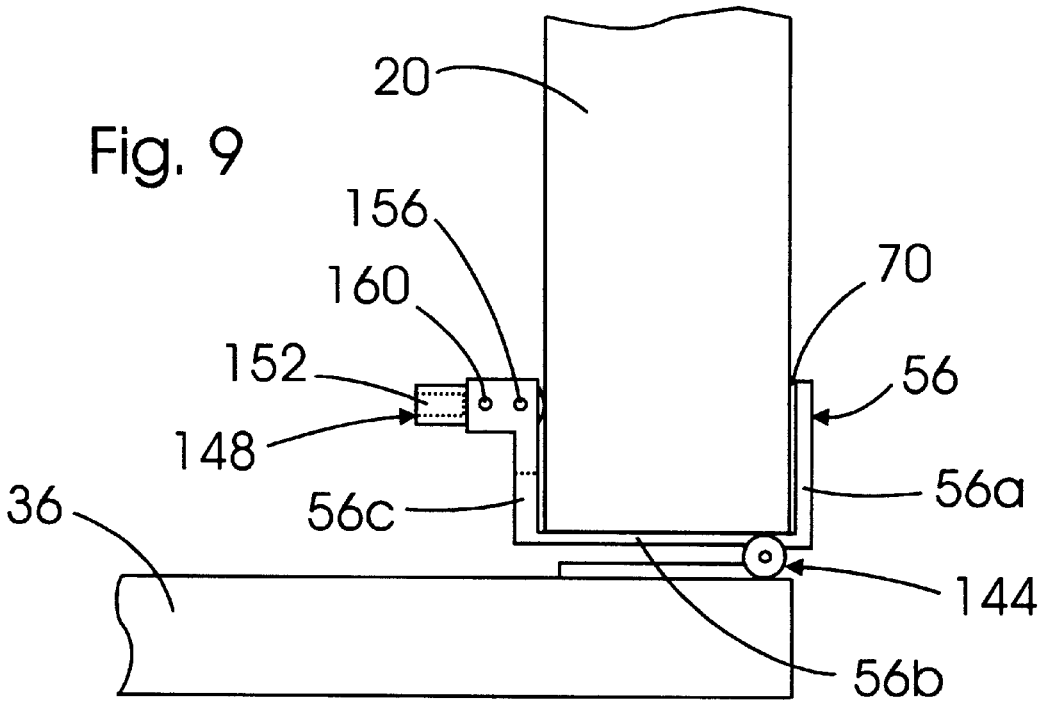
FIG. 9 is a top view of a hinge assembly for fastening a door to a side panel with said assembly fastened to the side panel with a clamp and lever fastener.

FIG. 9 shows a door 36 mounted to a side panel 20 using a butt hinge clamp and lever fastener assembly 144 having a clamp 56 and a lever fastener 148. As in FIGS. 6 and 7, the door would open outward and to the side.

The operation of the lever fastener 148 is very similar to the operation of the clamping bookend and related clamp disclosed in U.S. Pat. Nos. 5,655,670 and 6,044,982 to Stuart. The clamping member 152 is attached via the clamping member pivot pin 156 to a clamp 56 consisting of a lower leg portion 56*a,* a middle connecting portion 56*b* and a upper leg portion 56*c* which is generally parallel to leg portion 56*a.* The leg portions 56*a,* 56*c* and connecting portion 56*b* define a slot 70 that receives a side panel 20 therein. The clamp 56 is attached to a hinge which is attached to the door 36. The above components are formed of strong durable materials such as, for example, wood, metal, or plastic.

The operation of the clamping member and clamp can be summarized as follows: With the clamping member 152 in the lowered, disengaged, or opened position, where the clamping member is nearly parallel to leg portions 56*a* and 56*c,* the clamp 56 is placed on the side panel 20. The clamp is sized such that the slot 70 is slightly larger than the thickness of the side panel and the side panel fits loosely within the slot. Once placed on the side panel, the clamping member 152 is raised by hand, whereby the clamping member 152 extends into slot 70 and engages the surface of the side panel 20, thereby wedging the side panel between the clamping member and the lower leg portion 56*a* of the clamp. The clamping force generated by the clamping member is sufficient to firmly maintain the clamp on the side panel without marring or otherwise damaging the side panel. The clamping member 152 is held in the locked upright position by the previously described pin latch 160. The clamping member 152 contains a recessed area to allow the insertion of an extension lever that can be used to more easily move the clamping member from the open to the engaged position. The clamping member and clamp can be removed from the side panel by moving the clamping member to the lowered or opened position so that the clamping member 152 no longer engages the side panel 20.

As disclosed for the clamping bookend and related clamp in U.S. Pat. Nos. 5,655,670 and 6,044,982 to Stuart, it will be recognized that the clamping force can be varied to avoid damaging the side panel by changing the size or rigidity of the clamping member 152. In addition, the clamping force can be increased by increasing the roughness of the clamping member which engages the side panel or by placing shims or pads between the clamping member 152 and the side panel 20 or between the lower leg portion 56*a* of the clamp and the side panel 20.

It will be noted that, like the screw fastener 84 and clamp 56 discussed above. the lever fastener 148 and clamp 56 could also be used to fasten the lower portion of a side panel 20 to a lower shelf so as to add rigidity to the shelving system.

Figure 10:
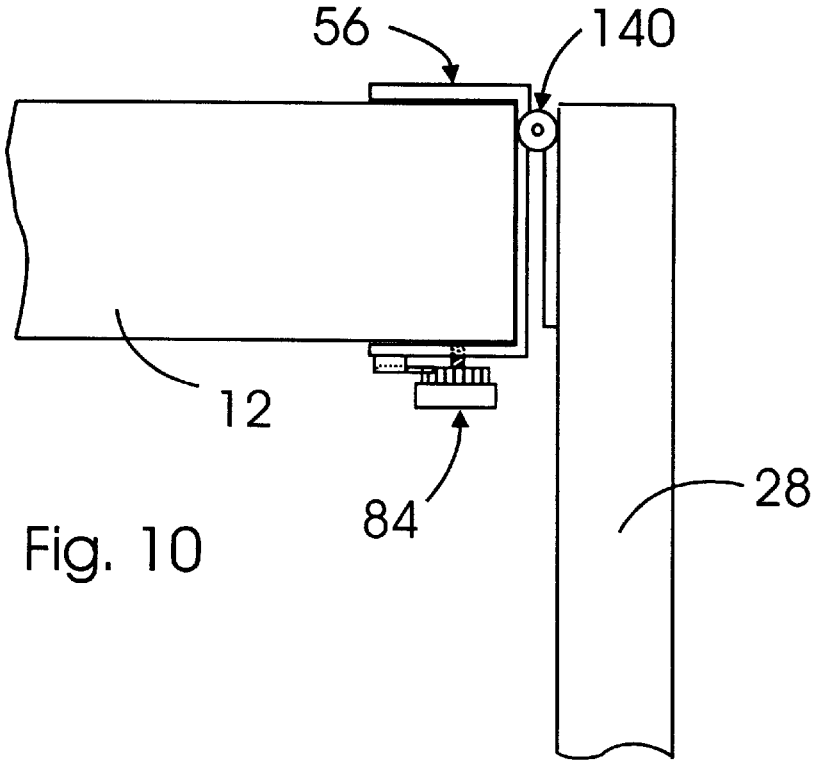
FIG. 10 is a side view of a hinge assembly for fastening a lid to a shelf with said assembly fastened to the shelf using a clamp and screw fastener.

FIG. 10 shows a door or lid 28 fastened near its top edge to a shelf 12 using a butt hinge clamp and screw fastener assembly 140 having a clamp 56 and a screw fastener 84. The operation of the assembly 140 is basically as described above for the screw fastener 84 and clamp 56 in FIG. 4. In this embodiment, the lid would open outward and upward and would usually be equipped with a lid stay (not shown) to hold the lid in the raised or open position as desired.

Figure 11:
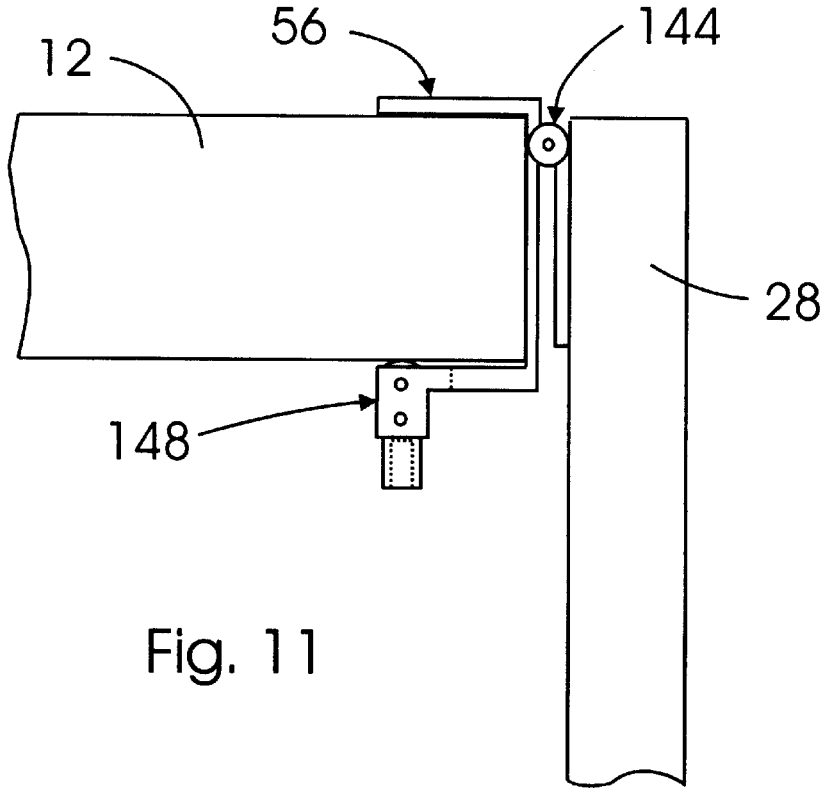
FIG. 11 is a side view of a hinge assembly for fastening a lid to a shelf with said assembly fastened to the shelf using a clamp and lever fastener.

FIG. 11 shows a lid 28 fastened near its top edge to a shelf 12 using a butt hinge clamp and lever fastener assembly 144 having a clamp 56 and a lever fastener 148. The operation of the assembly 144 is basically as described above for the clamp 56 and lever fastener 148 in FIG. 9. In this embodiment, the lid would open outward and upward and would usually be equipped with a lid stay (not shown) to hold the lid in the raised or open position as desired.

FIG. 12 shows a lid 28 fastened near its top edge to a shelf 12 using a butt hinge 136. In this embodiment, the lid would open outward and upward and would usually be equipped with a lid stay (not shown) to hold the lid in the raised or open position as desired.

FIG. 13 shows a lid 28 fastened at its bottom edge to a shelf 12 using a butt hinge 136. In this embodiment, the lid would open outward and down. A lid support (not shown) would usually be provided to keep the lid from dropping too far when opened.

Figure 14:
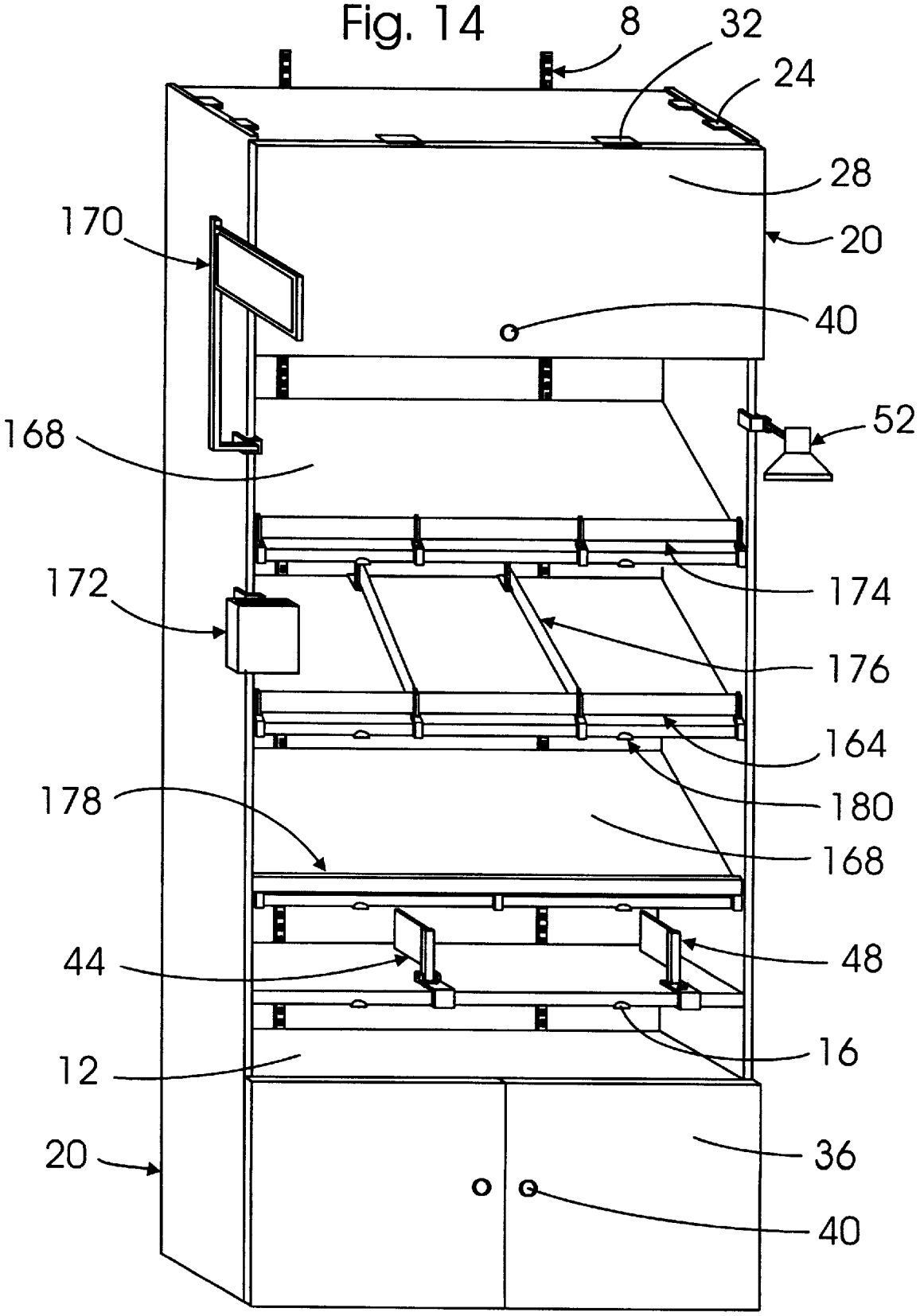
FIG. 14 is a front view perspective view of the shelving system with modifications for commercial use.

FIG. 14 shows a shelving system similar to that in FIG. 1, except that this system has been designed for use in a commercial setting, e.g. a retail store. The system includes the components shown in FIG. 1 but also is suitable for use with shelving accessories such as banding supported by clamping members 164, banding supported by screw fasteners 174, binning 176, a sign holder with a clamp 170, a literature dispenser with a clamp 172, and a banding strip 178. The construction and operation of these and other shelving accessories was disclosed in a U.S. Patent to Stuart (U.S. Pat. Nos. 5,655,670; 6,044,982; and 6,119,992). In general, the side panels and doors are formed to be light in weight so as to be easy to assemble and so as to not significantly interfere with the weight bearing function of the shelves. Also, if desired, e.g., for display purposes, the doors, side panels or other components can be made from transparent material such as glass or some types of plastic. It will be noted that some of the commercial modifications, e.g., slanted display shelves, are also suitable for domestic applications. The above components are formed of strong durable materials such as, for example, metal, wood, or plastic.

Figure 15:
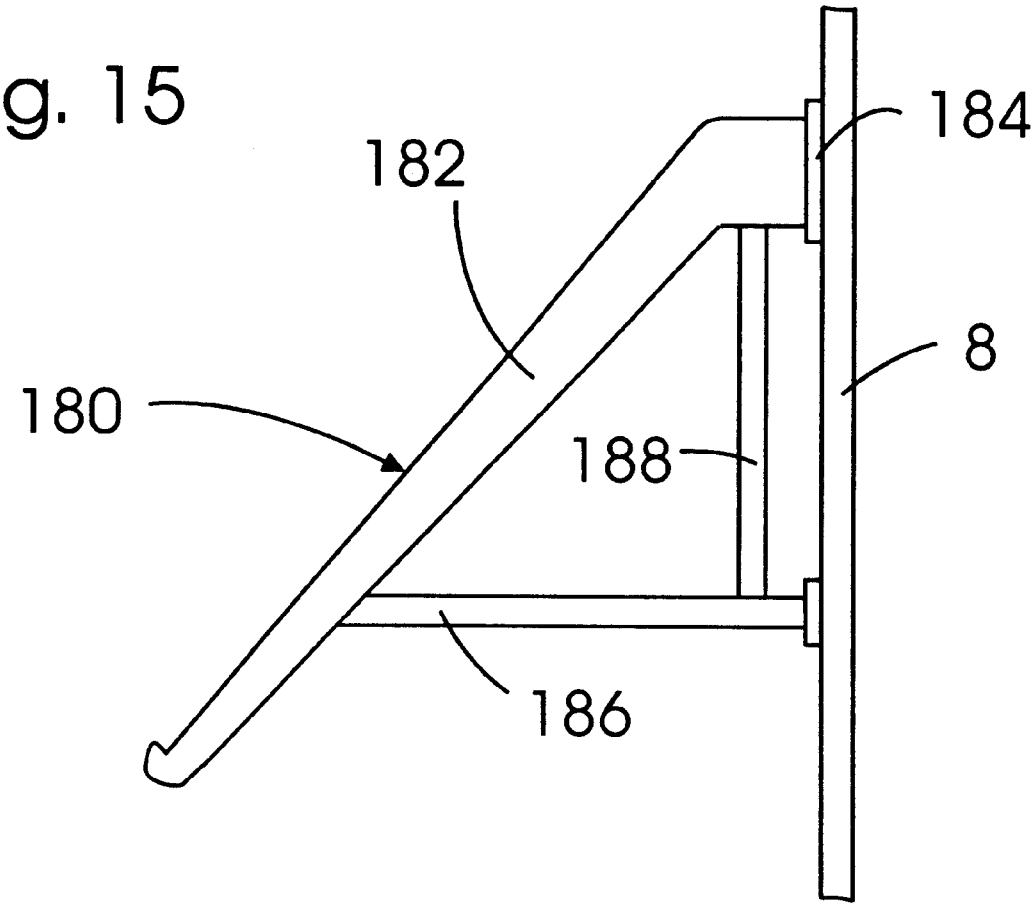
FIG. 15 is a side view of a bracket for a slanted display shelf.

FIG. 15 shows the slanted shelf bracket 180 for supporting slanted display shelves 168. The slanted bracket arm 182 is attached to a bracket base 184 which attaches to an standard 8 by means of typical shelf bracket mounting hooks or ears (not shown). An optional brace 186 is also provided to provide additional support, as is an additional optional cross-brace 188 that helps keep the brace in line with the bracket arm 182 and the standard 8.

It can be seen that the shelving system shown in FIGS. 1–15, 27–38, 61 and 64 presents an improved appearance over the prior art, since the unsightly standards and brackets are generally masked from view by the side panels. It can also be seen that the side panels provide additional stability and thus guard against accidental dislodgement and side to side sway. This shelving system also provides a wire rod version, a one standard version and a one-shelf version as well as enclosures for use in storage and security. Finally, this shelving system can be easily assembled and can be provided as an upgrade for existing shelving.

Figure 16:
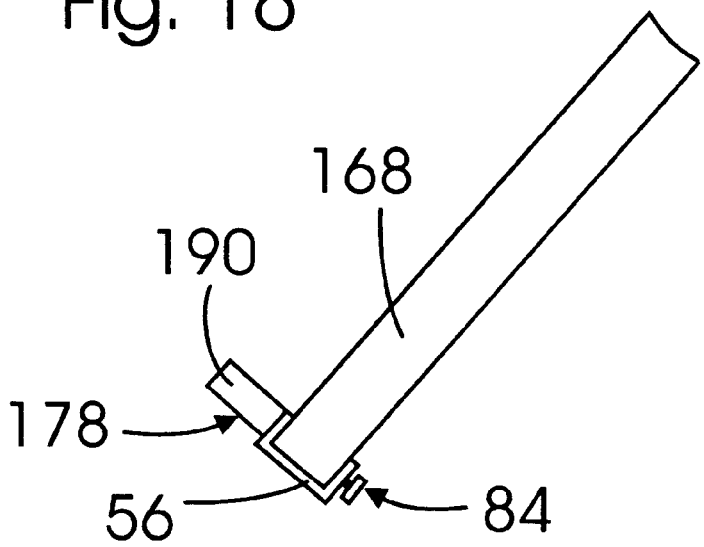
FIG. 16 is a side view of a banding strip with a clamp and screw fastener.

FIG. 16 shows a previously described banding strip 178 installed at the lower edge of a slanted display shelf 168 to organize objects on said shelf. The banding strip consists of a banding strip body 190 attached to a clamp 56 with a screw fastener 84. The operation of the screw fastener 84 and clamp 56 is basically as described above for the screw fastener 84 and clamp 56 in FIG. 4.

In addition to the approach show above of supporting shelves 12 with brackets 16 positioned along the length of the shelf, it is also feasible to support wall-mounted shelves by truncated panels or end brackets 194, which also can serve additional purposes such as supporting book stops, etc.

Figure 17:
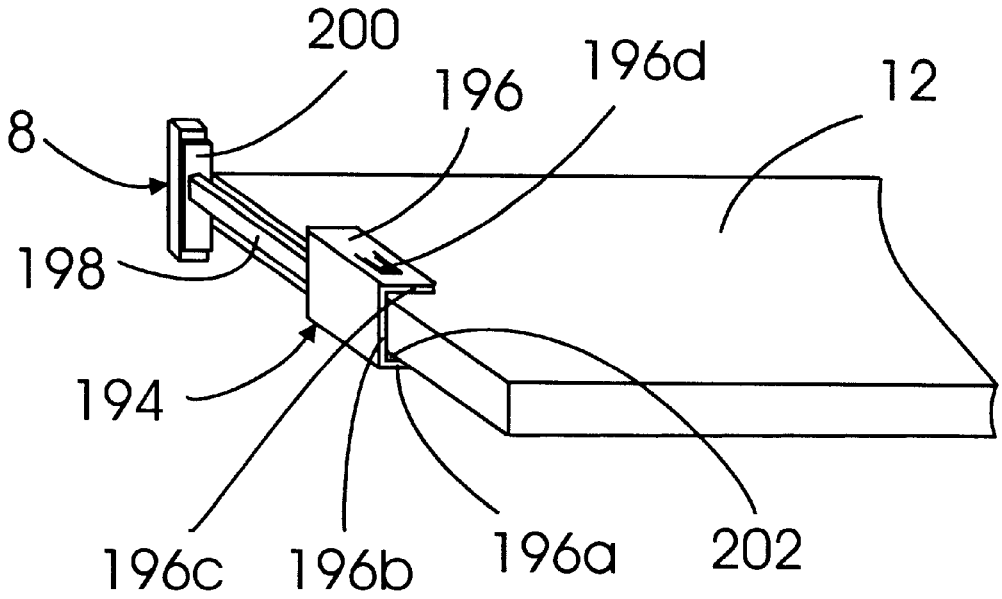
FIG. 17 is a front perspective view of an end bracket supporting a shelf.

FIG. 17 shows an end bracket 194 supporting the end of a shelf 12. The basic end bracket 194 consists of a base 200, that connects to the standard 8 by means of typical shelf bracket mounting hooks or ears (not shown), and also connects to an end bracket support 198 which, in turn, is attached to the end bracket channel 196. The end bracket channel consists of a lower leg portion 196*a,* a middle connecting portion 196*b* and upper leg portion 196*c* which is generally parallel to leg portion 196*a*. Leg portions 196*a,* 196*c* and connecting portion 196*b* define a channel slot 202 that receives a shelf 12 therein. An optional indented portion 196*d* of the end bracket channel protrudes from the upper leg portion of the channel 196 into the slot 202 and, when the shelf is inserted in to the channel by hand, the indented portion presses against the surface of the shelf, and thus helps keep the shelf in position.

Figure 18:
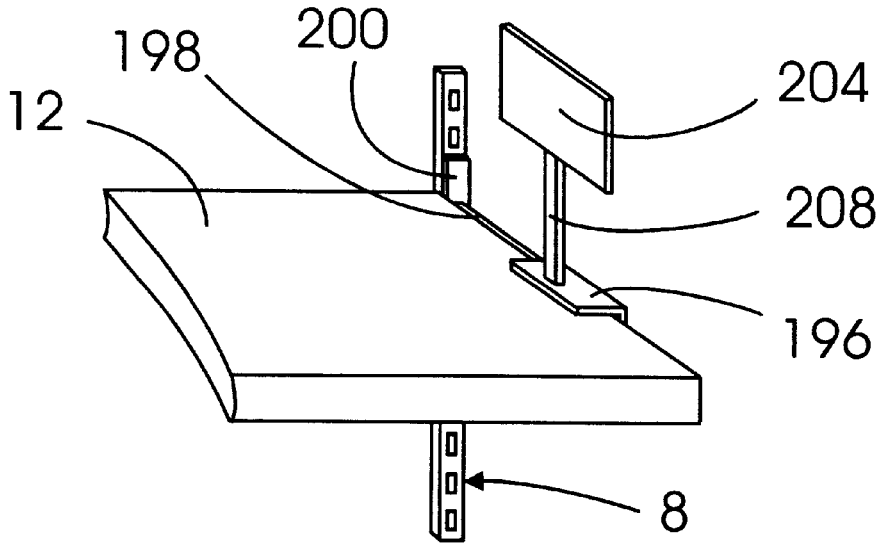
FIG. 18 is a front perspective view of an end bracket with a book stop supporting a shelf.

FIG. 18 shows a similar embodiment except that a book stop support 208 and book stop 204 are attached to the end bracket channel 196. The book stop is used to help organized objects such as books on the shelf; In this embodiment, the optional indented portion 196*d* of the end bracket channel protrudes from the bottom leg portion of the end bracket channel into the slot 202 (not shown).

Figure 19:
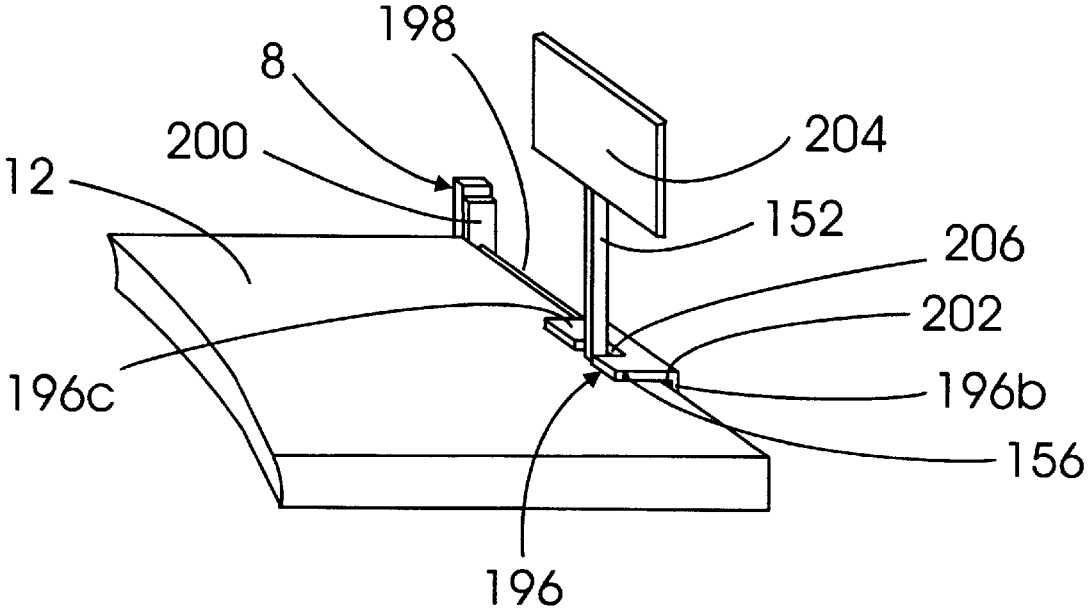
FIG. 19 is a front perspective view of an end bracket with a clamping member supporting a shelf.

FIG. 19 shows an alternative embodiment of the end bracket channel 196 for keeping the shelf in position, where the base 200 and end bracket support are connected to a end bracket channel 196 with a clamping member 152 and a book stop 204. The end bracket channel consists of a lower leg portion 196*a,* a middle connecting portion 196*b* and upper leg portion 196*c* which is generally parallel to leg portion 196*a*. Leg portions 196*a,* 196*c* and connecting portion 196*b* define a channel slot 202 for receiving a shelf 12 therein. The upper leg portion 196*c* contains a cut-out out 206 within which the clamping member 152 is connected with said upper leg portion 196*c* by a pivot pin 156. In this embodiment, the clamping member 152 wedges the shelf between the clamping member and the lower leg portion 196*a* of the end bracket channel 196. A similar clamping member is described above for FIG. 9. The above components are formed of strong durable materials such as, for example, wood, metal, or plastic.

The operation of the clamping member and channel can be summarized as follows: With the clamping member 152 in the lowered, disengaged, or opened position, where the clamping member is nearly parallel to leg portions 196*a* and 196*c*. the shelf is placed in the channel 196. The channel is sized such that the channel slot 202 is slightly larger than the thickness of the shelf and the shelf fits loosely within the slot. Once the shelf is placed in the channel. The clamping member 152 is raised by hand, whereby the clamping member 152 extends into slot 202 and engages the surface of the shelf 12, thereby wedging the shelf between the clamping member and the lower leg portion 196*a* of the end bracket channel 196. The clamping force generated by the clamping member is sufficient to firmly maintain the clamp on the shelf without marring or otherwise damaging the shelf. The clamping member 152 supports a book stop 204 to help organize objects on the shelf. The shelf may be removed from the channel by moving the clamping member to the lowered or opened position so that the clamping member 152 no longer engages the shelf 12.

As disclosed for the clamping bookend and related clamp in U.S. Pat. Nos. 5,655,670 and 6,044,982 to Stuart, it will be recognized that the clamping force can be varied to avoid damaging the shelf by changing the size or rigidity of the clamping member 152. In addition, the clamping force can be increased by increasing the roughness of the clamping member which engages the shelf or by placing shims or pads between the clamping member 152 and the shelf 12 or between the lower leg portion 196*a* of the clamp and the shelf.

Note that FIGS. 17 and 19 also show the use of a short standard 8 and end brackets 194 to provide an easily installed and easily removed single shelf.

Figure 20:
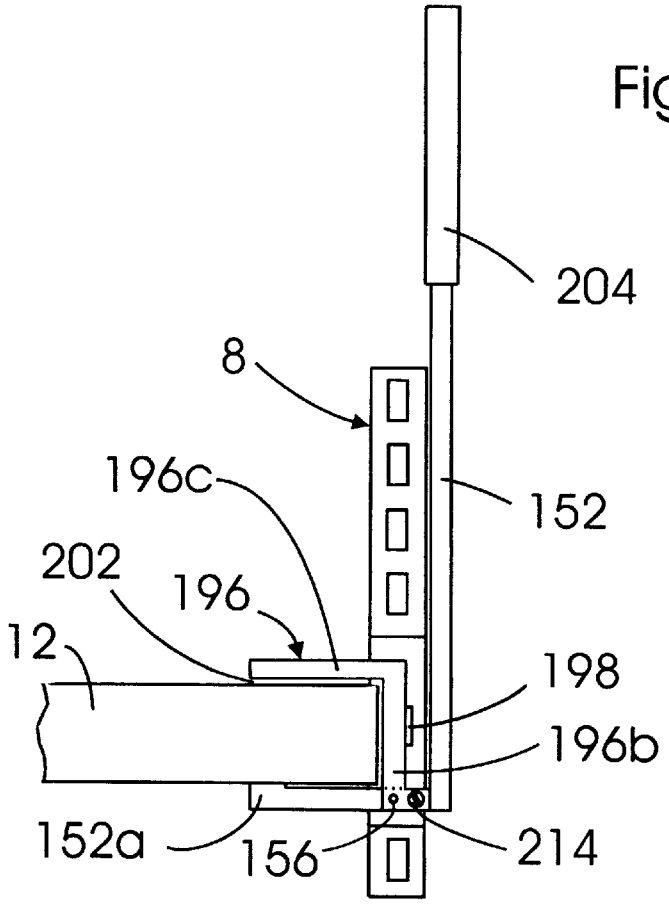
FIG. 20 is a front view of an end bracket with a clamping foot portion supporting a shelf.

FIG. 20 shows an alternative embodiment in which the shelf is held in place by an end bracket with a clamping member 152 with a clamping foot portion 152*a* and a set screw latch mechanism 214. with the slot 202 for the shelf defined by the clamping member 152 and the upper leg portion 196*c* and connecting portion 196*b* of the end bracket channel 196. A book stop 204 is provided at the upper end of the clamping member 152. The shelf is installed by placing the upper surface of the shelf 12 against the upper arm 196*c,* with the shelf pressed against the connecting portion 196*b*. The clamping foot portion 152*a* is then pressed against the shelf by direct pressure or by rotating the clamping member via the pivot pin 156. Once the clamping foot portion 152*a* is pressed tightly against the shelf, the set screw 214 is tightened to hold the clamping member in the clamped position. The clamping foot portion 152*a* concentrates the pressure exerted by the clamping member and thus helps provide a firm grip. A similar clamping member and set screw latch was described earlier in a U.S. Pat. No. 6,044,982.

Figure 21:
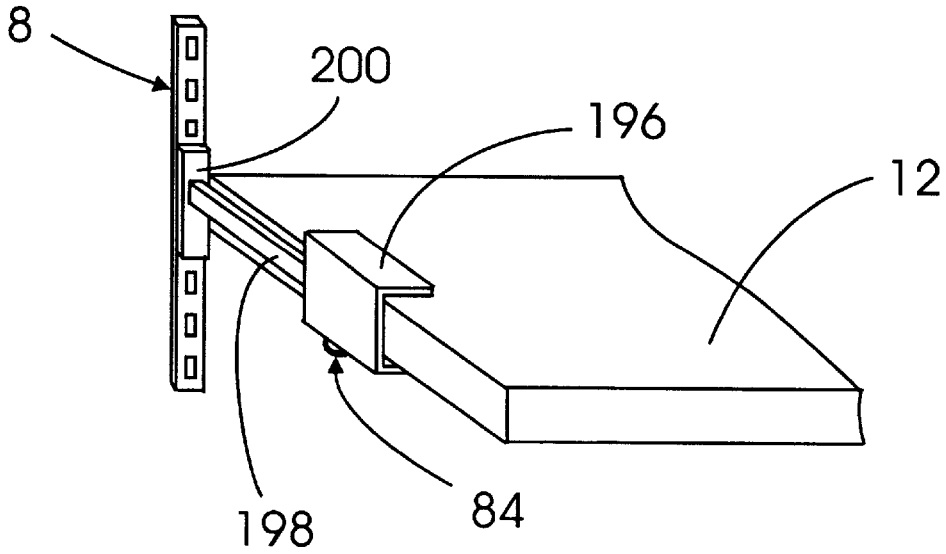
FIG. 21 is a front perspective view of an end bracket with a screw fastener supporting a shelf.

FIG. 21 shows an alternative embodiment with a screw fastener 84 used to hold the shelf in the end bracket channel 196. The structure and function of the screw fastener 84 and end bracket channel 196 is basically as described above for the screw fastener 84 and clamp 56 in FIG. 4.

Figure 22:
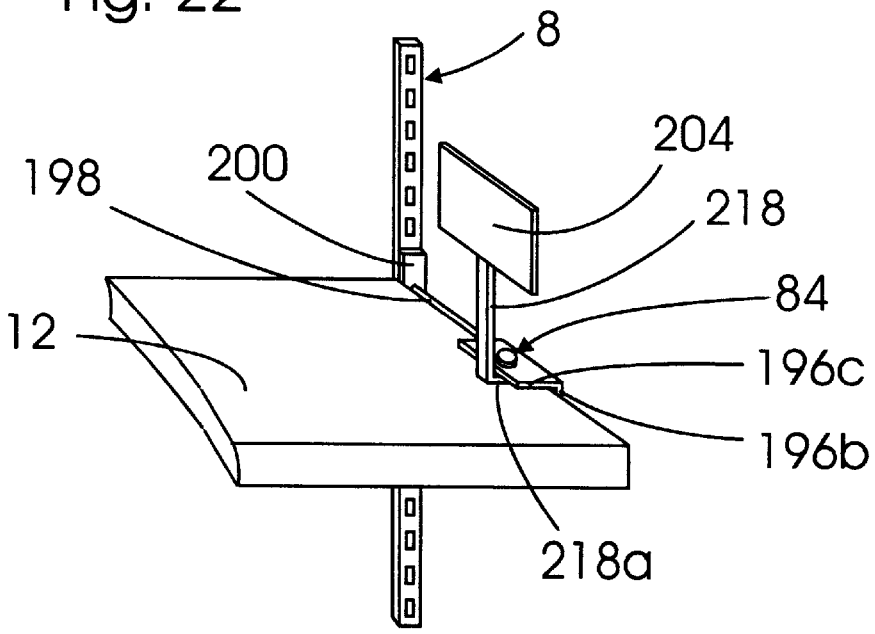
FIG. 22 is a front perspective view of an end bracket with a book stop and a screw fastener supporting a shelf.

FIG. 22 shows an alternative embodiment with a screw fastener 84 as in FIG. 21 but with the addition of a book stop

204, retaining member 218 and a retaining member extension 218*a* that extends between the upper leg 196*c* of the end bracket channel 196 and the stud of the screw fastener 104 (not shown). The use of a screw fastener and a retaining member and retaining member extension were described in a U.S. Patent by Stuart U.S. Pat. No. 6,119,992.

Figure 23:
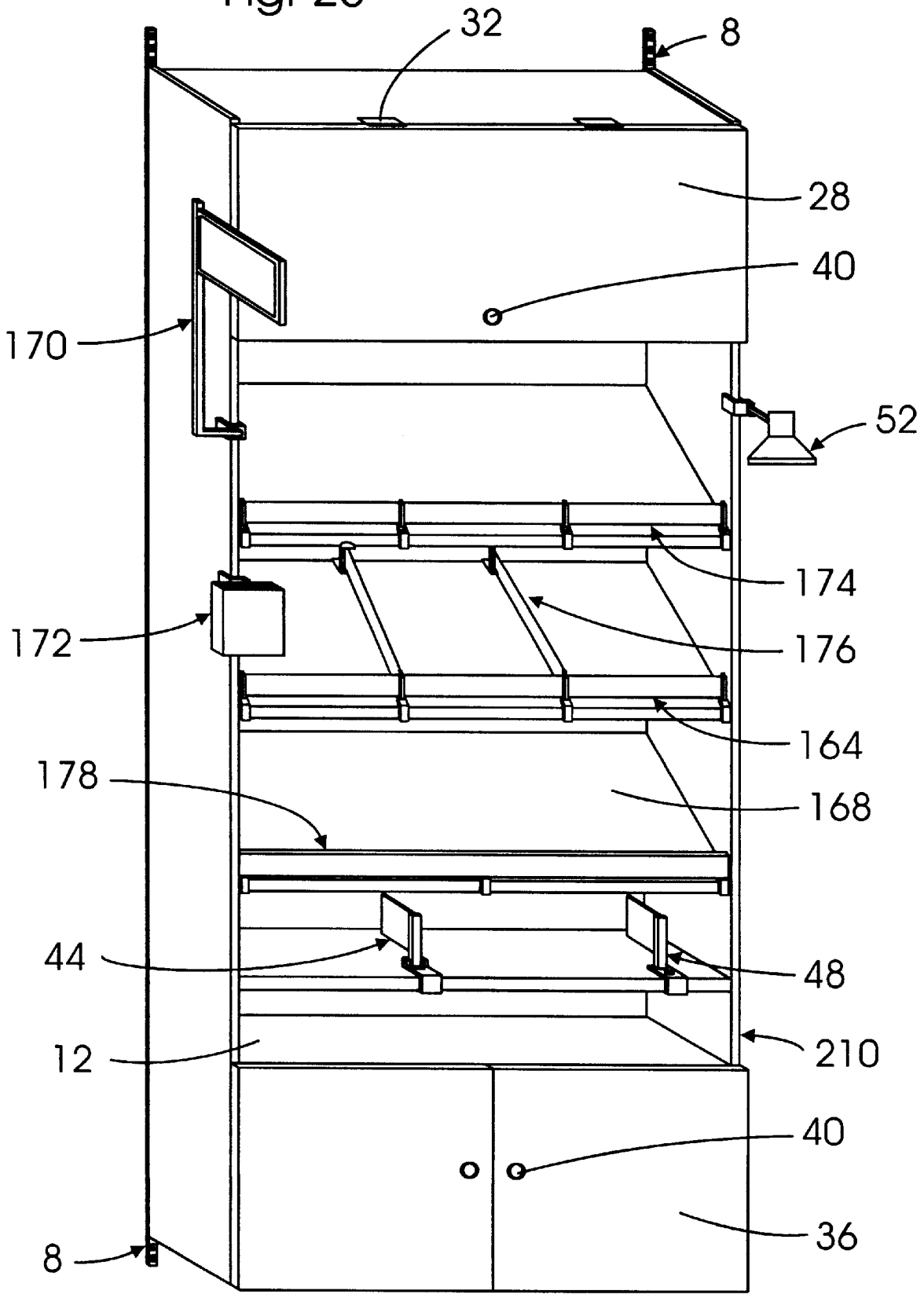
FIG. 23 is a front perspective view of a shelving system with panels.

FIG. 23 shows a shelving system with many of the same components of the shelving system of FIG. 14 except that panels 210 connect directly to the standards 8. This embodiment increases the over-all rigidity and strength of the system, provides a cleaner look and, in comparison to a system using side panels, reduces costs and assembly time since fewer components are needed. Unlike conventional shelving systems or a system employing side panels, this embodiment also reduces side to side sway since the shelves can be directly in contact with the supporting wall. This embodiment can be provided as an upgrade to existing shelving and standards, however, the standards in an existing installation would most likely need to be moved further apart so that the existing shelving would fit in the distance between the newly installed panels. A new standard 8 with one or more shelf brackets and/or slanted shelf brackets can also be installed if additional support is desired. As shown in FIG. 23, in this embodiment of a shelving system, the shelving system no longer uses fasteners 24 for attaching the side panels to the shelves 12 or shelf brackets 16 and/or slanted shelf brackets 180 for supporting the shelves. Instead, the shelves are supported directly by the panels 210.

Figure 24:
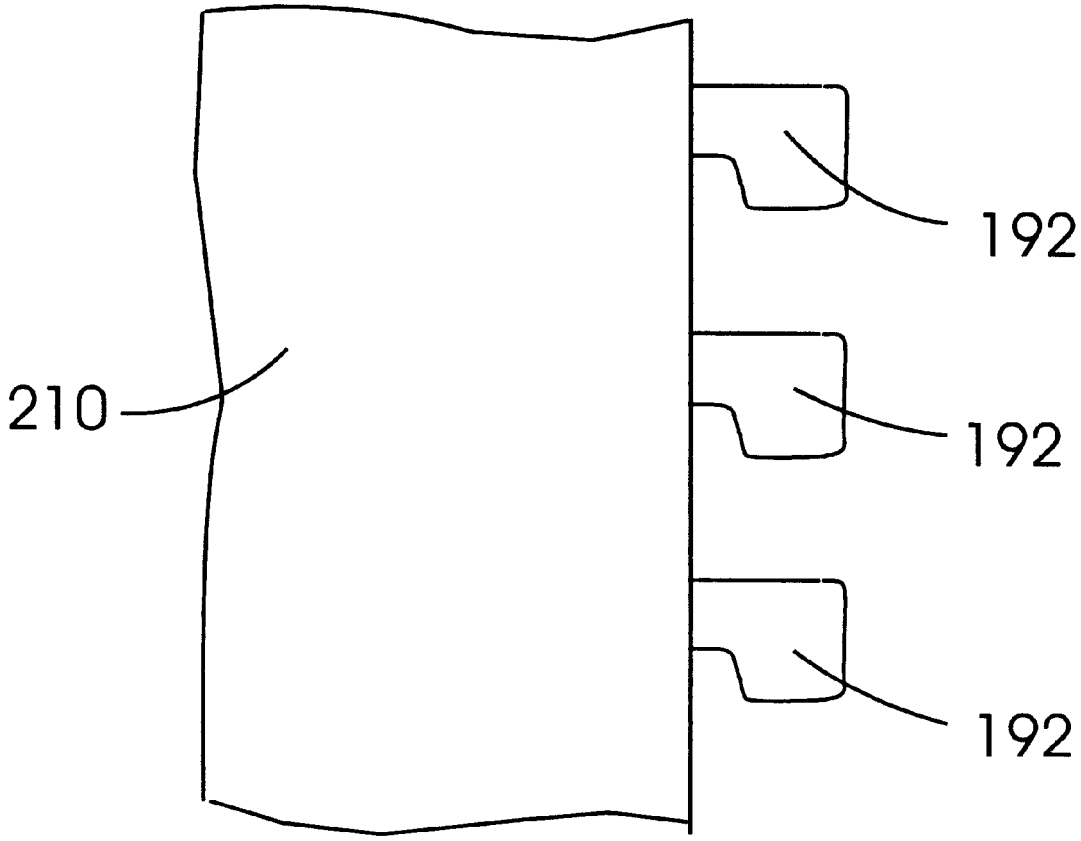
FIG. 24 is a side view of a portion of a panel.

As shown in FIG. 24, the panels 210 connect to the standards 8 using typical shelf bracket mounting ears 192. To provide an even cleaner look and also help reduce side to side sway, the panels 210 may be formed with recessed mounting ears 192 so as to fit completely over the standards 8 and thus hide the standards from view (see below).

Figure 25:
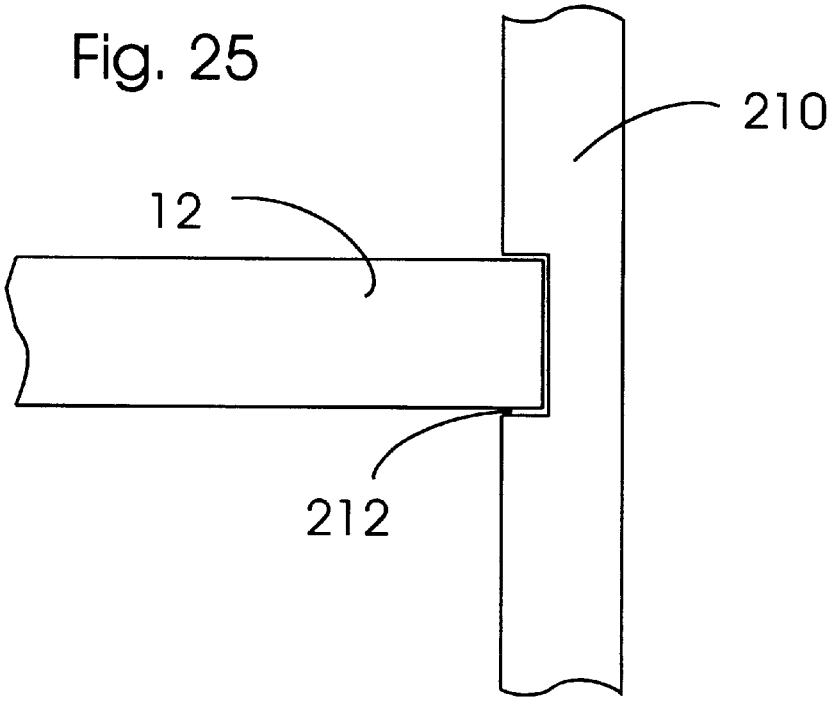
FIG. 25 is a front view of a shelf supported by a groove in a panel.
Figure 26:
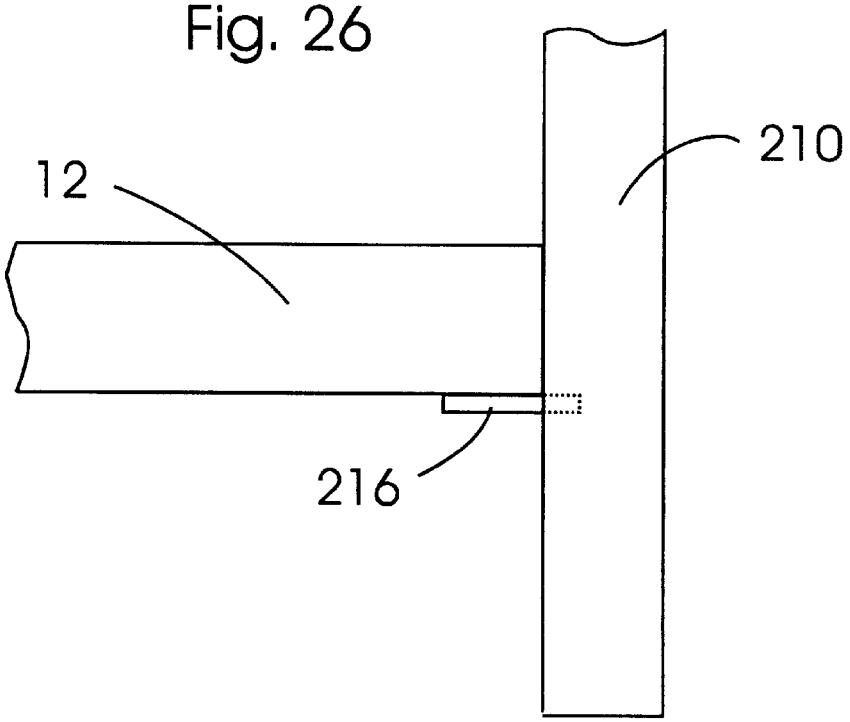
FIG. 26 is a front view of a shelf supported by a rod mounted in a panel.

FIGS. 25 and 26 show two embodiments for supporting the shelves by the panels 210. In FIG. 25, the shelf 12 is supported by an opening or groove 212 in the panel 210, while in FIG. 26, the shelf 12 is supported using a support rod 216. Additional approaches (not shown) include the use of brackets or flat spoons that fit into holes in the panel, as well as the use of the Swedish type of wire shelf support (where the center portion of the wire fits into a groove in the shelf and the ends of the wire fit into holes in the panel) or the use of shelf support strips or standards and brackets. Of course, if additional rigidity and strength are desired, the shelves could be fastened directly to the panels using strong adhesive or mechanical means such as screws.

It can be seen that the shelving system shown in FIGS. 17–26, 39–40, 55–58, 60, 62 and 63 presents a further improved appearance over the prior art, since the unsightly brackets are no longer used and the standard can be fully masked by the side panel bracket. Also, the use of side panel brackets further reduces the likelihood of accidental dislodgement, since the ends of the shelves are sheltered from accidental contact and can be held in place by the panels. Also, several additional approaches are available with this embodiment to reduce side to side sway even further, including placing the shelves directly against the supporting wall and providing panels with recessed ears and/or anti-sway portions. As compared to the side panel system, the panel system is also easier to assemble since there are fewer components. As with the side panel system described above, the panel system includes a wire rod version, a one standard version and a one-shelf version, enclosures for use in storage and security, and, in addition, a combination of vertical standards and sheet metal or plastic shelves. Finally, this shelving system can also be provided as an upgrade for existing shelving.

Figure 27:
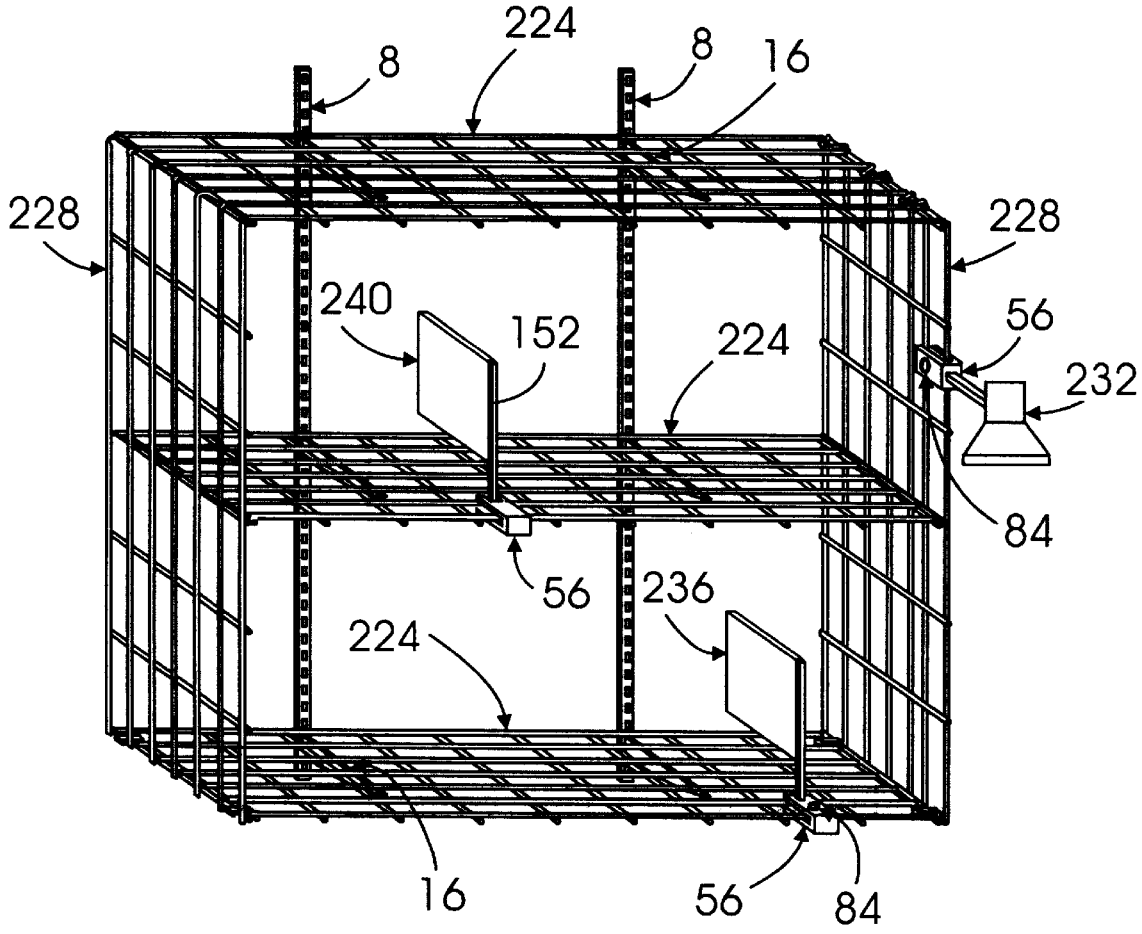
FIG. 27 is a front perspective view of a shelving system made from wire.

In addition to solid shelving as shown above, wire is often used for shelving, both in domestic and commercial applications. FIG. 27 shows a embodiment of the shelving system made from wire. In this embodiment, wire shelves 224 are supported by shelf brackets 16 and standards 8. For some applications, wire side panels 228 are attached to the ends of the wire shelves 224. As with nonwire shelving, in addition to providing a mounting surface for lighting, signs, literature dispensers, etc. The side panels also help keep goods secure from theft or damage, particularly if doors (not shown) are attached to the side panels or shelves. A lamp assembly 232 with a screw fastener 84 and clamp 56 is attached to the side panel, while a clamping partition assembly 240 and a screw faster partition assembly 236 are shown attached to the wire shelves 224. The lamp assembly and partition assemblies were disclosed in U.S. Patents to Stuart (U.S. Pat. Nos. 5,655,670; 6,044,982; and 6,119,992). The above components are formed of strong and durable materials such as metal, wood or plastic.

Figure 28:
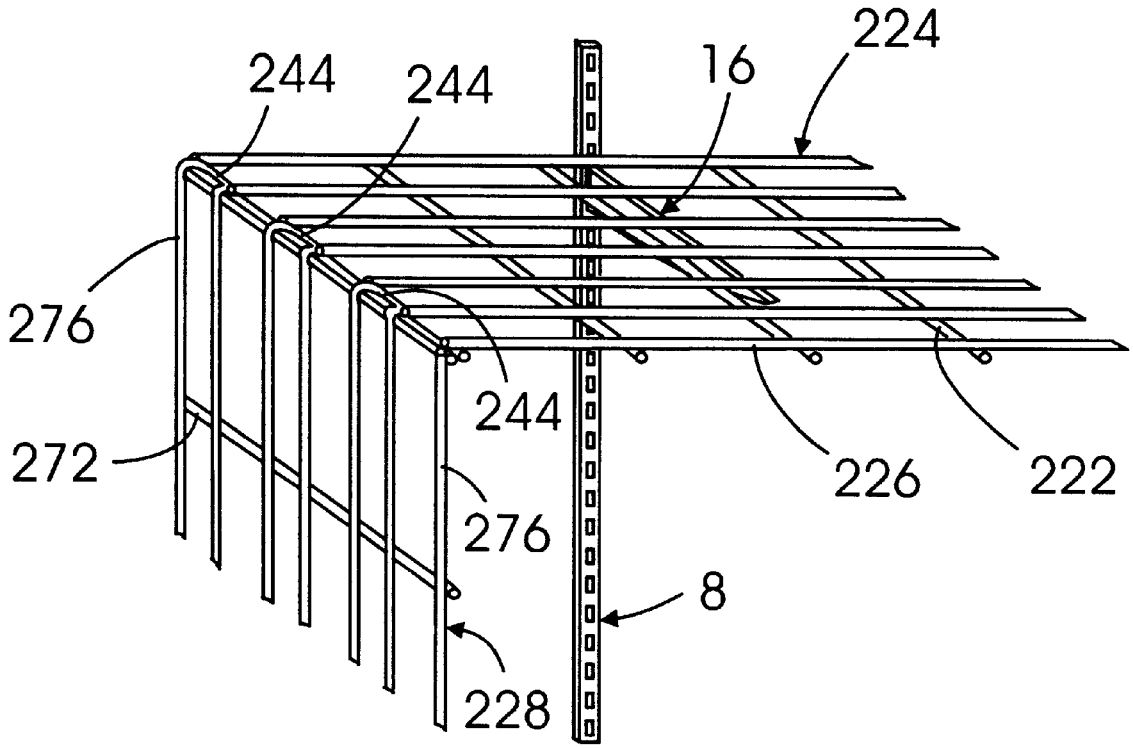
FIG. 28 is a front perspective view of a wire side panel fastened to a wire shelf via hangers at the end of the side panel.

FIG. 28 shows the favored embodiment for attaching the wire side panels 228 to the wire shelves 224. In this embodiment, the wire side panels 228 are attached to the wire shelf 224 by means of hangers 244, preferably formed from the end of the cross wires 276 of the wire side panel. The hangers 244 fit over the support wires 222 at the end of the wire shelf 224 and thus support the wire side panel 228. Hangers are favored over the other embodiments shown below due to the less likelihood of damage due to snagging of clothing and similar items.

Figure 29:
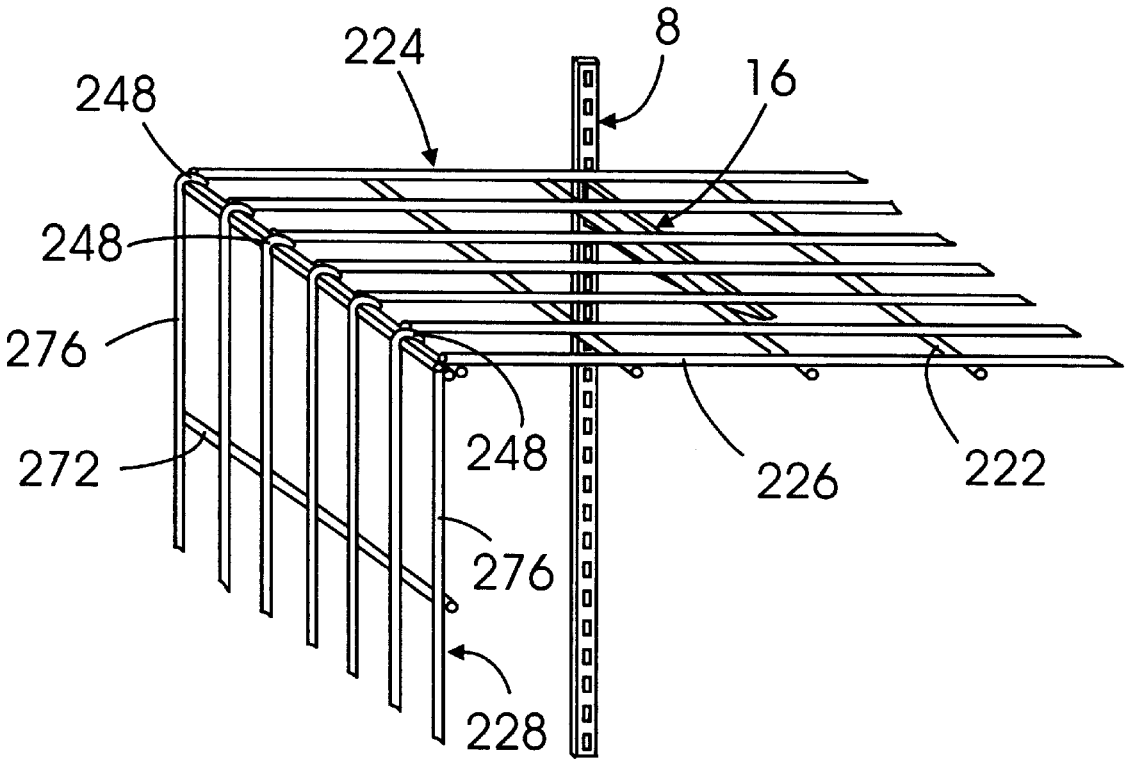
FIG. 29 is a front perspective view of a wire side panel fastened to a wire shelf via hooks at the end of the side panel.

FIG. 29 shows another embodiment, in which the wire side panels 228 are attached to the wire shelf 224 by means of individual wire hooks 248, preferably formed from the end of the cross wires 276 of the wire side panel 228. The hooks fit over the support wires 222 at the end of the wire shelf 224 and thus support the wire side panel 228.

Figure 30:
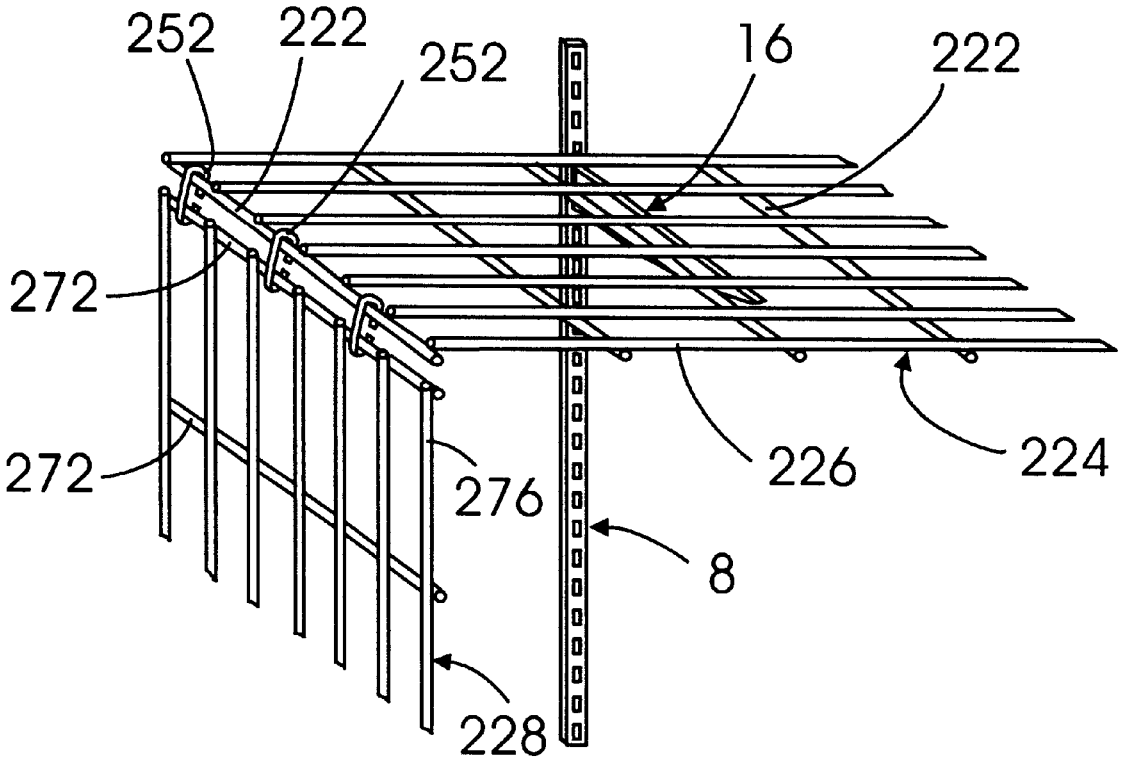
FIG. 30 is a front perspective view of a wire side panel fastened to a wire shelf via separate wire links.

Yet another embodiment is shown in FIG. 30, in which the wire side panels 228 are attached to the wire shelf 224 by means of separate wire links 252, preferably linking the support wires 272 at the end of the wire side panel 228 with the support wires 222 at the end of the wire shelf 224.

Figure 31:
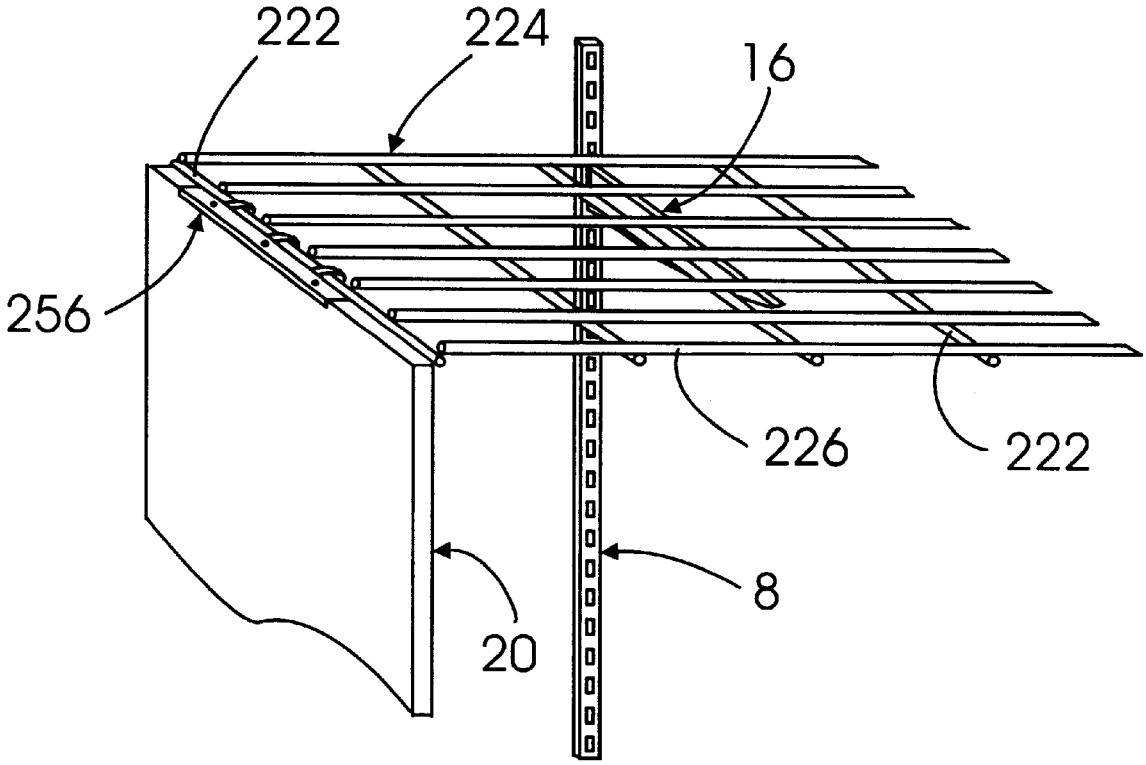
FIG. 31 is a front perspective view of a side panel fastened to a wire shelf via a clip.

An embodiment with side panels 20 attached to the wire shelves 224 is shown in FIG. 31. In this embodiment, the side panels 20 are attached to the wire shelf 224 by means of a clip 256, preferably linking the side panel to the support wire 222 at the end of the wire shelf 224. The clip is attached to the side panel 20 using screws, strong adhesive, or similar means.

Figure 32:
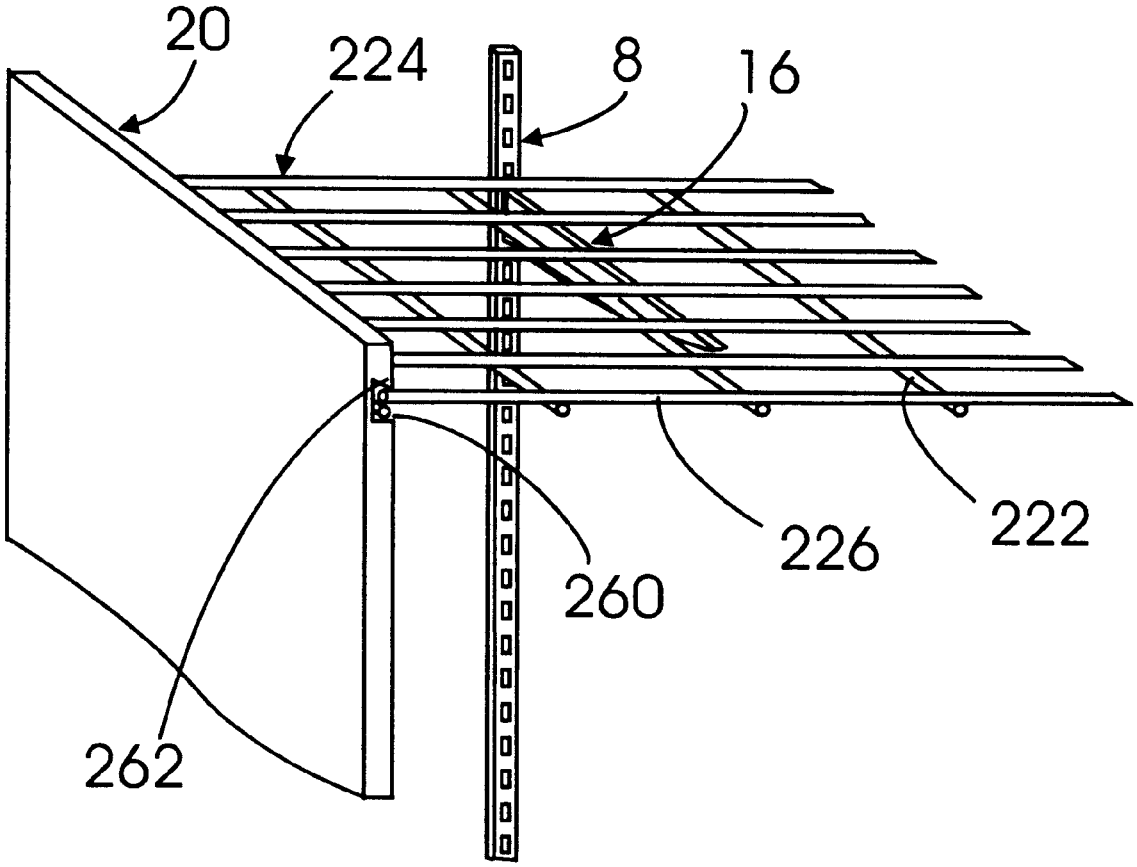
FIG. 32 is a front perspective view of a side panel fastened to a wire shelf via a groove in said side panel.

Yet another embodiment of side panels 20 attached to wire shelves 224 is shown in FIG. 32. In this embodiment, the side panel 20 is attached to the wire shelf 224 by means of a groove 260 in the side panel. The support wire 222 and the end of the wire shelf 224 fit into the groove 260 and the groove has a lip 262 that hooks over the support wire 222 and thus holds the side panel 20 on the end of the wire shelf 224.

Figure 33:
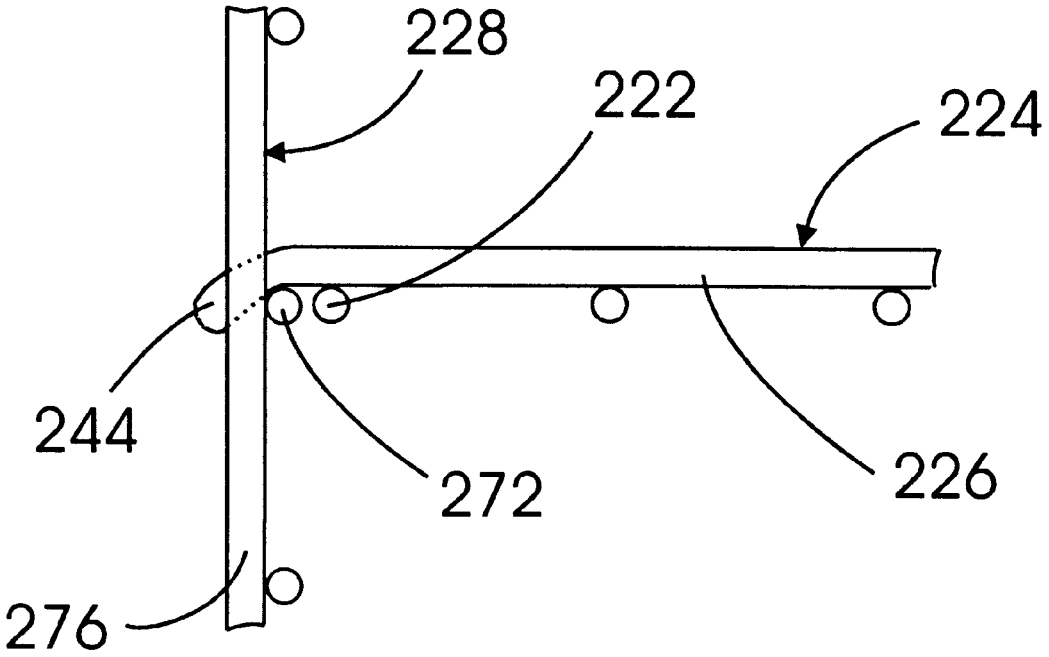
FIG. 33 is a front view of a wire shelf fastened to a wire side panel via hangers at the end of the shelf.

In addition to the embodiments described above in which side panels 20 or wire side panels 228 are supported by the wire shelf 224, separate wire shelves can also be supported by side panels 20, wire side panels 228, or panels 210. FIG. 33 shows the favored embodiment for supporting a separate wire shelf 224 with wire side panels 228, with a separate wire shelf 224 fastened to the wire side panel 228 by means of hangers 244, preferably formed from the ends of the cross wires 226 of the wire shelf 224 and fitting over the support wires 272 of the wire side panel 228.

Figure 34:
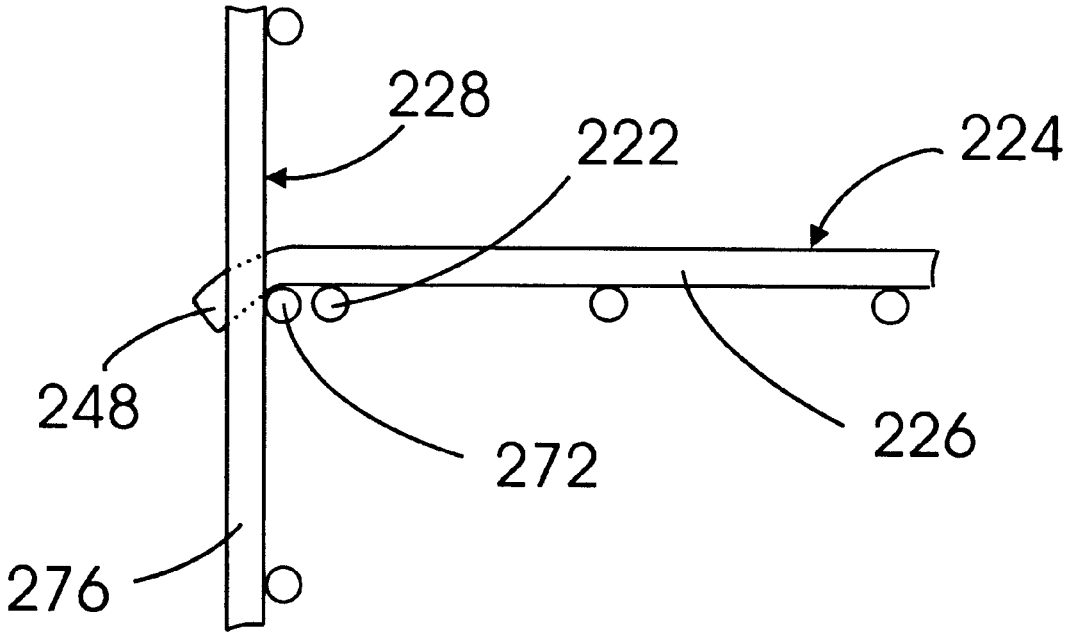
FIG. 34 is a front view of a wire shelf fastened to a wire side panel via hooks at the end of the shelf.

FIG. 34 shows another embodiment, with a separate wire shelf 224 fastened to the wire side panel 228 by means of separate hooks 248, preferably formed from the ends of the cross wires 226 of the wire shelf 224 and hooking over the support wires 272 of the wire side panel 228.

Figure 35:
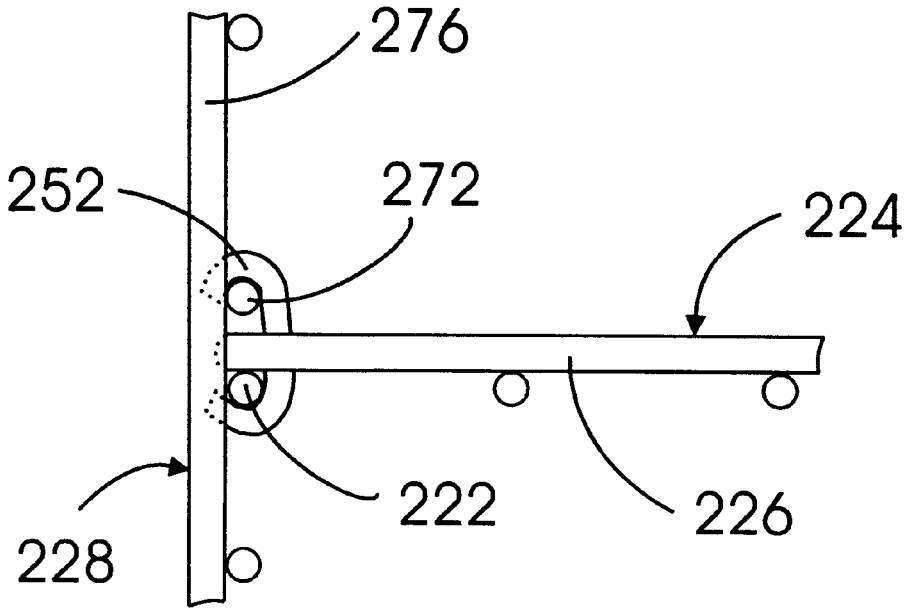
FIG. 35 is a front view of a wire shelf fastened to a wire side panel via separate wire link.

FIG. 35 shows yet another embodiment, with a separate wire shelf 224 fastened to the wire side panel 228 by means of separate wire links 252, preferably linking the support wire 222 at the end of the wire shelf 244 with the support wire 272 of the wire side panel 228.

Figure 36:
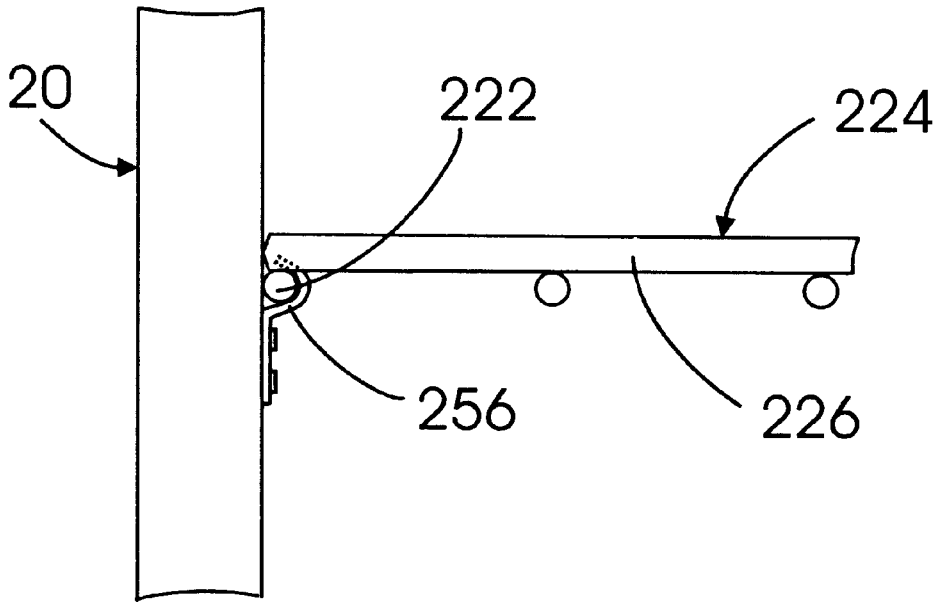
FIG. 36 is a front view of a wire shelf fastened to a side panel via a clip.

FIG. 36 shows an embodiment with a separate wire shelf 224 fastened to a side panel 20 by means of a clip 256, preferably linking the support wire 222 at the end of the wire shelf 224 to the side panel 20. The clip is attached to the side panel using screws, strong adhesive, or similar means.

Figure 37:
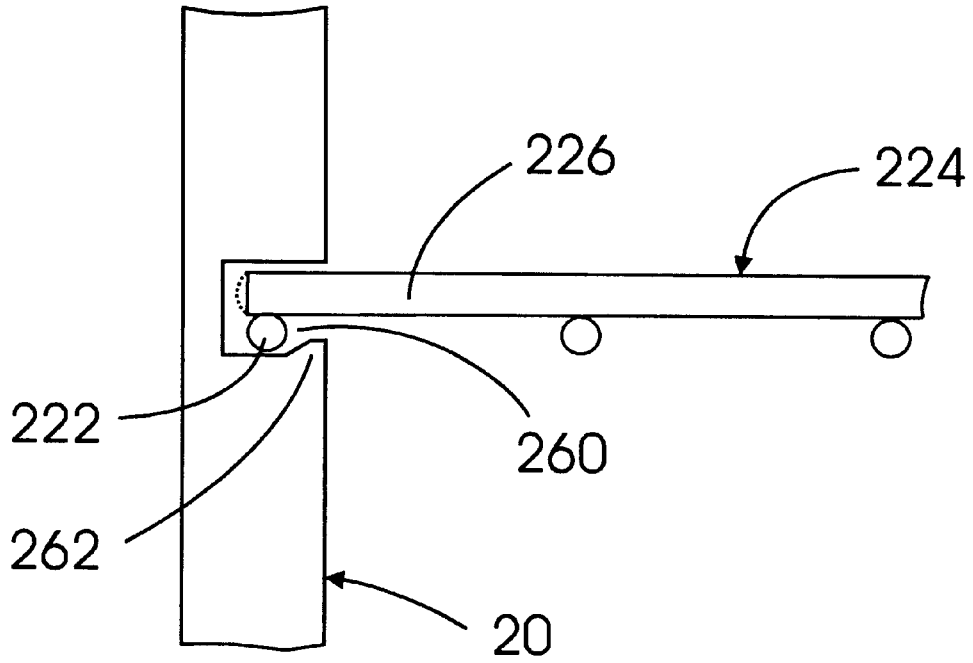
FIG. 37 is a front view of a wire shelf fastened to a side panel via a grove in said side panel.

FIG. 37 shows another embodiment, with a separate wire shelf 224 fastened to a side panel 20 by means of a groove 260 in the side panel. The support wire 222 and the end of the wire shelf 224 fit into the groove 260, with the groove having a lip 262 that hooks under the support wire 222 and thus holds the wire shelf 224 to the side panel 20.

Figure 38:
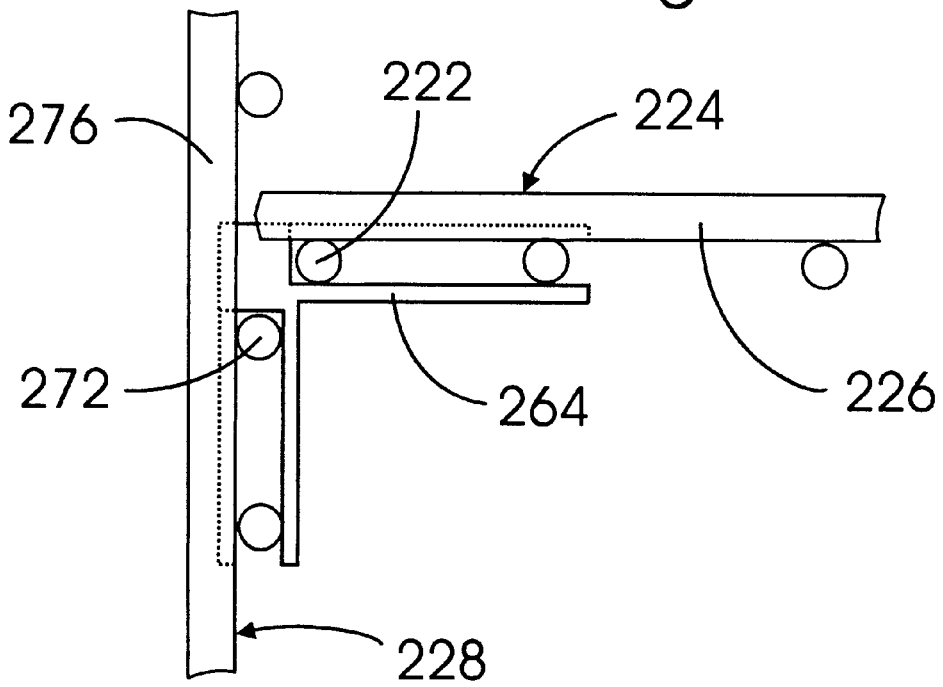
FIG. 38 is a front view of a wire shelf fastened to a wire side panel via a separate bracket.

FIG. 38 shows another embodiment, with a separate wire shelf 224 fastened to the wire side panel 228 by means of a separate connecting bracket 264, preferably linking the support wires 222 at and near the end of the wire shelf 244 with several support wires 272 of the wire side panel 228.

Figure 39:
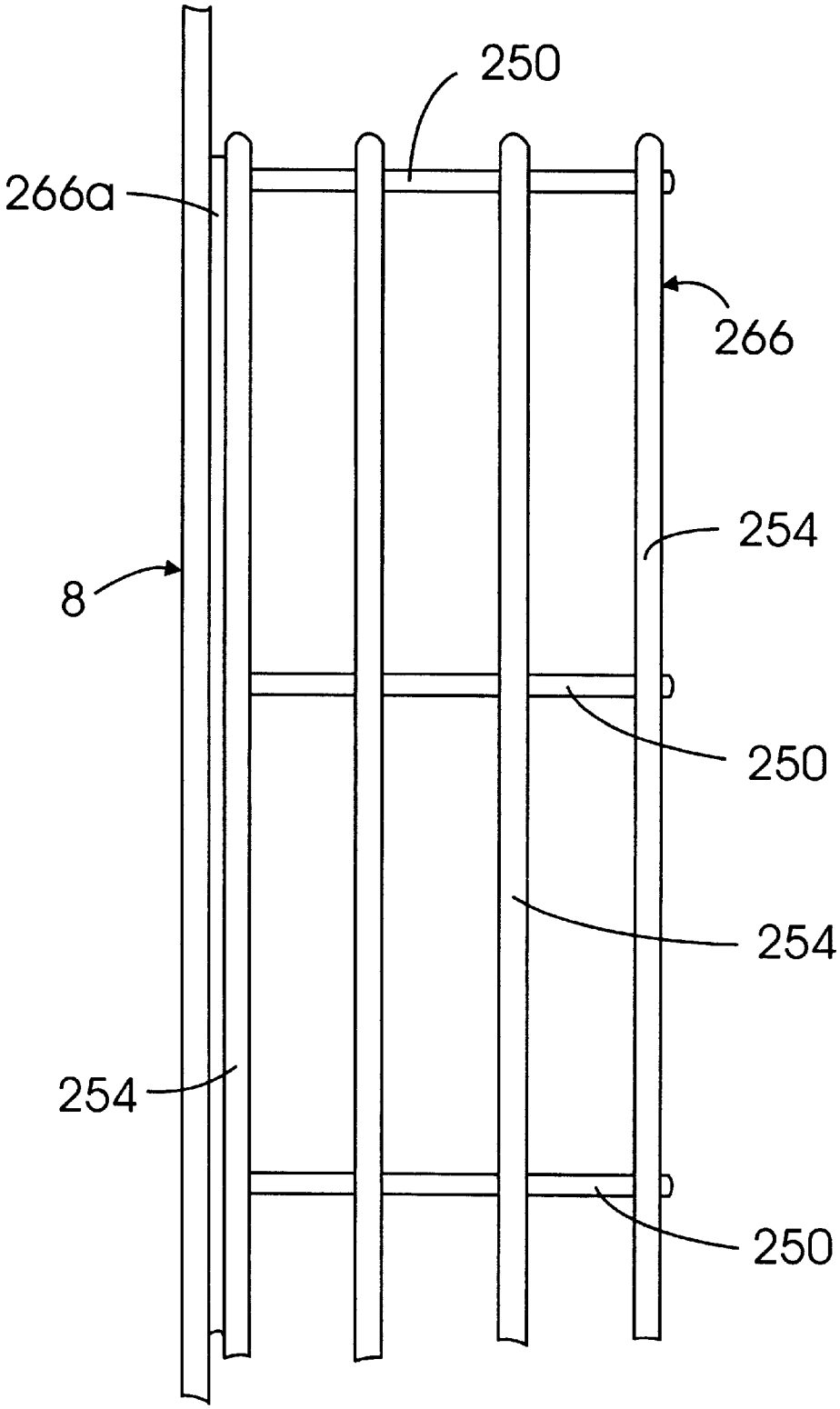
FIG. 39 is a side view of a wire panel attached to a standard.

While FIGS. 27–32 have shown wire shelves 224 supported by shelf brackets 16 located along the length of the shelves, wire shelves can also be supported by positioned at the end of the shelves. As for the nonwire shelving discussed above, locating the shelf supports at the end of the shelves can increase the over-all rigidity and strength of the shelving system, provide a cleaner look and, in addition, reduce costs and assembly time since fewer components are needed. FIG. 39 shows a wire panel 266 analogous to the panel described for nonwire shelving above. The wire panel 266 connects to a standard 8 by means of typical shelf bracket mounting ears (not shown). The base portion 266*a* of the panel connects the mounting ears to the rear cross wire 254 of the wire panel 266. The support wires 250 connect and support the cross wires 254.

Figure 40:
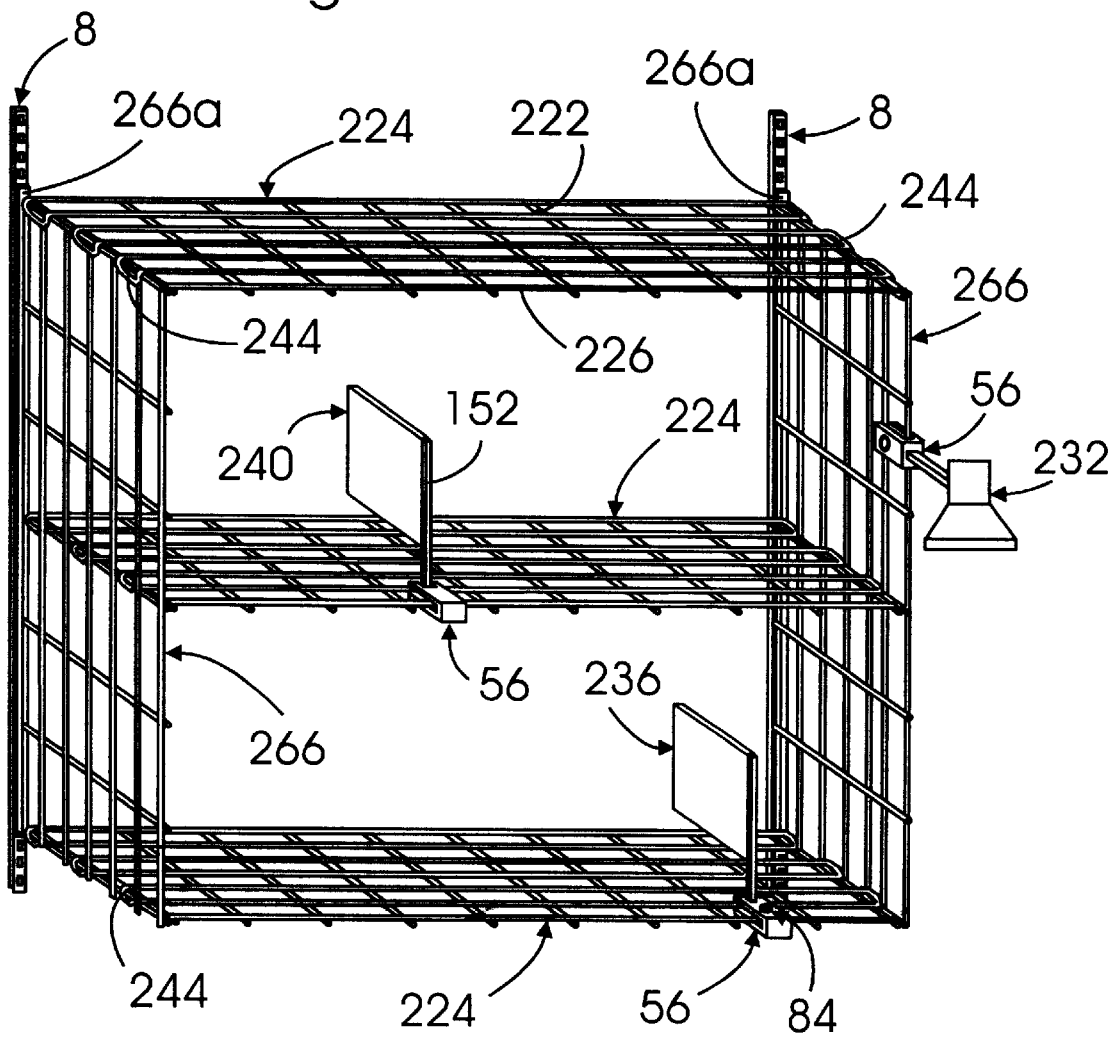
FIG. 40 is a front perspective view of a shelving system with wire shelves and wire panels.

FIG. 40 shows a wire shelving system formed of wire panels 266 and individual wire shelves 224. The wire panels 266 are attached to standards 8 as described for FIG. 39. For this type of shelving system, the wire shelving 224 can be connected to the wire panels using the approaches shown for attaching wire shelves 224 to wire side panels 228 in FIGS. 33–35 and FIG. 38. For the embodiment shown in FIG. 40, the wire shelves are connected using hangers 244 as described for FIG. 33. FIG. 36 also shows several partition assemblies and a lamp assembly described earlier for FIG. 27. The above components are formed for strong durable materials such as metal, wood or plastic.

FIGS. 41–45 show another approach for supporting a wire side panel, i.e., by use of a shelf bracket 16. FIG. 41 shows a shelf bracket 16 supporting a wire side panel 228 by means of cradle portions 16*b* of the shelf bracket 16, where the cradle portions fit on both sides of the support wire 272 at the upper end of the wire side panel 228. It will be noted that, for this and the following embodiments, both a wire side panel 228 and wire shelf 224 can be supported by the shelf bracket 16 positioned at the end of the wire shelf by using different combinations of the embodiments described herein.

FIG. 42 shows another embodiment of a shelf bracket 16 supporting a wire side panel 228. In this embodiment, the wire side panel 228 is provided with hangers 244 that fit over the shelf bracket 16 with the hangers preferably formed from the ends of the cross wires 276 of the wire side panel.

Figure 43:
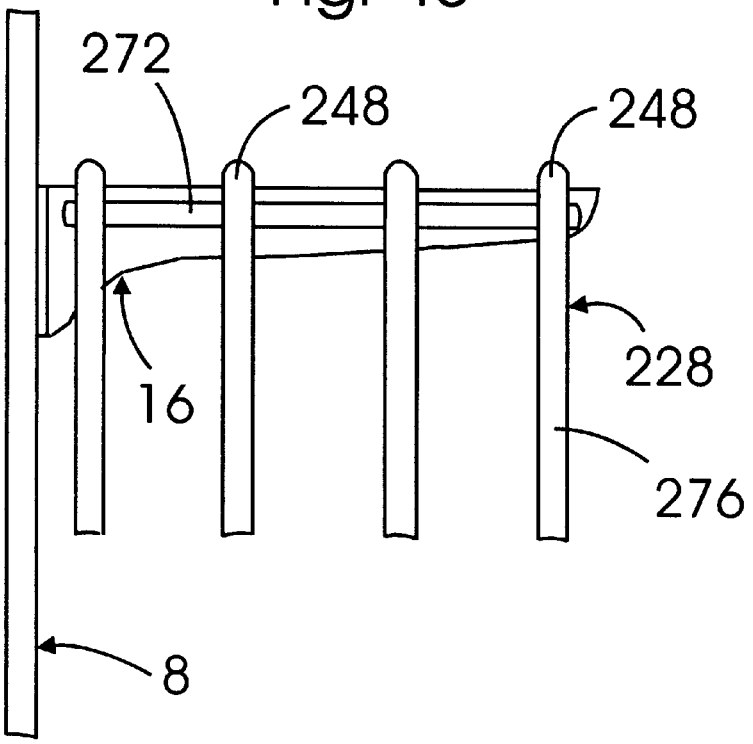
FIG. 43 is a side view of a wire side panel fastened to a shelf bracket via hooks at the top end of the side panel.

FIG. 43 shows yet another embodiment of a shelf bracket 16 supporting a wire side panel 228. In this embodiment, the wire side panel 228 is provided with separate hooks 248 that fit over the shelf bracket 16 with the hooks preferably formed from the ends of the cross wires 276 of the wire side panel 228.

Figure 44:
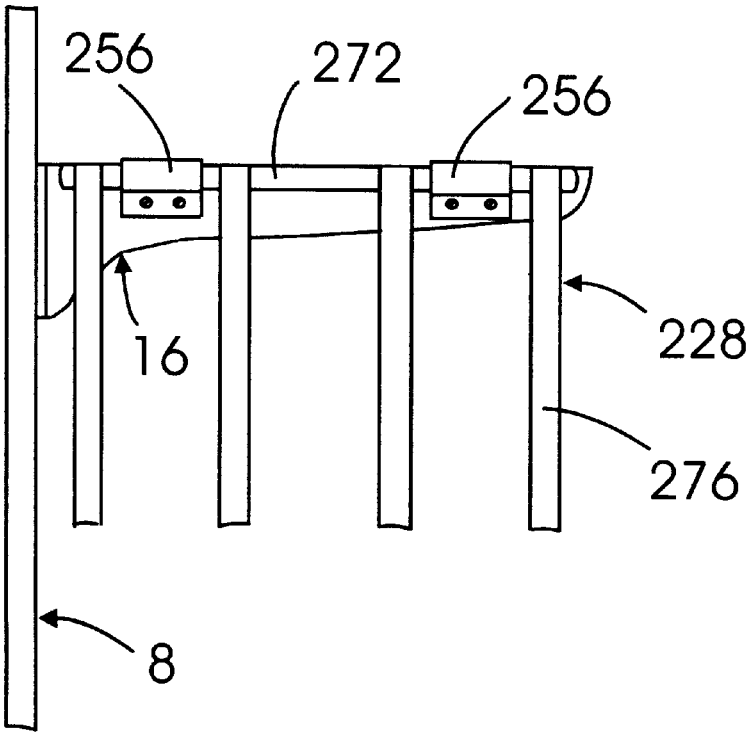
FIG. 44 is a side view of a wire side panel fastened to a shelf bracket via clips.

FIG. 44 shows yet another embodiment of a shelf bracket 16 supporting a wire side panel 228. In this embodiment, the wire side panel 228 is supported by separate clips 256 fastened to the shelf bracket 16 with the clips preferably positioned so that they engage the support wire 272 at the uppermost end of the wire side panel 228. The clips are attached to the bracket 16 with screws, strong adhesive, or similar means.

Figure 45:
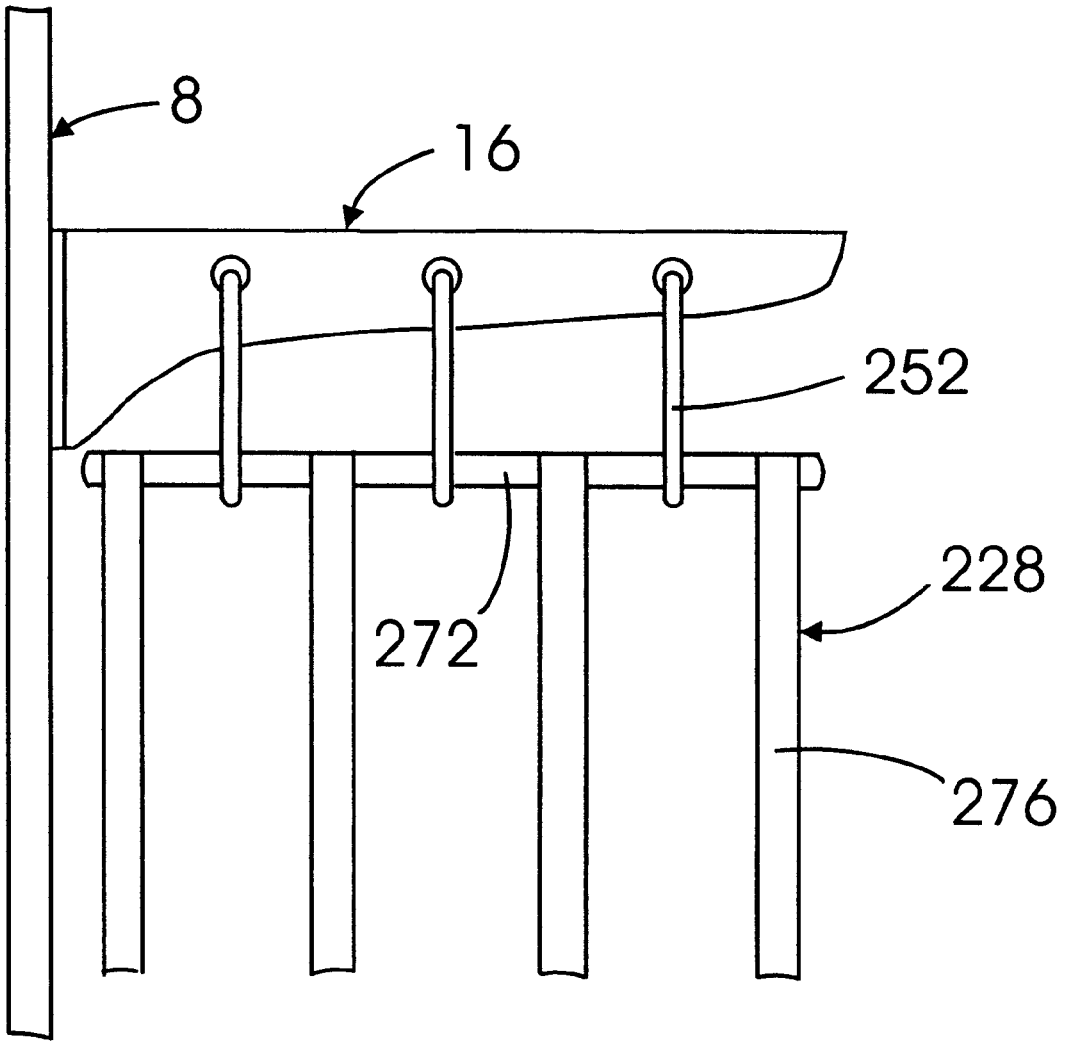
FIG. 45 is a side view of a wire side panel fastened to a shelf bracket via separate wire links.

FIG. 45 shows yet another embodiment of a shelf bracket 16 supporting a wire side panel 228. In this embodiment, the wire side panel 228 is supported by separate wire links 252 fastened to the shelf bracket 16 with the wire links preferably positioned so that they engage the support wire 272 at the uppermost end of the wire side panel 228.

Figure 46:
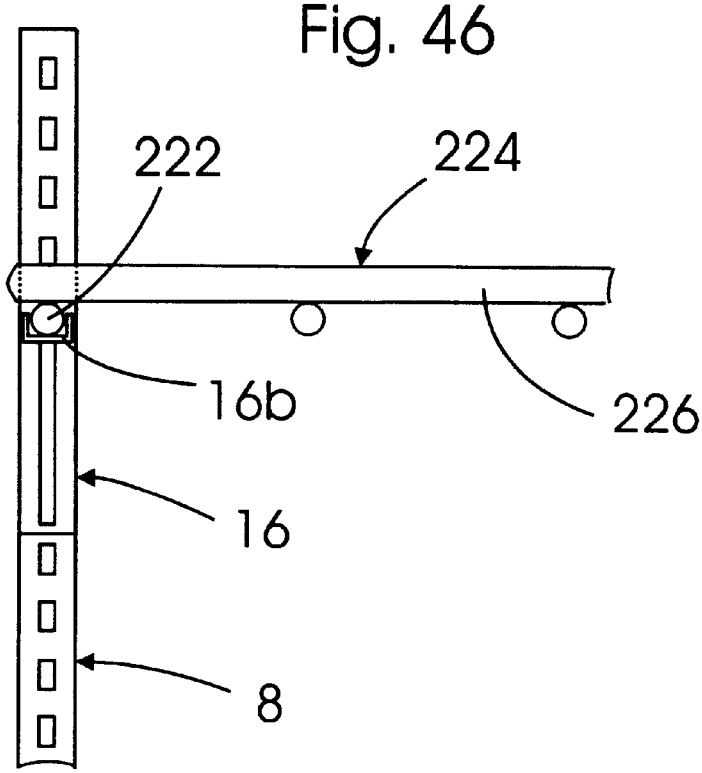
FIG. 46 is a front view of a wire shelf fastened to a shelf bracket via cradle portions of the shelf bracket.

As noted above, in addition to directly supporting wire side panels 228, shelf brackets 16 also can support the end of wire shelves 224. FIG. 46 shows a shelf bracket 16 supporting a wire shelf 224 by means of cradle portions 16*b* of the bracket 16 that fit on both sides of the support wire 222 at the end of the wire shelf 224. As also noted above, for this and the following embodiments, both a wire shelf 224 and wire side panel 228 can be supported by the shelf bracket 16 positioned at the end of the wire shelf.

Figure 47:
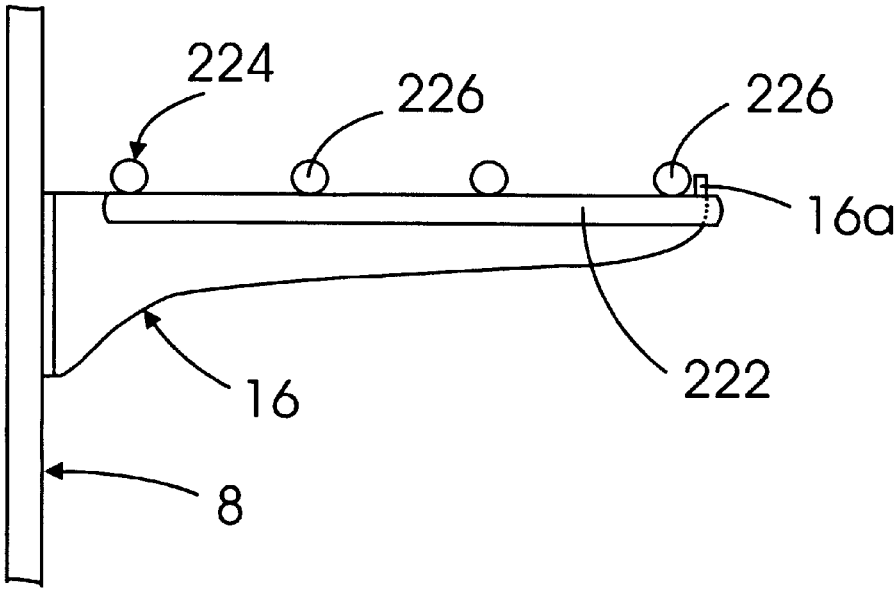
FIG. 47 is a side view of a wire shelf fastened to a shelf bracket via a support wire and retainer portion of the shelf bracket.

FIG. 47 shows another embodiment of a shelf bracket 16 supporting a wire shelf 224. In this embodiment, the support wires 222 of the wire shelf 224 fit over the the outside of the shelf bracket 16. The wire shelf is prevented from sliding forward away from the wall standards 8 by the retainer portion 16a of the shelf bracket 16 which engages the front cross wire 226 of the wire shelf 224.

Figure 48:
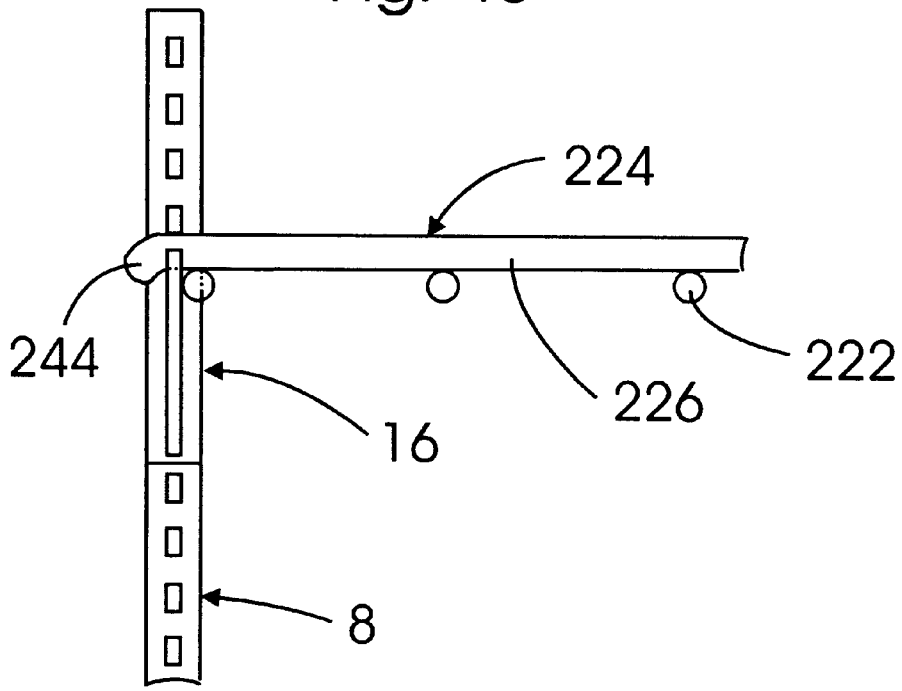
FIG. 48 is a front view of a wire shelf fastened to a shelf bracket via hangers at the end of said shelf.

FIG. 48 shows another embodiment of a shelf bracket 16 supporting a wire shelf 224. In this embodiment, the wire shelf 224 is provided with hangers 244 that fit over the shelf bracket 16 with the hangers preferably formed from the ends of the cross wires 226 of the wire shelf 224.

Figure 49:
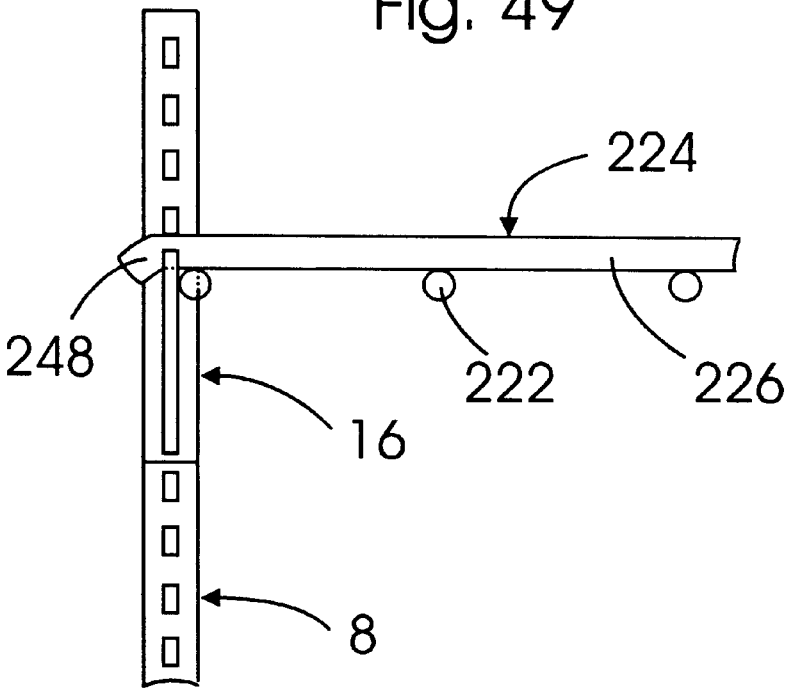
FIG. 49 is a front view of a wire shelf fastened to a shelf bracket via hooks at the end of said shelf.

FIG. 49 shows another embodiment of a shelf bracket 16 supporting a wire shelf 224. In this embodiment, the wire shelf 224 is provided with hooks 248 that fit over the shelf bracket 16 with the hooks preferably formed from the ends of the cross wires 226 of the wire shelf 224.

Figure 50:
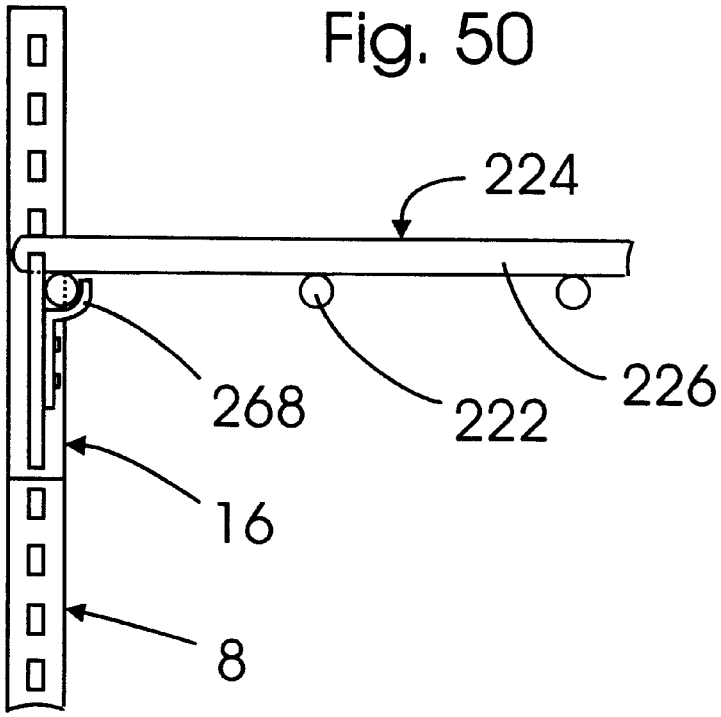
FIG. 50 is a front view of a wire shelf fastened to a shelf bracket via clips.

FIG. 50 shows yet another embodiment of a shelf bracket 16 supporting a wire shelf 224. In this embodiment, the wire shelf 224 is supported by clips 256 fastened to the shelf bracket 16 with the clips preferably positioned so that they engage the support wire 222 at the end of the wire shelf 224. The clips are attached to the bracket with screws, strong adhesive, or similar means.

Figure 51:
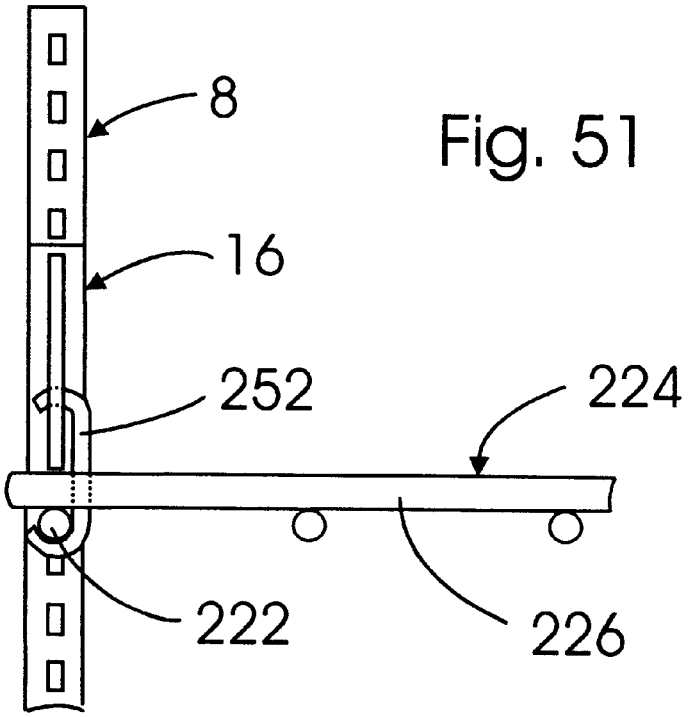
FIG. 51 is a front view of a wire shelf fastened to a shelf bracket via separate wire links.

FIG. 51 shows another embodiment of a shelf bracket 16 supporting a wire shelf 224. In this embodiment, the wire shelf is supported by separate wire links 252 fastened to the shelf bracket 16 with the wire links preferably positioned so that they engage the support wire 222 at the end of the wire shelf 224.

Figure 52:
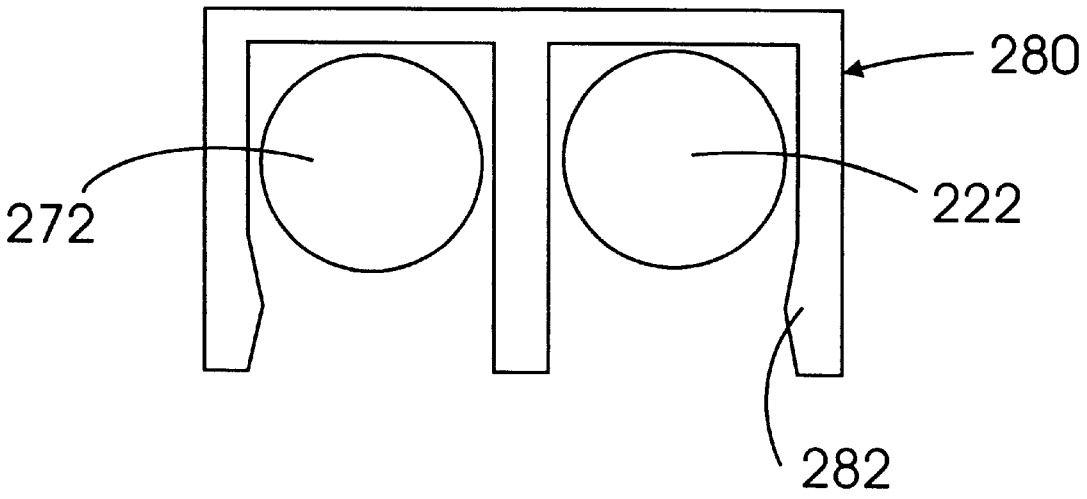
FIG. 52 is a front view of a clip for fastening together a wire shelf and a wire side panel.
Figure 53:
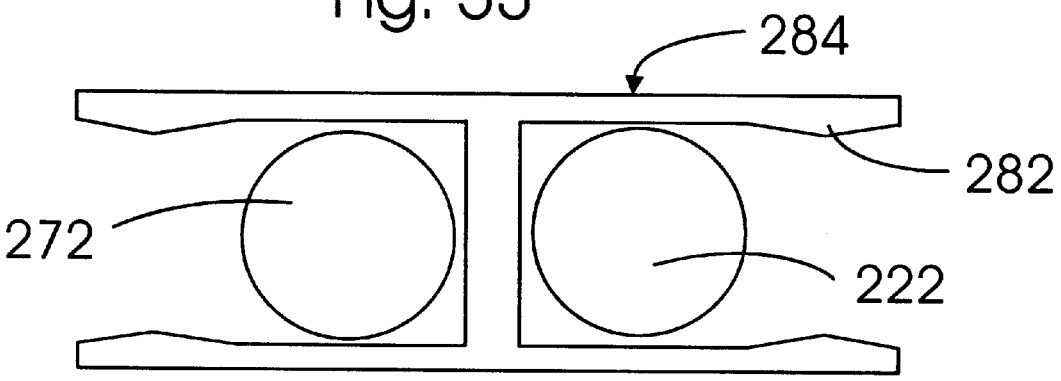
FIG. 53 is a front view of an alternative clip for fastening together a wire shelf and a wire side panel.
Figure 54:
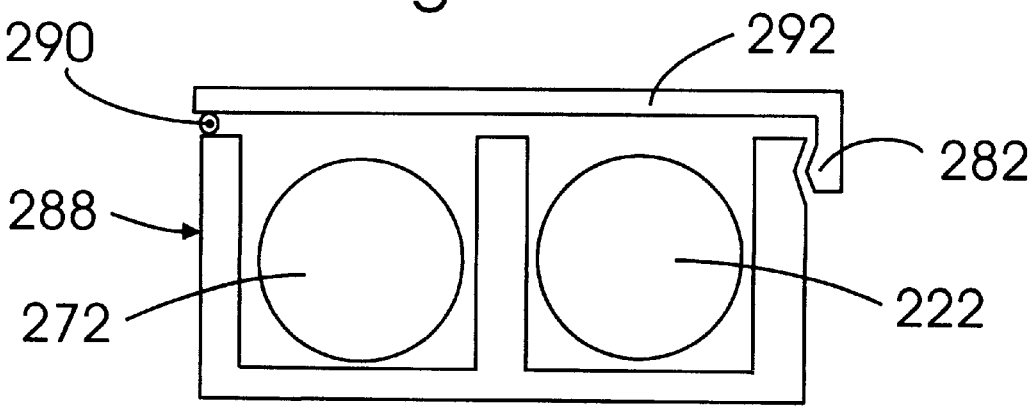
FIG. 54 is a front view of yet another alternative clip for fastening together a wire shelf and a wire side panel.

In addition to fastening the top of wire side panels 228 to wire shelves 224 or shelf brackets 16, wire side panels 228 can be provided with added stability by fastening them to additional wire shelves 224 or shelf brackets 16. FIGS. 52–54 show various clips that can be used to connect the support wires 272 of wire side panels 228 and the support wires 222 of wire shelves 224. FIG. 52 shows an M-shaped clip 280 which fits over support wires for wire shelves 222 and support wires for wire side panels 272. The protrusions 282 hold the clip in place after the clip is pressed, by hand, over the support wires.

FIG. 53 shows another embodiment for connecting the support wires 272 of wire side panels 228 and the support wires 222 of wire shelves 224 with an H-shaped clip 284. This clip also has protrusions 282 to hold the clip in place after being pressed, by hand, over the support wires.

FIG. 54 shows yet another embodiment for connecting the support wires 272 of wire side panels 228 and support wires 222 of wire shelves 224 with an W-shaped clip 288. This clip has a retainer lid 292 with a hinge 290 and a latch 282 to hold the lid in place after the clip is pressed over the support wires and the retainer lid 292 is closed and latched.

Figure 55:
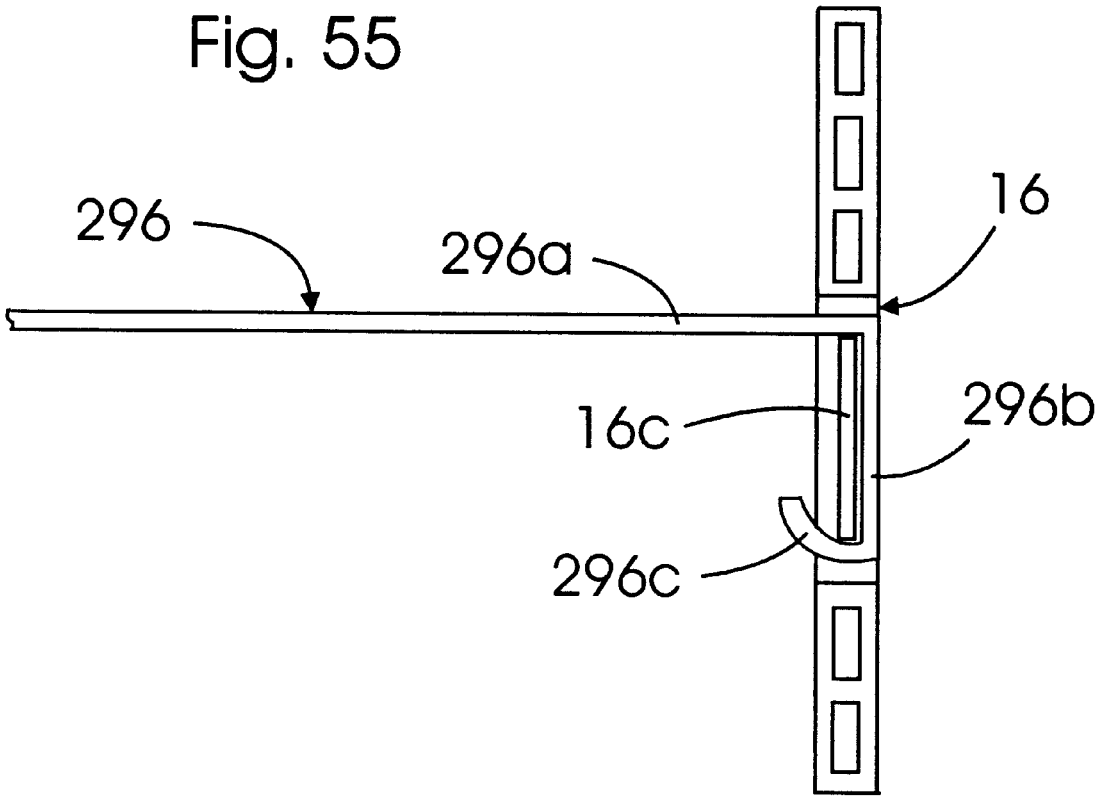
FIG. 55 is a front view of a sheet metal shelf supported by a shelf bracket.

FIGS. 55–58 show various embodiments of a shelving system substantially combining the elements of wall shelving using standards and shelf brackets and free-standing sheet metal shelving. Such a combination provides much of the strength and stability of wall-mounted shelving with the low cost and light weight of sheet metal shelving. Also, the system is more attractive than conventional shelving, since the metal shelf bracket is masked by the shelf. FIG. 55 shows a front view of a shelf bracket 16 supporting a sheet metal shelf 296, with the blade portion 16*c* of the shelf bracket 16 inserted into the sheet metal shelf 296 such that the blade portion is underneath the sheet metal body portion 296*a,* beside the sheet metal shelf edge bend portion 296*b* and inside the edge bend curl portion 296*c*. This embodiment could also be constructed using plastic shelving rather than sheet metal shelving. As with the use of sheet metal shelving, combining the elements of wall-mounted shelving using standards and brackets with free-standing plastic shelving would provide much of the strength and stability of wall-mounted shelving with the low cost and light weight of plastic shelving. The above components are formed of strong durable materials such as metal, wood or plastic.

Figure 56:
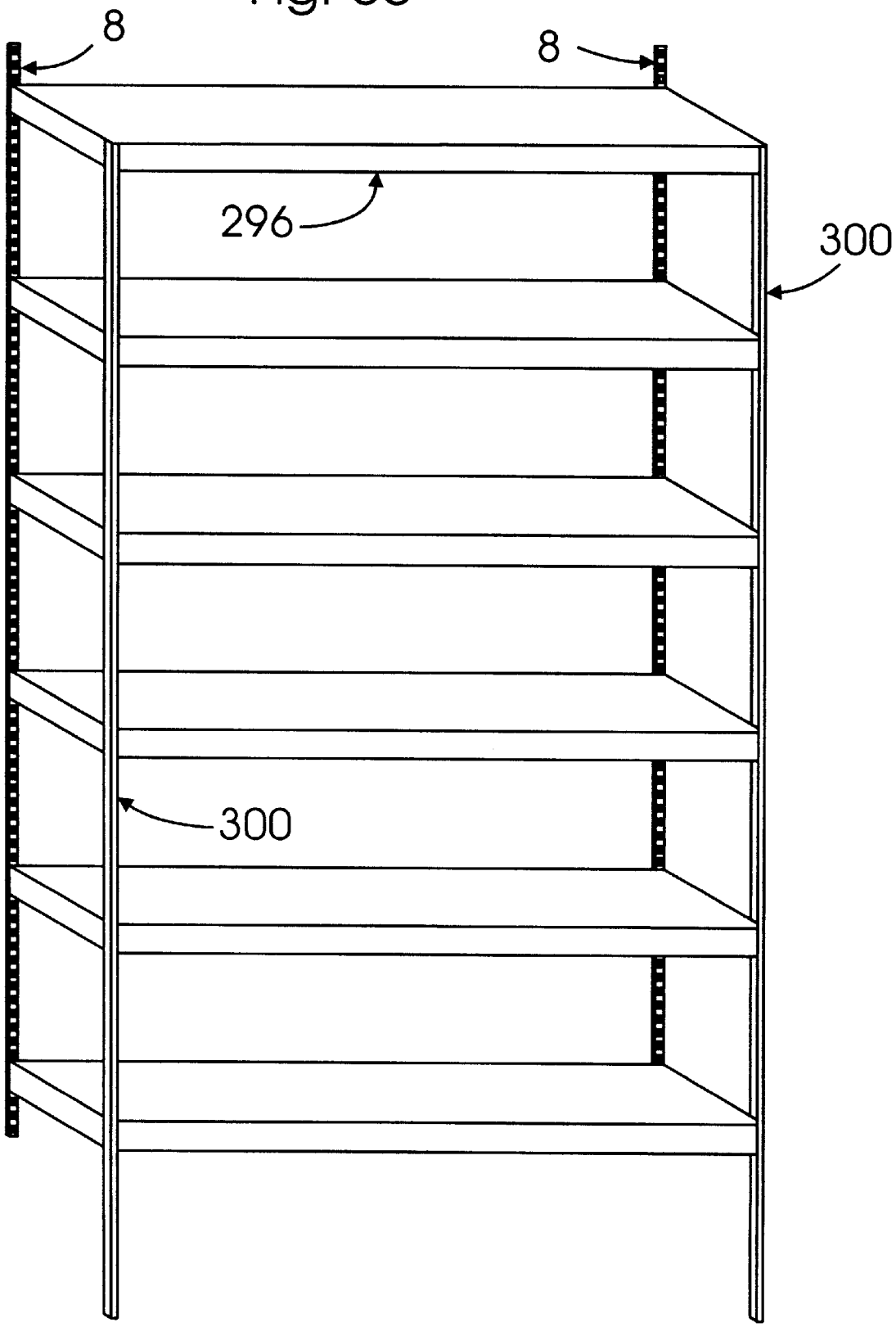
FIG. 56 is a front perspective view of a shelving system with standards, shelf brackets, sheet metal shelves and front legs.

FIG. 56 shows the use of wall standards 8 and shelf brackets 16 to support the rear corners of a set of sheet metal shelves 296, with the front of the sheet metal shelves supported by the typical metal legs 300 used to support sheet metal shelves.

Figure 57:
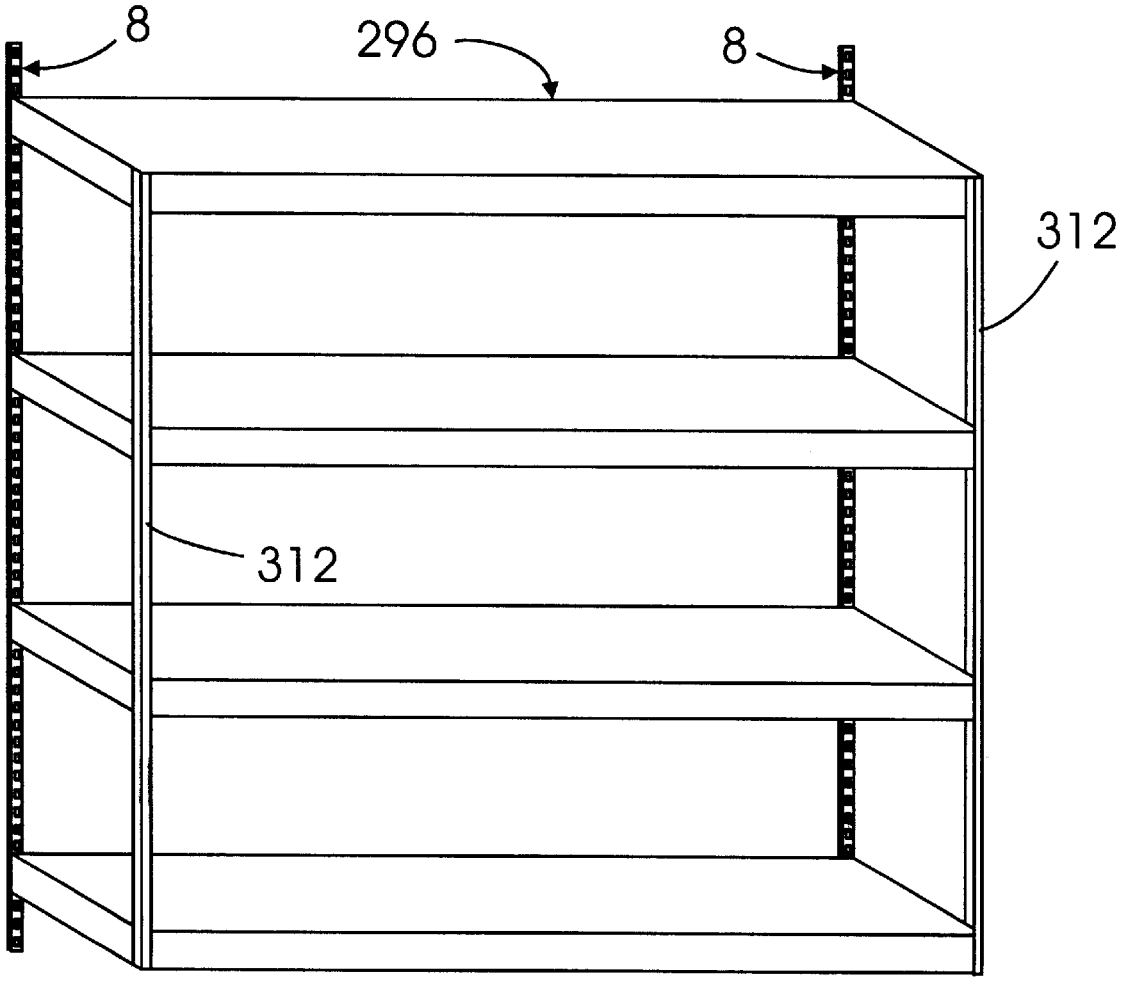
FIG. 57 is a front perspective view of a shelving system with standards, shelf brackets, sheet metal shelves and front supports.

FIG. 57 shows another embodiment, with wall standards 8 and shelf brackets 16 supporting the rear corners of sheet metal shelves 296, with the front of the sheet metal shelves provided with partial metal legs or supports 312 that, while they do not support the weight of the shelves, help provide rigidity and keep the front of the sheet metal shelves 296 in alignment.

Figure 58:
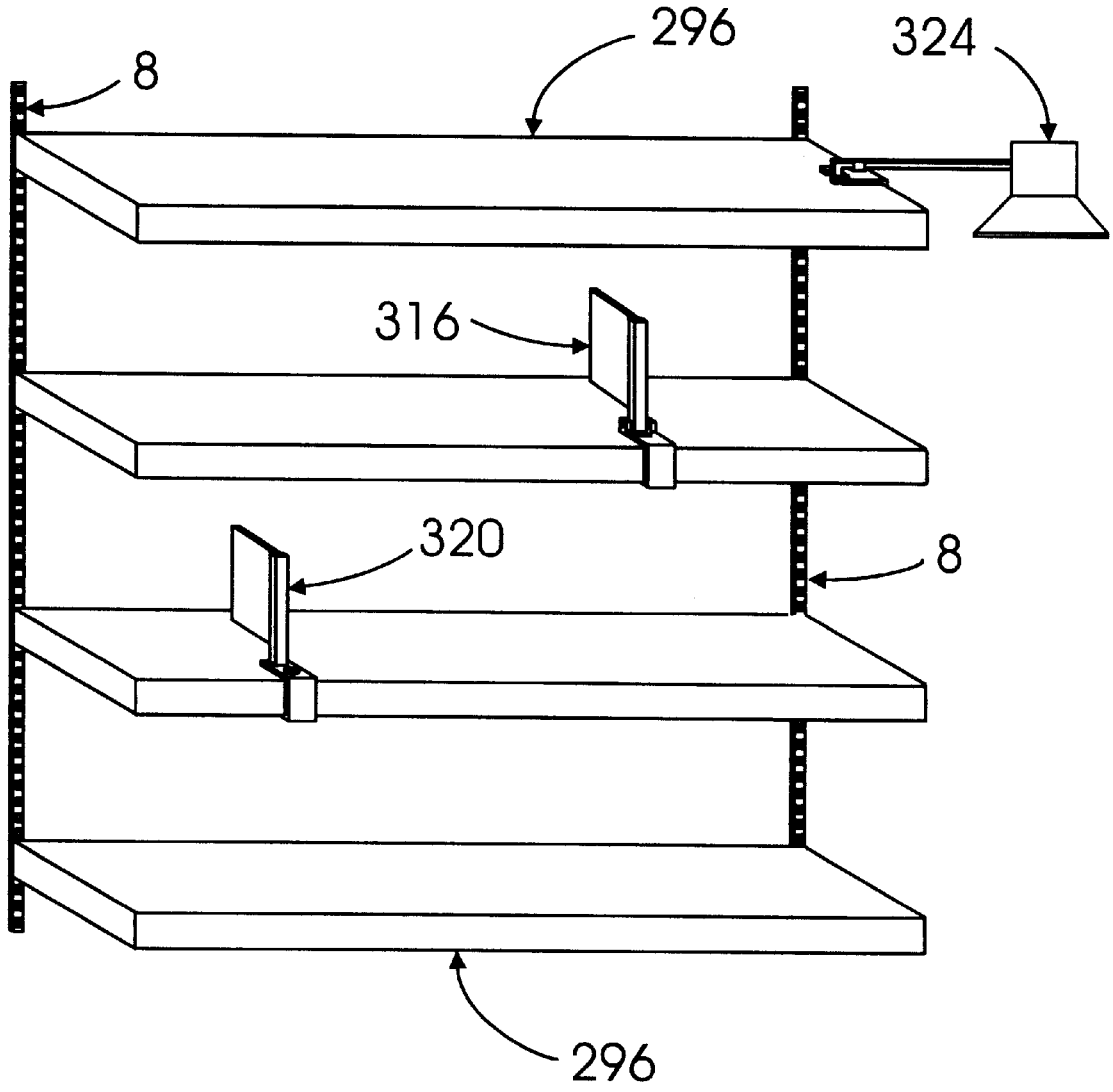
FIG. 58 is a front perspective view of a shelving system with standards, shelf brackets and sheet metal shelves.

FIG. 58 shows yet another embodiment, with wall standards 8 and shelf brackets 16 supporting the rear corners of sheet metal shelves 296. In this embodiment, the omission of the front legs and supports provides a cleaner look and improved access to the shelves but with some reduction in rigidity and strength. FIG. 58 also shows a partition assembly with a clamping member for a sheet metal shelf 316, a partition assembly with a screw fastener for sheet metal shelving 320, and a lamp assembly with a clamping member for sheet metal shelving 324. These partition and lamp assemblies have been previously described in U.S. Patents to Stuart (U.S. Pat. Nos. 5,655,670; 6,044,982; and 6,119,992) .

Figure 59:
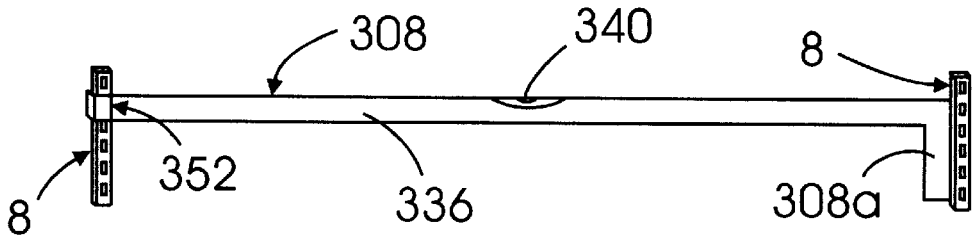
FIG. 59 is a front view of a shelf installation guide.

FIG. 59 shows a front view of a shelf installation guide 308 with a guide body 336, a bubble level 340, a right angle portion 308*a* and one or two optional clips 352. The guide is used to help ensure that the shelving standards 8 are installed correctly with the length of the guide body 336 preferably equal to the desired distance between the standards 8 of the to be installed shelving system. The bubble level 340 indicates when the guide body is in the horizontal position and the right angle portion 308*a* shows the upright position, i.e., perpendicular to the horizontal position. The optional clips 352 connect to the guide body 336 and grip the shelf standards 8 to help hold the guide and/or the standards in position for installing the standards 8 on the wall. The above components are formed of strong durable materials such as metal, wood or plastic. An inexpensive version of the guide 308 could be provided to consumers as a part of the shelving system.

The operation of the guide is as follows: First, the top of a standard 8 is loosely attached to the wall at the location of one of the upper-most corners of the desired shelving installation. The end of the shelf installation guide 308 having the right angle portion 308*a* is then held against the lower portion of the standard 8 and used to determine, using the level 340, when the standard 8 is in the perpendicular position. Once the perpendicular position is determined, the top and bottom of the standard 8 is attached to the wall at this position. To add the next standard for the shelving installation, one end of the guide (with or without the optional clip 352) would be held against the top of the first standard and, with the level showing a horizontal position, the wall would be marked at the other end of the guide 308 to show the needed location of the top of the next wall standard 8. The top of this next standard 8 would be loosely attached to the wall at the marked location and then the guide would be used to position the bottom of this added standard in the perpendicular position. This position would also be marked and the second standard attached to the wall at the desired positions for the top and bottom of the standard. The guide 308 would also be used to check the position of the standards prior to completing the installation of the shelving system by placing the guide at the level position, as indicated by the level 340, at various locations between the standards 8 and checking that the standards are the correct distance apart, i.e., the distance is the same as the length of the guide body 336.

Figure 60:
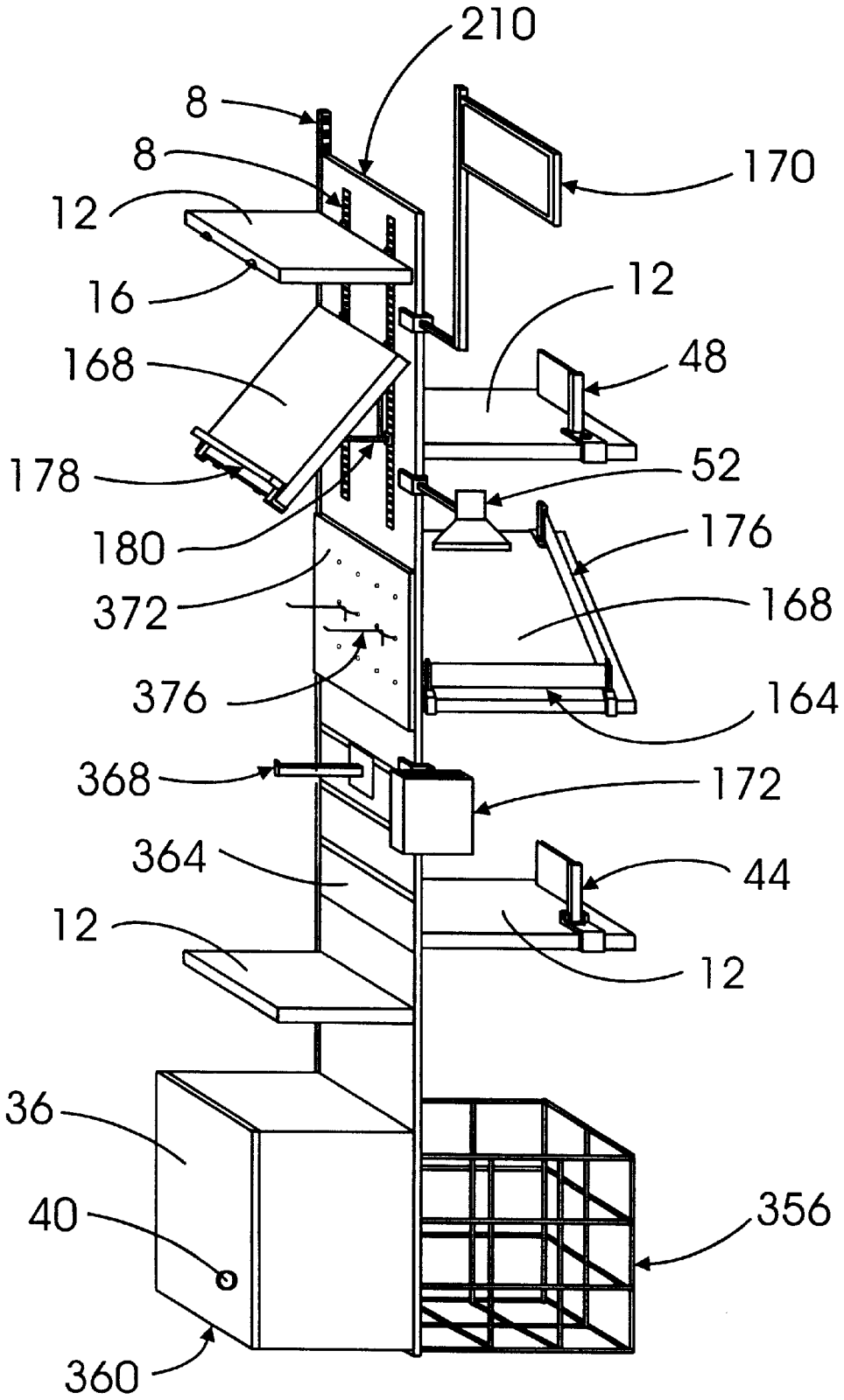
FIG. 60 is a front perspective view of a shelving system using one standard and a panel.

In addition to shelving requiring two or more standards, shelving can also be supported by one standard. For example, FIG. 60 shows a shelving system consisting of one panel 210 attached to a standard 8 and supporting shelves 12 and other items. The embodiment shown provides a number of provisions for commercial use. As shown in the figure, the panel can support various types of surfaces and hardware suitable for use in the display and storage of merchandise, including ordinary shelves 12 and slanted display shelves 168. These shelves are either directly attached to the panel or supported by shelf brackets 16 or slanted shelf brackets 180 and standards 8 attached to the panel 210. Other surfaces and hardware suitable for use in the display and storage of merchandise includes the use of pegboard 372 and pegboard hardware 376, slatwall 364 and slatwall hardware 368, a wire basket 356 and a storage cabinet 360 with a side-hung door 36 and knob 40. The above components are formed of strong and durable materials such as metal, wood or plastic.

FIG. 60 also shows a number of items previously discussed in FIG. 14, including a sign holder 170, lamp 52, screw fastener partition 48, clamping bookend partition 44, banding supported by a clamping member 164, a banding strip 178, binning 176, and a literature dispenser 172.

Figure 61:
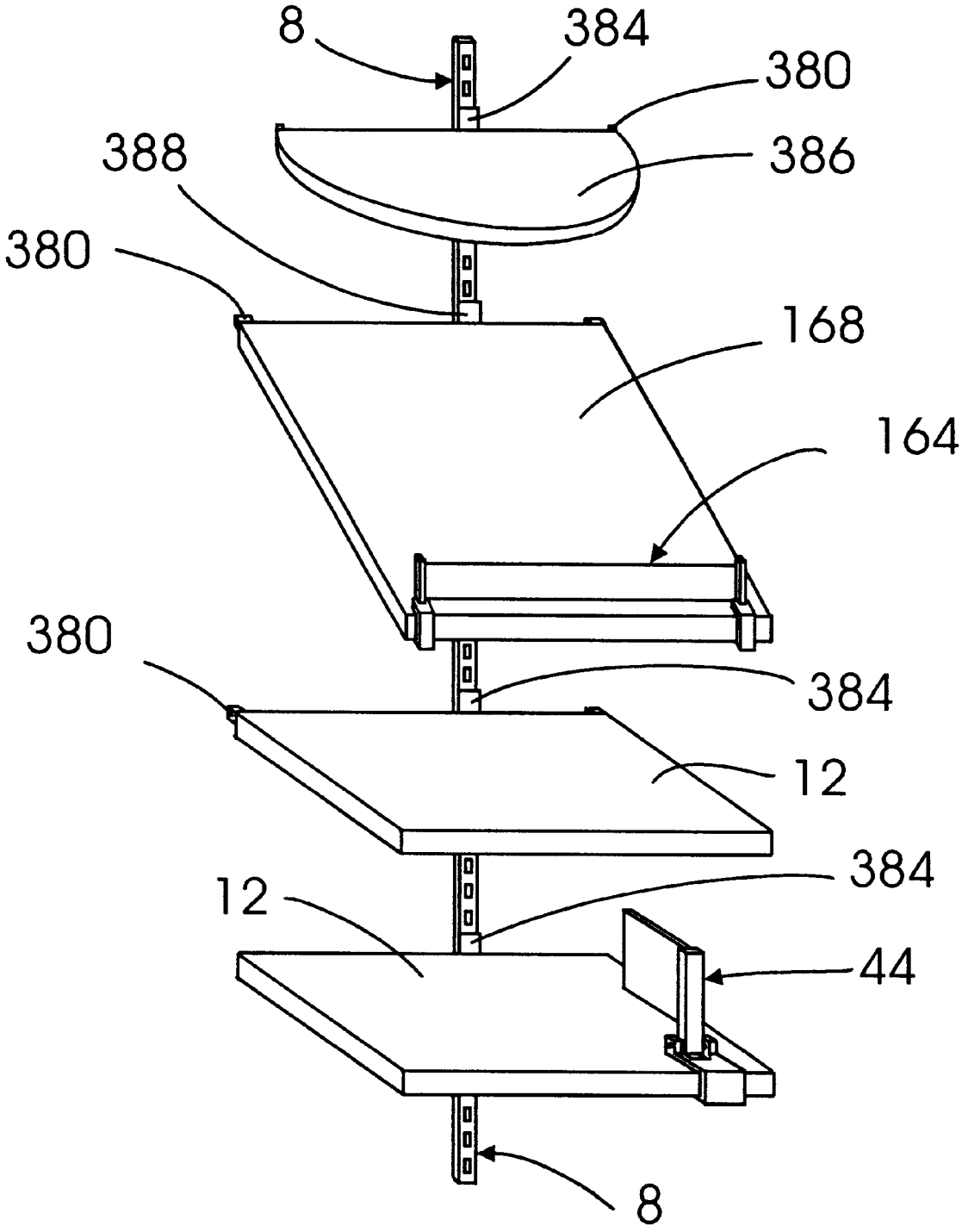
FIG. 61 is a front perspective view of a shelving system using one standard, shelf brackets and several shelves.

FIG. 61 shows another shelving system which uses one standard 8 but does not use a 210. In this system, which would be useful for displaying merchandise, the individual shelves are supported by one standard 8 which supports shelf brackets 384 and slanted display shelf brackets 388 designed to attach to the shelves. These shelf bracket could be attached to the shelves using a strong adhesive or could be fastened using screws or similar mechanical means. FIG. 61 shows several different types of shelves that could be used with this system, including ordinary shelving 12, rounded shelving 386 and slanted display shelving 168. Optional spacers 380 are provided to prevent any rotation of the shelf around the standard's vertical axis. Said spacers could be mounted to the edge of the shelf using an adhesive or fasteners such as screws. Several previously described items useful in organizing items on a shelf are also shown, i.e., banding supported by clamping members 164 and a clamping bookend partition 44. It will be noted that additional items used to organize shelves, e.g., the screw fastener partition 48, banding strip 178, and binning 176 shown above in FIG. 60, would also be suitable for use in the shelving system shown in FIG. 61. The above components are formed of strong durable materials such as metal, wood or plastic.

Figure 62:
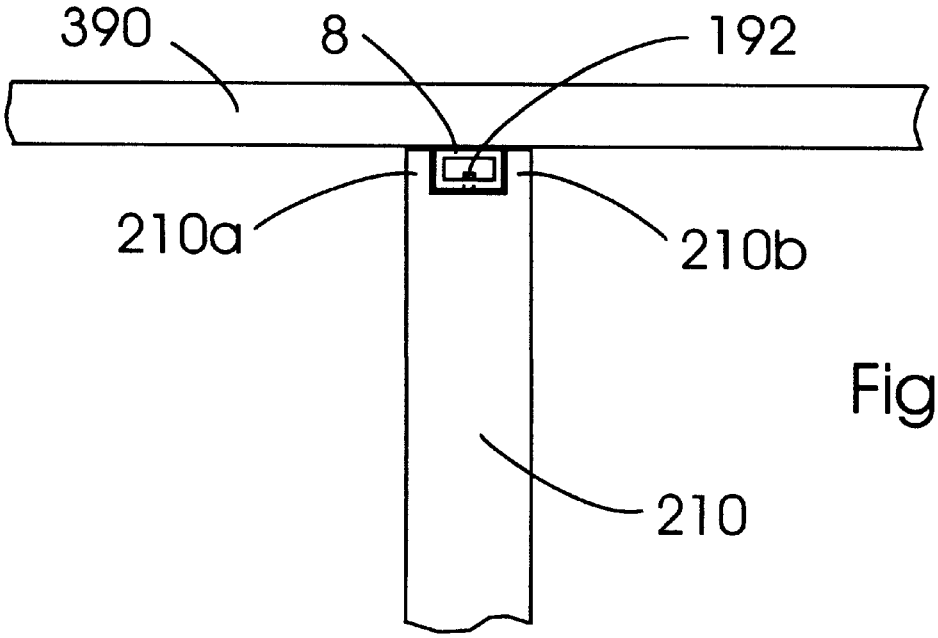
FIG. 62 is a top view of a panel with recessed mounting ears.

FIG. 62 shows a panel 210 with recessed mounting ears 192. As noted above, this embodiment, in addition to providing a cleaner look, also reduces side to side sway since the shoulder portions 210*a* and 210*b* contact the supporting wall 390 and thus help lock the panel in place. This embodiment can, of course, be used with shelving requiring one, two, or more standards.

Figure 63:
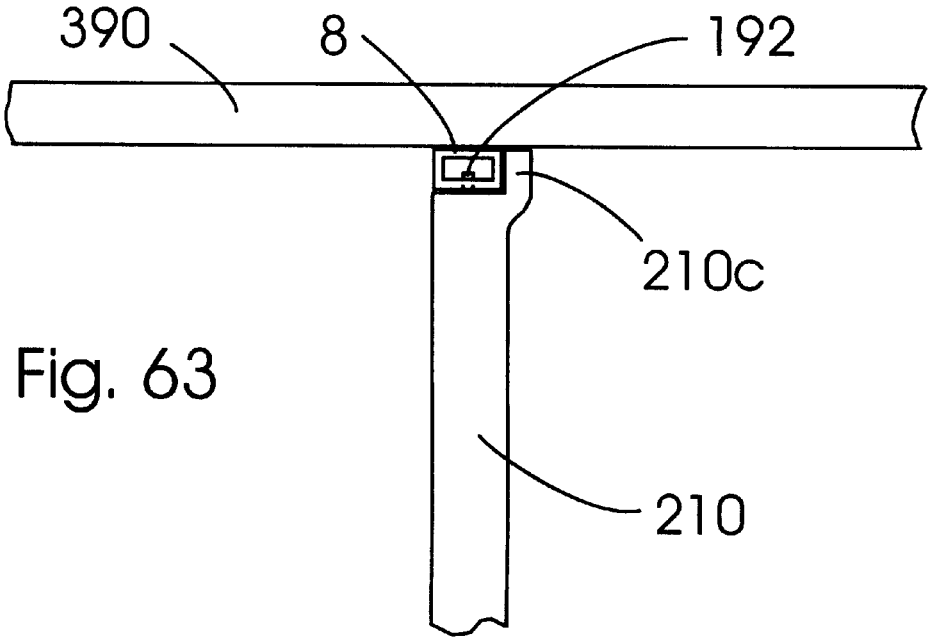
FIG. 63 is a top view of a panel with an anti-sway brace portion.

FIG. 63 shows a panel 210 with an anti-sway brace portion 210*c* that reduces side to side sway. Said anti-sway brace portion could be located on either side of the panel (for example, said brace portion could be located on the interior side of two panels used together as the sides of a shelving assembly). Panel with anti-sway brace portions would be used in pairs to prevent sway with one of the pair preventing sway in one direction, e.g., to the right, and the other of the pair preventing movement in the opposite direction, e.g., to the left.

Figure 64:
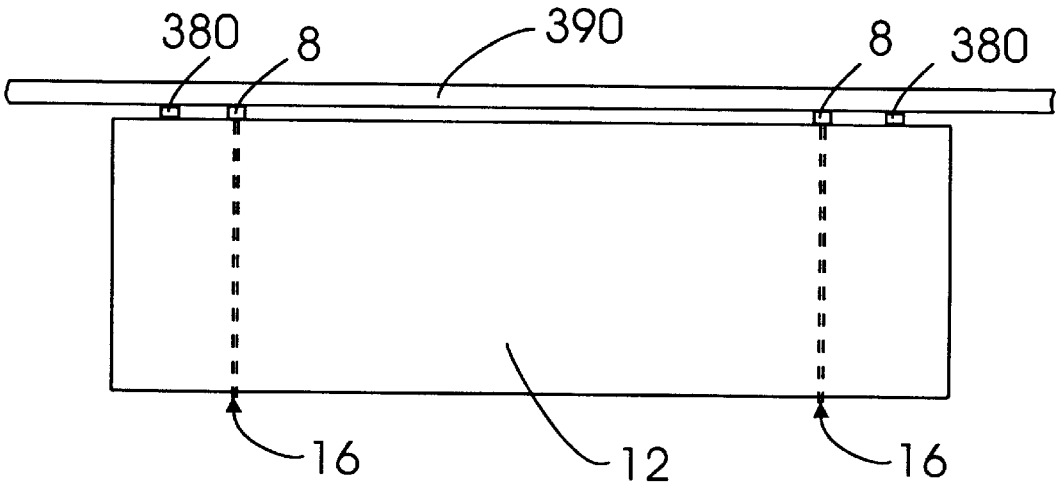
FIG. 64 is a top view of a shelving system with spacers.

FIG. 64 shows a shelf 12 having spacers 380 and supported by standards 8 and shelf brackets 16. As noted above, said spacers could be mounted to the edge of the shelf using an adhesive or fasteners such as screws. As in FIG. 61, said spacers prevent rotation around the vertical axis of the standards and thus prevent side to side sway.

In accordance with the provisions of the Patent Statutes the preferred forms and embodiments of the invention have been illustrated and described, it will be apparent to those of ordinary skill in the art that various changes and modifications may be made without deviating from the inventive concept set forth above.

What is claimed is:

1. A wall-mounted shelving system comprising a. a plurality of elongated standards secured to a wall, each said elongated standard having a vertical axis, said standards containing a plurality of slots;

b. a plurality of shelf brackets removably connected with said standards via said slots;

c. one or more shelves with a plurality of ends, wherein said shelves are supported by said shelf brackets; and d. a plurality of side panels, each said side panel having means for removable attachment of said side panel to said ends of said shelves, so as to easily and removably enclose said shelves at said ends.

2. A shelving system as defined in claim 1, wherein said means for attaching said side panels consists of a cam assembly.

3. A shelving system as defined in claim 1, wherein said means for attaching said side panels consists of a clamping foot.

4. A shelving system as defined in claim 1, wherein said means for attaching said side panels consists of a screw fastener.

5. A shelving system as defined in claim 1, wherein said means for attaching said side panels consists of a pull rod.

6. A shelving system as defined in claim 1, wherein said means for attaching said side panels consists of a clamping leg.

7. A shelving system as defined in claim 1, wherein said side panels and said shelves are made of wire and wherein said means for attaching said side panels consists of one or more hangers.

8. A shelving system as defined in claim 7, wherein said means for attaching said side panels consists of one or more wire hooks.

9. A shelving system as defined in claim 7, wherein said means for attaching said side panels consists of one or more wire links.

10. A shelving system as defined in claim 7, wherein said means for attaching said side panels consists of one or more clips.

11. A shelving system as defined in claim 7, wherein said means for attaching said side panels consists of one or more grooves.

12. A shelving system as defined in claim 1, and further comprising spacers located between the wall and the rear edge of said shelf in order to prevent swaying and rotation of said shelf brackets relative to said standard axis.

13. A shelving system as defined in claim 1, and further comprising a door pivotally connected with one of said side panels.

14. A shelving system as defined in claim 1, and further comprising a lid pivotally connected with one of said shelves.

15. A shelving system as defined in claim 1, and further comprising a drawer slidably connected between said side panels.

16. A shelving system as defined in claim 1, wherein said side panels are formed of wire and further comprising one or more wire shelves supported by said side panels, with means for fastening said wire shelves to said side panels.

17. A shelving system as defined in claim 16, wherein said means for fastening said wire shelves includes at least one of hangers, hooks, wire links, clip, groove, or connecting bracket.

* * * * *